US012458142B2

(12) United States Patent
Harikrishnasamy et al.

(10) Patent No.: US 12,458,142 B2
(45) **Date of Patent: *Nov. 4, 2025**

(54) BRACKET SYSTEM FOR MOUNTING AN APPLIANCE TO A CABINET STRUCTURE

(71) Applicant: WHIRLPOOL CORPORATION, Benton Harbor, MI (US)

(72) Inventors: Arunkumar Harikrishnasamy, Stevensville, MI (US); Manjunathraddi Navalgund, Pune (IN); Sanket Vivek Phalak, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 819 days.

This patent is subject to a terminal disclaimer.

(21) Appl. No.: 17/676,893

(22) Filed: Feb. 22, 2022

(65) Prior Publication Data

US 2022/0400855 A1 Dec. 22, 2022

Related U.S. Application Data

(63) Continuation of application No. 17/354,069, filed on Jun. 22, 2021, now Pat. No. 11,666,145.

(51) Int. Cl.
*A47B 77/08* (2006.01)
*F25D 23/10* (2006.01)

(52) U.S. Cl.
CPC ..... *A47B 77/08* (2013.01); *F25D 23/10* (2013.01)

(58) Field of Classification Search
CPC ... A47B 77/08; A47B 2096/208; F25D 23/10; F25D 2323/024
See application file for complete search history.

(56) References Cited

U.S. PATENT DOCUMENTS

| | | | |
|---|---|---|---|
| 3,392,720 | A | 7/1968 | Sherman |
| 7,770,985 | B2 | 8/2010 | David et al. |
| 8,382,219 | B2 | 2/2013 | Hottmann et al. |
| 8,439,460 | B2 | 5/2013 | Laible et al. |

(Continued)

FOREIGN PATENT DOCUMENTS

| | | | |
|---|---|---|---|
| AU | 2009200623 | A1 | 2/2009 |
| DE | 102008041487 | A1 | 2/2010 |

(Continued)

*Primary Examiner* — Matthew W Ing
(74) *Attorney, Agent, or Firm* — Price Heneveld LLP

(57) ABSTRACT

A bracket system for coupling an appliance to a cabinet structure includes a mounting bracket having an inner wall spaced-apart from an outer wall and a plurality of apertures is provided through the outer wall. The inner wall couples to the outer surface of the appliance in assembly. A trim member includes first and second mounting portions and an abutment portion inwardly offset from the first and second mounting portions. The first and second mounting portions each include a plurality of apertures disposed therethrough. An inner surface of the first mounting portion abuts the outer wall of the mounting bracket, such that the apertures disposed therebetween are aligned. The second mounting portion includes a plurality of apertures disposed therethrough, and an outer surface of the second mounting portion is configured to abut the inner surface of the cabinet compartment for mounting thereto.

16 Claims, 54 Drawing Sheets

(56) References Cited

U.S. PATENT DOCUMENTS

| | | | | |
|---|---|---|---|---|
| 8,485,615 | B2 | 7/2013 | Ciyanoglu et al. | |
| 8,789,902 | B2 | 7/2014 | Hottmann et al. | |
| 9,032,675 | B2 | 5/2015 | Laible et al. | |
| 9,185,976 | B2 | 11/2015 | Chen et al. | |
| 10,165,860 | B2 | 1/2019 | Hawkins et al. | |
| 2009/0165268 | A1* | 7/2009 | Laible ..... | A47B 77/08 24/589.1 |
| 2011/0025173 | A1 | 2/2011 | Ciyanoglu et al. | |

FOREIGN PATENT DOCUMENTS

| | | | |
|---|---|---|---|
| EP | 2279384 | A1 | 2/2011 |
| EP | 2658053 | B1 | 5/2015 |

* cited by examiner

BRACKET SYSTEM FOR MOUNTING AN APPLIANCE TO A CABINET STRUCTURE

CROSS REFERENCE TO RELATED APPLICATION

This application is a continuation of U.S. patent application Ser. No. 17/354,069, now U.S. Pat. No. 11,666,145, filed on Jun. 22, 2021, entitled BRACKET SYSTEM FOR MOUNTING AN APPLIANCE TO A CABINET STRUCTURE, the entire disclosure of which is hereby incorporated by reference.

BACKGROUND OF THE DISCLOSURE

The present disclosure generally relates to a bracket system for an appliance, and more specifically, to a bracket system for mounting an appliance to a cabinet structure.

SUMMARY OF THE DISCLOSURE

According to one aspect of the present disclosure, a bracket system for use between an outer surface of an appliance and an inner surface of a cabinet structure includes a mounting bracket with an inner wall spaced-apart from an outer wall with at least one sidewall that interconnects the inner wall and the outer wall. A channel is defined between the inner wall and the outer wall. A plurality of apertures is provided through the outer wall. Each aperture of the plurality of apertures opens into the channel. The inner wall is configured to abut the outer surface of the appliance. A trim member includes first and second mounting portions and an abutment portion inwardly offset from the first and second mounting portions. The first mounting portion includes a plurality of apertures disposed therethrough. One or more of the apertures of the plurality of apertures of the first mounting portion of the trim member align with one or more of the apertures of the plurality of apertures of the mounting bracket to define aligned mounting apertures therebetween. An inner surface of the first mounting portion abuts the outer wall of the mounting bracket and a portion of an inner surface of the abutment portion is configured to abut the outer surface of the appliance. The second mounting portion includes a plurality of apertures disposed therethrough. An outer surface of the second mounting portion is configured to abut the inner surface of the cabinet structure.

According to another aspect of the present disclosure, a bracket system for use between an outer surface of an appliance and an inner surface of a cabinet structure includes a mounting bracket with an inner wall spaced-apart from an outer wall with an intermediate wall interconnecting the inner wall and the outer wall. The inner wall is configured to abut the outer surface of the appliance, and a plurality of apertures is provided through the outer wall. A trim member includes a front mounting portion and a rear mounting portion spaced-apart from one another along a body portion of the trim member. The front and rear mounting portions each include a plurality of apertures disposed therethrough. One or more of the apertures of the plurality of apertures of the rear mounting portion of the trim member align with one or more of the apertures of the plurality of apertures of the mounting bracket to define aligned mounting apertures therebetween. An inner surface of the rear mounting portion abuts the outer wall of the mounting bracket. An outer surface of the front mounting portion is configured to abut the inner surface of the cabinet structure.

According to yet another aspect of the present disclosure, an appliance mounting system includes an appliance having a sidewall with an outer surface. A mounting bracket includes an inner wall spaced-apart from an outer wall. The outer wall includes a plurality of apertures provided therethrough. The inner wall is coupled to the outer surface of the sidewall of the appliance. A trim member includes first and second mounting portions. The first mounting portion and the second mounting portion each include a plurality of apertures disposed therethrough. One or more of the apertures of the plurality of apertures of the first mounting portion of the trim member align with one or more of the apertures of the plurality of apertures of the mounting bracket to define aligned mounting apertures therebetween. An inner surface of the first mounting portion abuts the outer wall of the mounting bracket. A cabinet structure includes a sidewall with an inner surface to at least partially define a cabinet enclosure. The appliance is received within the cabinet enclosure of the cabinet structure. An outer surface of the second mounting portion of the trim member abuts the inner surface of the sidewall of the cabinet structure.

These and other features, advantages, and objects of the present disclosure will be further understood and appreciated by those skilled in the art by reference to the following specification, claims, and appended drawings.

Figure 1:
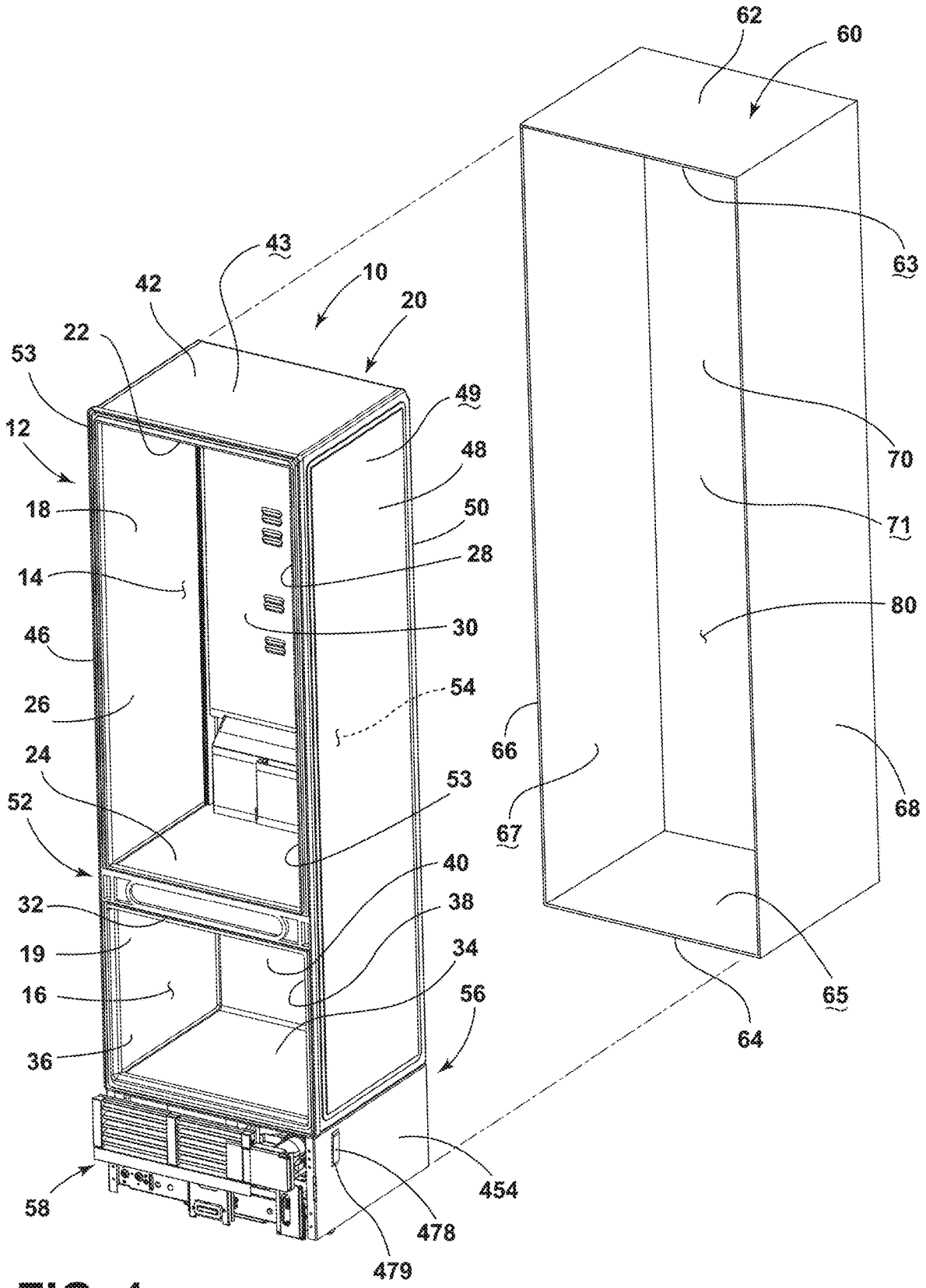
FIG. 1 is a front top perspective view of a refrigerator shown exploded away from a cabinet structure.

The components in the figures are not necessarily to scale, emphasis instead being placed upon illustrating the principles described herein.

DETAILED DESCRIPTION

The present illustrated embodiments reside primarily in combinations of method steps and apparatus components related to a bracket system for mounting an appliance to a cabinet structure. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

The terms "substantial," "substantially," and variations thereof, as used herein, are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

Figure 7:
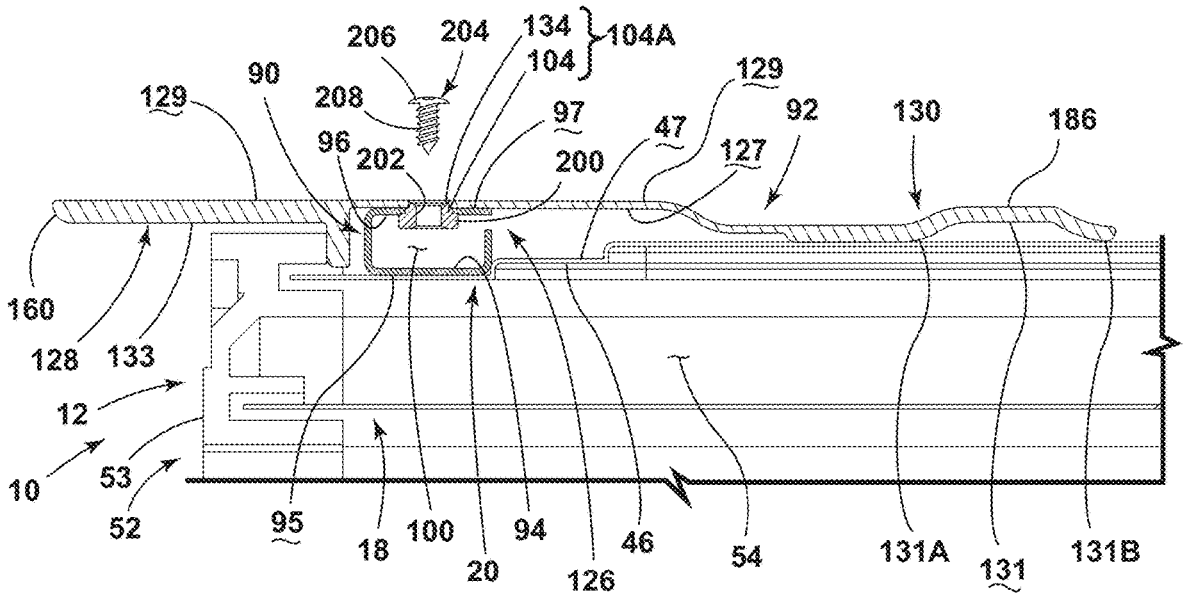
FIG. 7 is a fragmentary cross-section view of the side-mounting bracket system and the refrigerator of FIG. 3A taken at line VII with a fastener exploded away therefrom.

Referring to the embodiment illustrated in FIG. 1, reference numeral 10 generally designates an appliance shown in the form of a refrigerator that includes a vacuum insulated cabinet structure 12. In the embodiment illustrated in FIG. 1, the refrigerator 10 is shown without doors to reveal a refrigerator compartment 14 and a freezer compartment 16. The vacuum insulated cabinet structure 12 of the refrigerator 10 is contemplated to be comprised of one or more liners 18, 19 and an external wrapper 20. Liner 18 is contemplated to be a refrigerator liner having a top wall 22, a bottom wall 24, first and second sidewalls 26, 28, and a rear wall 30, which cooperate together to define the parameters of the refrigerator compartment 14. Similarly, liner 19 is contemplated to be a freezer liner having a top wall 32, a bottom wall 34, first and second sidewalls 36, 38, and a rear wall 40, which cooperate together to define the parameters of the freezer compartment 16. The external wrapper 20 includes a top wall 42, first and second sidewalls 46, 48, and a rear wall 50, which cooperate together to define the outer parameters of the refrigerator 10. The external wrapper 20 and the one or more liners 18, 19 may be interconnected by a trim breaker 52 in a sealed manner to define a vacuum cavity 54 therebetween, as best shown in FIG. 7. The trim breaker 52 includes a front edge 53 defining a front portion of the vacuum insulated cabinet structure 12. The vacuum cavity 54 defined between the external wrapper 20 and the one or more liners 18, 19 may have an air pressure level of less than about 1 atm, about 0.5 atm, about 0.4 atm, about 0.3 atm, about 0.2 atm, about 0.1 atm, about 0.01 atm, or less than about 0.001 atm. In this way, the vacuum cavity 54 includes a vacuum drawn thereon which provides an overall negative internal pressure within the vacuum cavity 54. Thus, the vacuum cavity 54 serves as an insulator to help retain the desired cold temperatures within the refrigerator compartment 14 and the freezer compartment 16. It is contemplated that the external wrapper 20 and the liners 18, 19 may be comprised of a metal material suitable to retain the vacuum within the vacuum cavity 54.

As further shown in FIG. 1, the refrigerator 10 includes a machine room cover 56 configured to house the components of a refrigeration system 58 for cooling the refrigerator compartment 14 and the freezer compartment 16. Like the external wrapper 20, the machine room cover 56 may also be comprised of a metal material. It is to be understood that the features, as set forth herein, could be applied to any appliance having any general configuration, such as the rectangular configuration of the refrigerator 10 shown in FIG. 1. As such, the refrigerator 10 may be referred to herein as an appliance that is configured for reception within a cabinet structure 60.

Figure 2:
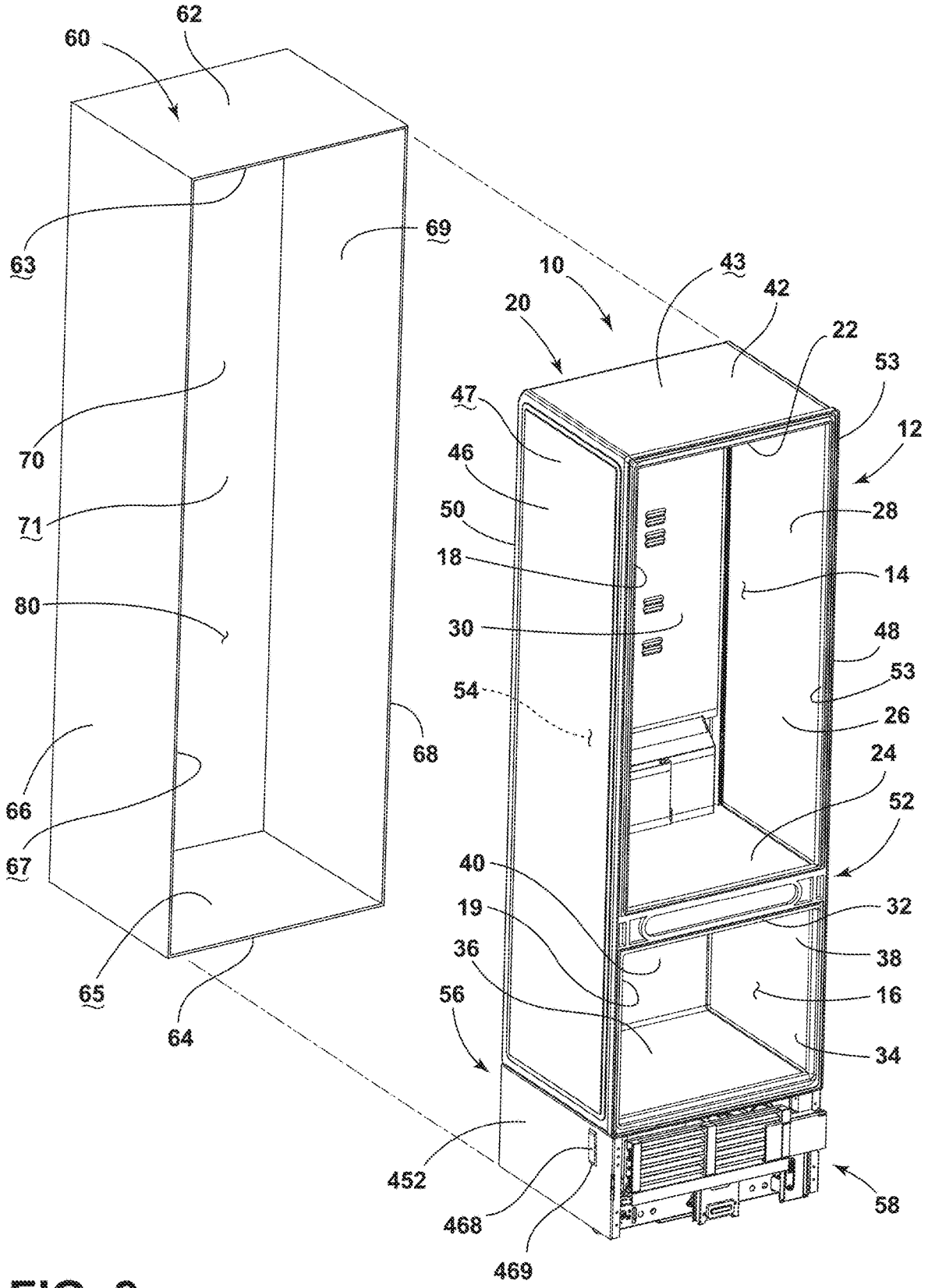
FIG. 2 is a front top perspective view of the refrigerator and cabinet structure of FIG. 1 from another perspective.

With further reference to FIG. 1, the cabinet structure 60, as shown, includes a top wall 62 with an inner surface 63, a bottom wall 64 with an inner surface 65, a first sidewall 66 with an inner surface 67, a second sidewall 68 with an inner surface 69 (FIG. 2), and a rear wall 70 with an inner surface 71, which all cooperate together to define a cabinet enclosure 80 in which the refrigerator 10 is configured to be received. The bottom wall 64 may be a support surface, such as a floor, upon which the cabinet structure 60 is a buttingly supported. With reference to FIGS. 1 and 2, the first sidewall 46 of the refrigerator 10 includes an outer surface 47 that is configured to align with the inner surface 67 of the first sidewall 66 of the cabinet structure 60 when the refrigerator 10 is received within the cabinet enclosure 80. As shown in FIGS. 1 and 2, the second sidewall 48 of the refrigerator 10 includes an outer surface 49 that is configured to align with the inner surface 69 of the second sidewall 68 of the cabinet structure 60 when the refrigerator 10 is received within the cabinet enclosure 80. As further shown in FIGS. 1 and 2, the top wall 42 of the refrigerator 10 includes an outer surface 43 that is configured to align with the inner surface 63 of the top wall 62 of the cabinet structure 60 when the refrigerator 10 is received within the cabinet enclosure 80. To secure the refrigerator 10 in-place within the cabinet enclosure 80, a bracket system is provided, as further described below.

Figure 3A:
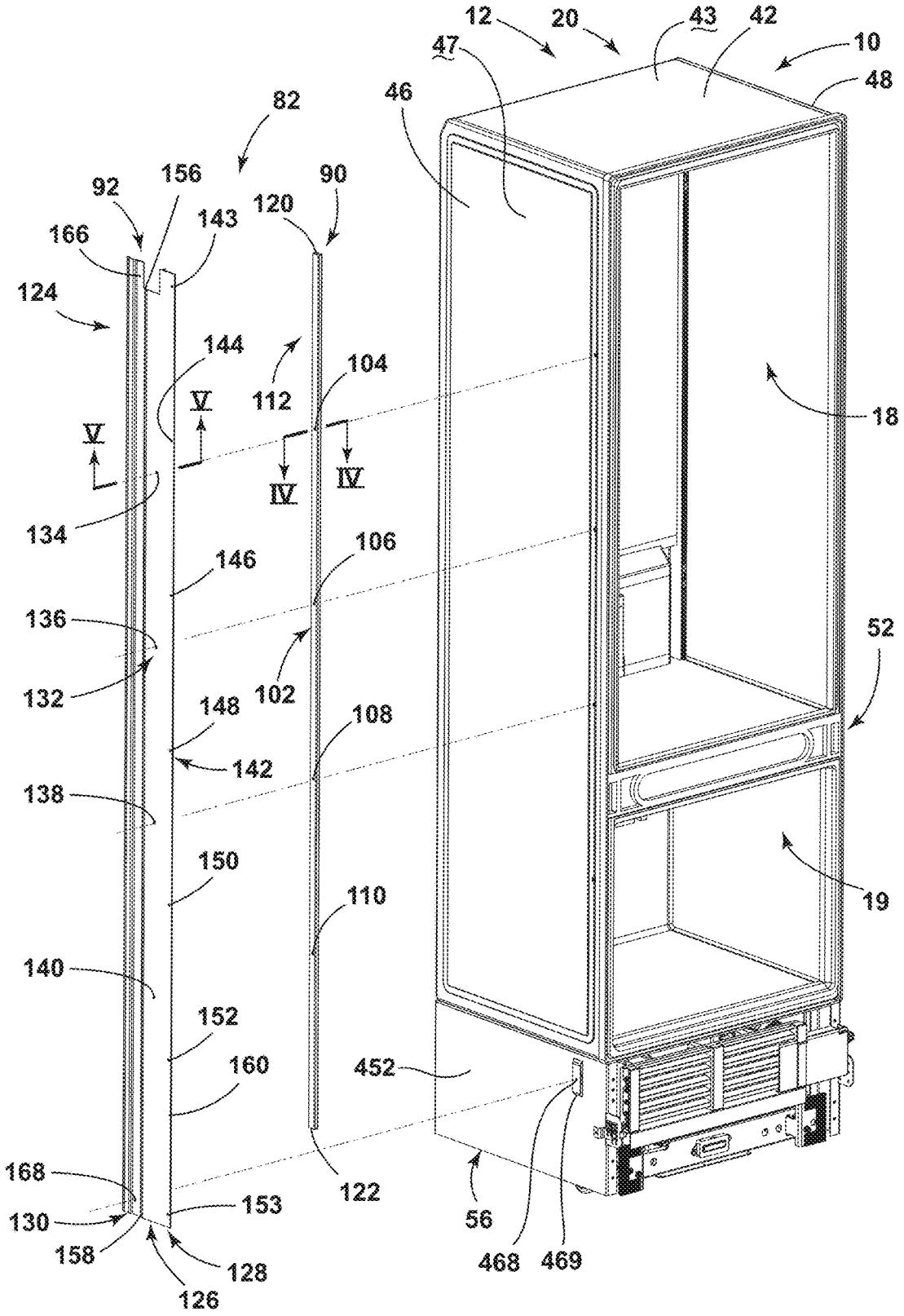
FIG. 3A is a front top perspective view of the refrigerator of FIG. 1 with a side-mounting bracket system exploded away therefrom.

Referring now to FIG. 3A, the refrigerator 10 is shown with a side-mounting bracket system 82 shown exploded away from the outer surface 47 of the first sidewall 46 of the refrigerator 10. In the embodiment shown in FIG. 3A, the side-mounting bracket system 82 includes a mounting bracket 90 and a trim member 92. Both the mounting bracket 90 and the trim member 92 are elongate members configured to couple to one another. Specifically, the mounting bracket 90 is contemplated to be comprised of a metal material suitable for welding to the outer surface 47 of the first sidewall 46 of the refrigerator 10. In this way, the mounting bracket 90 can be fixedly coupled to the outer surface 47 of the first sidewall 46 of the refrigerator 10. Once the mounting bracket 90 is mounted on the refrigerator 10, the trim member 92 can then be mounted to the mounting bracket 90. In the embodiment shown in FIG. 3A, the trim member 92 is mounted to the mounting bracket 90 using fasteners, as further described below.

Figure 3B:
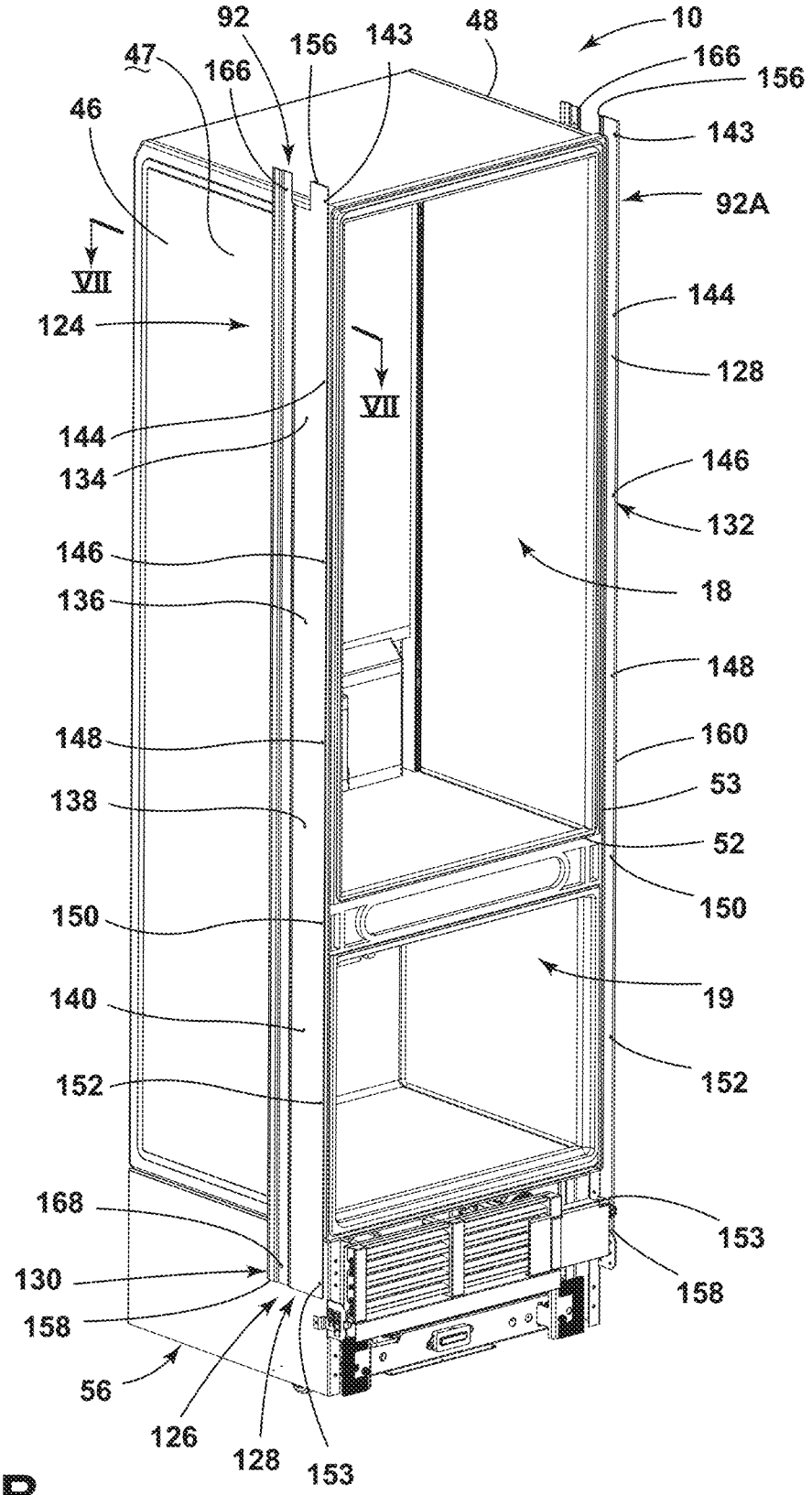
FIG. 3B is a front top perspective view of the refrigerator of FIG. 3A with the side-mounting bracket system mounted thereto.
Figure 3C:
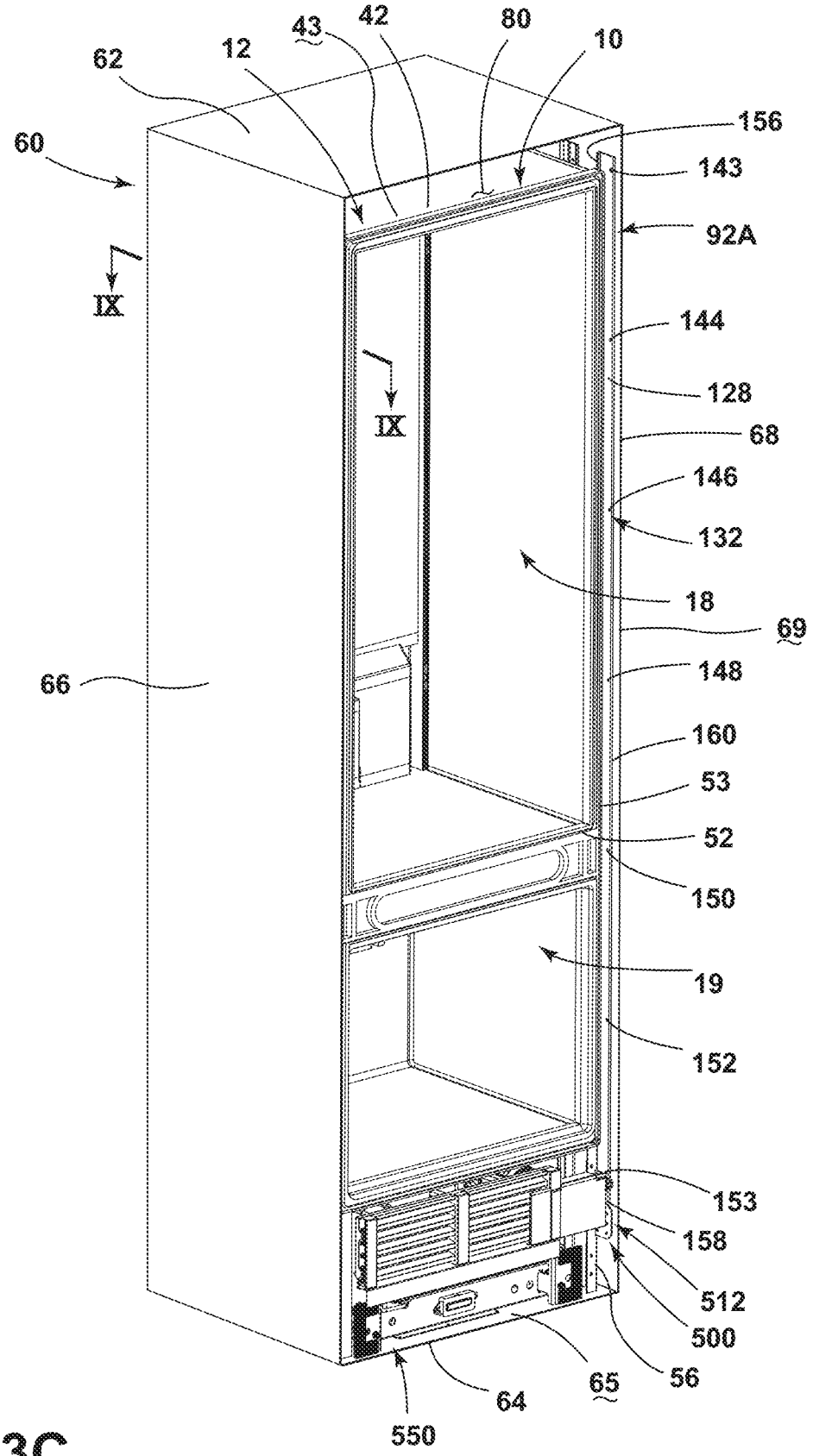
FIG. 3C is a front top perspective view of the refrigerator of FIG. 3B received within the cabinet structure of FIG. 1.

Referring now to FIG. 3B, the trim member 92 is shown mounted to the first sidewall 46 of the external wrapper 20 of the refrigerator 10. Mounting of the trim member 92 to the refrigerator 10 is further described in more detail below. In FIG. 3C, the refrigerator 10 is shown received within the cabinet structure 60.

Figure 4:
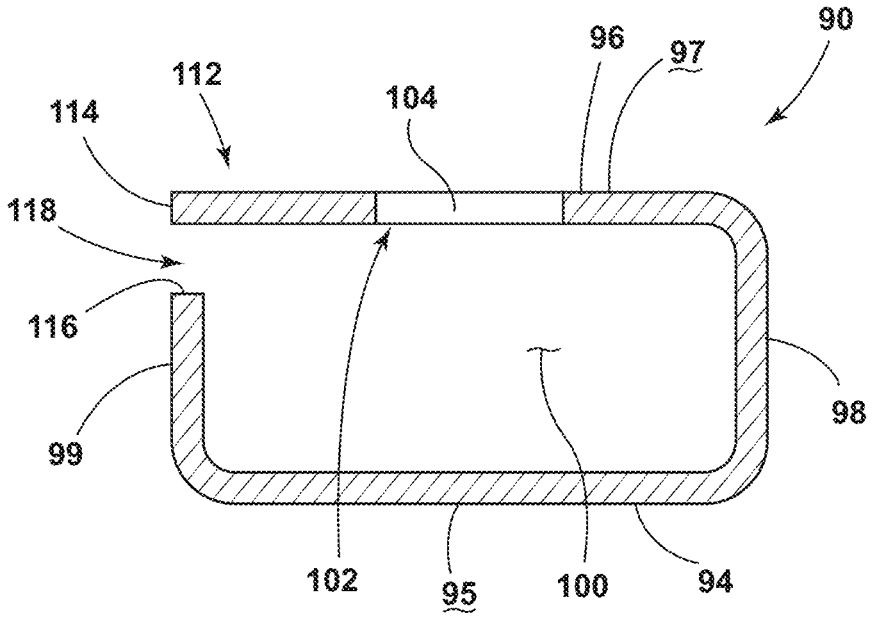
FIG. 4 is a cross-section view of a mounting bracket of the side-mounting bracket system of FIG. 3A taken at line IV.

Referring now to FIG. 4, the mounting bracket 90 is shown from a crossectional view. As shown in the FIG. 4, the mounting bracket 90 includes an inner wall 94 spaced-apart from an outer wall 96 with a first sidewall 98 interconnecting the inner wall 94 and the outer wall 96. A second sidewall 99 extends outwardly from the inner wall 94 of the mounting bracket 90 towards the outer wall 96 of the mounting bracket 90. A channel 100 is defined between the inner wall 94, the outer wall 96 and the first and second sidewalls 98, 99. The inner wall 94 and the outer wall 96 both extend in a forward direction from the first sidewall 98, in the embodiment shown in FIG. 4. A plurality of apertures 102 is provided through the outer wall 96, as best shown in FIG. 3A as apertures 104, 106, 108 and 110 which are vertically spaced-apart along a length of a body portion 112 of the mounting bracket 90. Each aperture 104, 106, 108 and 110 of the plurality of apertures 102 opens into the channel 100. Thus, the mounting bracket 90 includes the body portion 112 having first and second ends 114, 116, such that the mounting bracket 90 is contemplated to be comprised of an extruded or roll-formed sheet metal material that is shaped into the inner wall 94, the outer wall 96 and the first and second sidewalls 98, 99. The second end 116 of the body portion 112 is disposed on the second sidewall 99, and is spaced-apart from the outer wall 96 of the mounting bracket 90 to define an opening 118 into the channel 100 of the mounting bracket 90. With reference to FIG. 3A, the body portion 112 of the mounting bracket 90 includes upper and lower ends 120, 122, and it is contemplated that the opening 118 of the mounting bracket 90 runs the length of the body portion 112 between the upper and lower ends 120, 122. The inner wall 94 and the outer wall 96 of the mounting bracket 90 are generally planar walls that run substantially parallel to one another, and include respective outer surfaces 95, 97. The outer surface 95 of the inner wall 94 is configured to abut the outer surface 47 of the first sidewall 46 of the refrigerator 10 in assembly, and is contemplated to be welded thereto to fixedly couple the mounting bracket 90 to the refrigerator 10.

Figure 5:
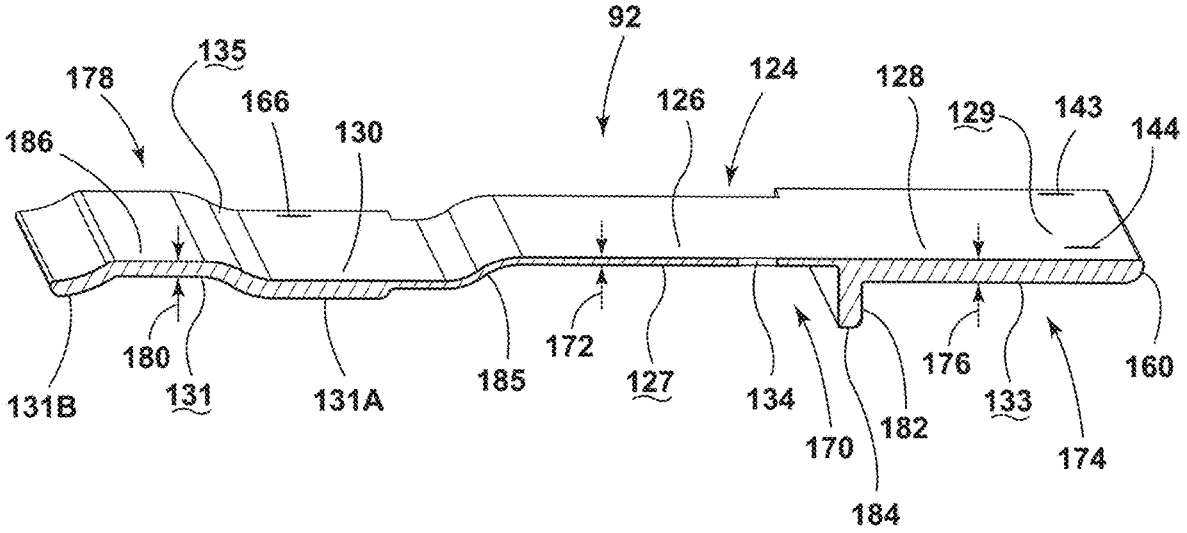
FIG. 5 is a bottom perspective cross-section view of a trim member of the side-mounting bracket system of FIG. 3A taken at line V.
Figure 8:
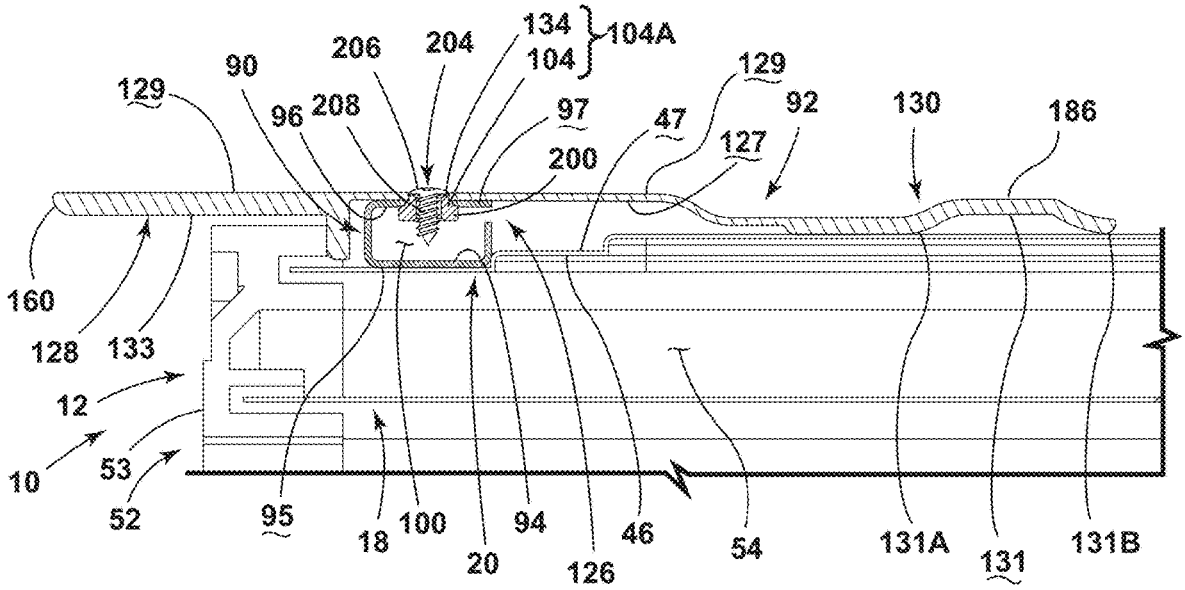
FIG. 8 is a fragmentary cross-section view of the side-mounting bracket system and the refrigerator of FIG. 3A taken at line VII with the fastener of FIG. 7 interconnecting the trim member and the mounting bracket.
Figure 9:
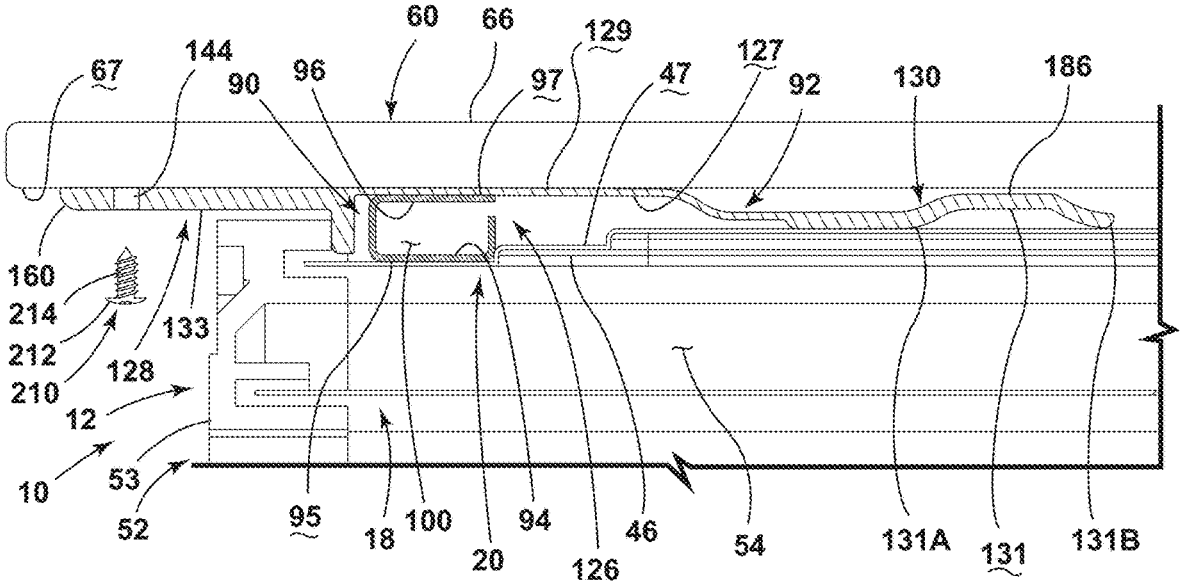
FIG. 9 is a fragmentary cross-section view of the side-mounting bracket system, the refrigerator and cabinet structure of FIG. 3C taken at line IX with a fastener exploded away therefrom.

Referring now to FIG. 5, the trim member 92 is shown from a crossectional view. As shown in the FIG. 5, the trim member 92 includes an overall body portion 124 with first and second mounting portions 126, 128 and an abutment portion 130 that is inwardly offset from the first and second mounting portions 126, 128. The first mounting portion 126 includes a plurality of apertures 132 disposed therethrough. The plurality of apertures 132 is best shown in FIG. 3A as apertures 134, 136, 138 and 140 which are vertically spaced-apart along a length of the overall body portion 124 of the trim member 92. The apertures 134, 136, 138 and 140 of the plurality of apertures 132 of the trim member 92 are configured to align with the apertures 104, 106, 108 and 110 of the plurality of apertures 102 of the mounting bracket 90 to define aligned mounting apertures therebetween, as further described below. An inner surface 127 of the first mounting portion 126 abuts the outer surface 97 of the outer wall 96 of the mounting bracket 90 in assembly, as best shown in FIGS. 7-10. A portion of an inner surface 131 of the abutment portion 130 is configured to abut the outer surface 47 of the first sidewall 46 of the refrigerator 10 in assembly. The second mounting portion 128 includes a plurality of apertures 142 disposed therethrough as best shown in FIG. 3A as apertures 143, 144, 146, 148, 150, 152 and 153 which are vertically spaced-apart along a length of the overall body portion 124 of the trim member 92. The second mounting portion 128 includes an outer surface 129 that extends over the first mounting portion 126, and is configured to abut the inner surface 67 of the first sidewall 66 of the cabinet enclosure 80, as best shown in FIG. 9. The apertures 143, 144, 146, 148, 150, 152 and 153 of the plurality of apertures 142 of the trim member 92 are used to couple the trim member 92 to the cabinet structure 60 using fasteners, as further described below. The first mounting portion 126 is disposed rearward from the second mounting portion 128. Thus, the first mounting portion 126 may be referred to herein as the rear mounting portion, while the second mounting portion 128 may be referred to herein as the front mounting portion. It is contemplated that any number of apertures can be used with the trim member 92 to mount the same to the cabinet structure 60 and the mounting bracket 90. Similarly, it is contemplated that any number of apertures can be used with the mounting bracket 90 for mounting the trim member 92 thereto.

With further reference to FIG. 3A, the trim member 92 includes the overall body portion 124 having upper and lower ends 156, 158, with the plurality of apertures 142 vertically spaced-apart along a length thereof. Apertures 143, 144, 146, 148, 150, 152 and 153 of the plurality of apertures 142 are positioned adjacent to a front edge 160 of the trim member 92. The upper end 156 of the trim member 92 includes an upper mounting aperture 166, and the lower end 158 of the trim member 92 includes a lower mounting aperture 168. The upper mounting aperture 166 is configured to couple to an upper bracket system, as further described below. The lower mounting aperture 168 is configured to couple to the machine room cover 56, as further described below. With reference to FIG. 3B, the overall body portion 124 of the trim member 92 shows the upper end 156 thereof extending above the top wall 42 of the external wrapper 20, such that the same is accessible for mounting to an upper bracket system. With further reference to FIG. 3B, the overall body portion 124 of the trim member 92 shows the lower end 158 thereof extending below the vacuum insulated cabinet structure 12 to abut the machine room cover 56 In this way, the lower mounting aperture 168 is accessible for mounting to a mounting aperture 468 of the machine room cover 56 in assembly.

As further shown in FIG. 3B, a second trim member 92A is shown mounted to the second sidewall 48 of the external wrapper 20. The second trim member 92A is contemplated to be a mirror image of the first trim member 92, such that like reference numerals are provided thereon to indicate common features shared between the trim members 92, 92A. As shown in FIG. 3B, the front edge 160 of the second trim member 92A extends outwardly from the front edge 53 of the vacuum insulated cabinet structure 12 of the refrigerator 10. In this way, the plurality of apertures 132 of the second trim member 92A are accessible in an outboard manner relative to the front edge 53 of the vacuum insulated cabinet structure 12 of the refrigerator 10 when the refrigerator 10 is received in the cabinet enclosure 80 of the cabinet structure 60. With the access to the plurality of apertures 132 of the first and second trim members 92, 92A, the same can be securely fastened to the cabinet structure 60 using fasteners after the refrigerator 10 is positioned within the cabinet structure 60. Thus, while not shown in FIG. 3C, the same outboard configuration is also provided for the plurality of apertures 132 of trim member 92 for coupling to the cabinet structure 60 when the refrigerator 10 is disposed within the cabinet enclosure 80 of the cabinet structure 60, as shown in FIG. 3C and further described below with reference to FIGS. 9-10. In FIG. 3C, the refrigerator 10 is received within the cabinet enclosure 80 of the cabinet structure 60 with the trim members 92, 92A coupled on opposite sides thereof and ready for fastening to the first and second sidewalls 66, 68 of the cabinet structure 60, respectively.

With further reference to FIG. 5, the trim member 92 is shown with the first mounting portion 126 having a body portion 170 with a thickness 172. The second mounting portion 128 is shown having a body portion 174 with a thickness 176. The abutment portion 130 is shown having a body portion 178 with a thickness 180. Together, the collective body portions 170, 174, 178 make up the overall body portion 124 of the trim member 92. The thickness 172 of the body portion 170 of the first mounting portion 126 is less than the thickness 176 of the body portion 174 of the second mounting portion 128, and is less than the thickness 180 of the body portion 178 of the abutment portion 130. As shown in FIG. 5, the second mounting portion 128 includes a tab 182 inwardly extending from an inner surface 133 of the second mounting portion 128. The tab 182 includes a distal end 184 which may abut an outer portion of the external wrapper 20 of the refrigerator 10 in assembly. The trim member 92 further includes an inwardly angled transverse portion 185 disposed between the first mounting portion 126 and the abutment portion 130 which inwardly offsets the abutment portion 130 relative to the first and second mounting portions 126, 128. The inner surface 131 of the abutment portion 130 of the trim member 92 includes first and second abutment locations 131A, 131B that are configured to abut the outer surface 47 of the first sidewall 46 of the refrigerator 10 in assembly, as best shown in FIGS. 7-10. An outwardly extending interconnecting web 186 is disposed between and interconnects the first and second abutment locations 131A, 131B of the abutment portion 130 of the trim member 92.

Figure 6:
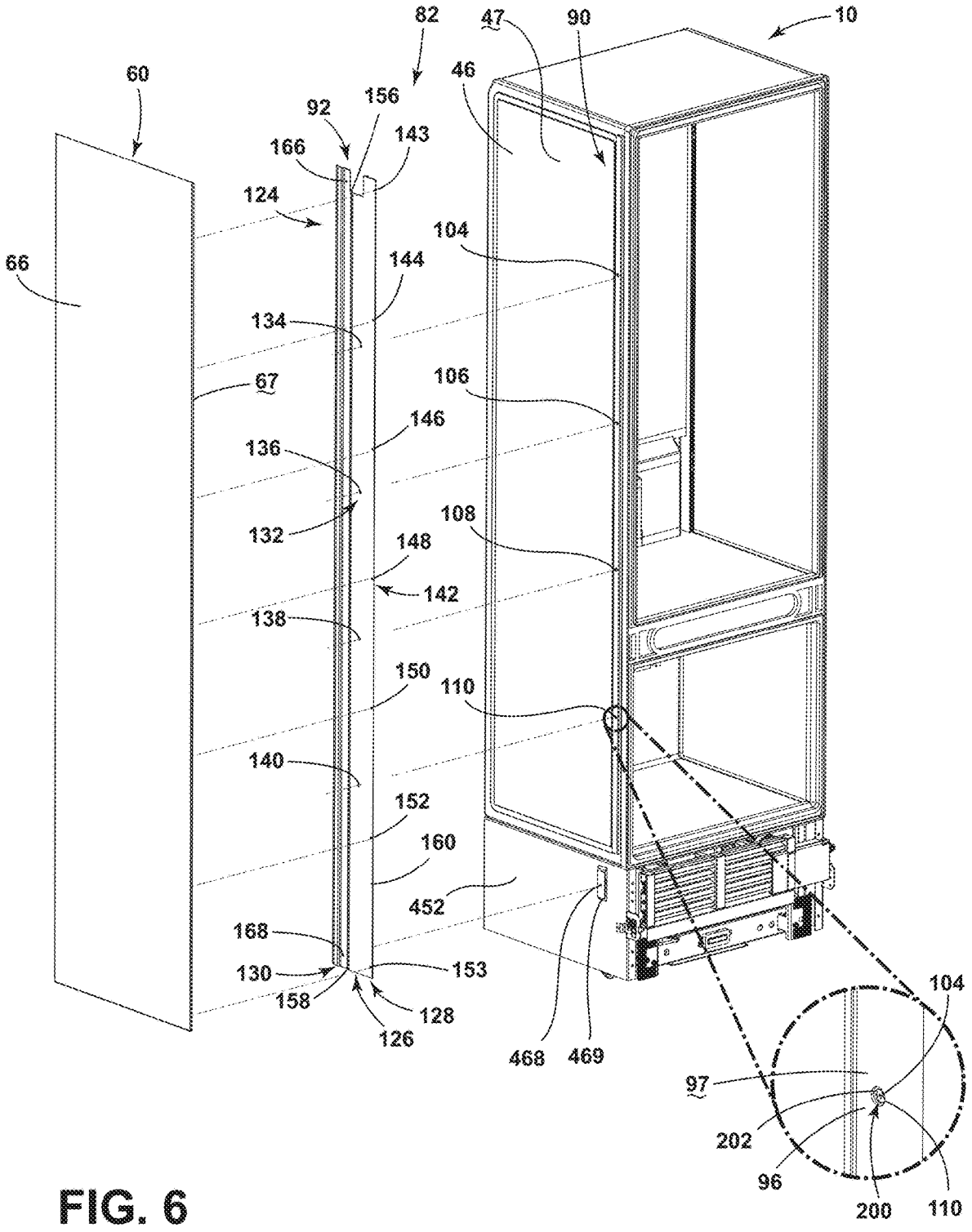
FIG. 6 is a front top perspective view of the refrigerator of FIG. 3A with the mounting bracket of the side-mounting bracket system mounted thereto and the trim member and a sidewall of the cabinet structure exploded away therefrom.

Referring now to FIG. 6, the mounting bracket 90 is shown coupled to the outer surface 47 of the first sidewall 46 of the external wrapper 20 of the refrigerator 10. As noted above, it is contemplated that the mounting bracket 90 is a metal bracket configured for welding to the first sidewall 46 of the external wrapper 20, which is also contemplated to be comprised of a metal material. As such, the mounting bracket 90 is fixedly coupled to the first sidewall 46 of the external wrapper 20. In the embodiment shown in FIG. 6, the mounting bracket 90 does not extend above or below the first sidewall 46 of the external wrapper 20, as mounted thereto. With the mounting bracket 90 coupled to the first sidewall 46 of the external wrapper 20, the apertures 104, 106, 108 and 110 of the plurality of apertures 102 disposed on the outer wall 96 of the mounting bracket 90 are exposed and ready for alignment with the apertures 134, 136, 138 and 140 of the trim member 92. As noted above, apertures 134, 136, 138 and 140 of the trim member 92 are configured to align with the apertures 104, 106, 108 and 110 of the mounting bracket 90 to define aligned mounting apertures therebetween. When the above-noted apertures (104, 106, 108 and 110 of the mounting bracket 90, and 134, 136, 138 and 140 of the trim member 92) are aligned, a fastener is received therethrough to couple the trim member 92 to the mounting bracket 90, as best shown in FIGS. 7-8. The apertures 104, 106, 108 and 110 of the plurality of apertures 102 disposed on the outer wall 96 of the mounting bracket 90 are configured to receive a threaded insert 200, as shown in the zoomed in portion of FIG. 6. The threaded insert 200 may be welded into place, or could also be a friction fit or self-cinching member, such as a swage nut. The threaded insert 200 includes a threaded inner cavity 202 that is configured to threadingly engage a threaded fastener.

Figure 10:
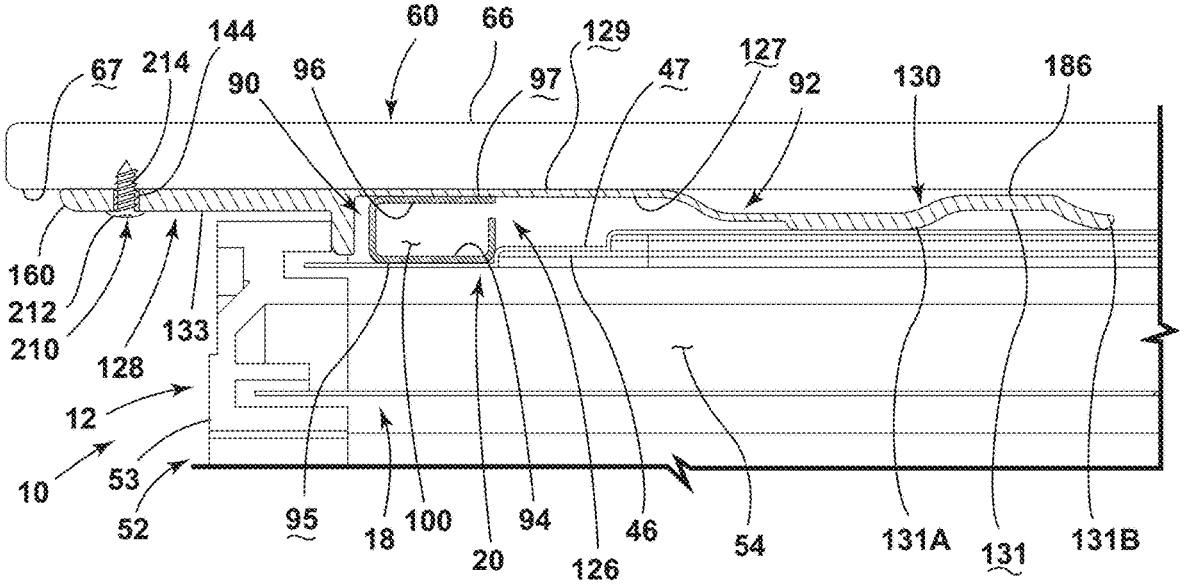
FIG. 10 is a fragmentary cross-section view of the side-mounting bracket system, the refrigerator and cabinet structure of FIG. 3C taken at line IX with the fastener of FIG. 9 interconnecting the trim member and a sidewall of the cabinet member.

As further shown in FIG. 6, the first sidewall 46 of the cabinet structure 60 is shown exploded away from the trim member 92. The apertures 143, 144, 146, 148, 150, 152 and 153 of the plurality of apertures 142 of the trim member 92 are used to couple the trim member 92 to the first sidewall 46 cabinet structure 60 using fasteners, as best shown in FIGS. 9-10. Thus, the front edge 160 of the trim member 92 is outwardly positioned relative to the front edge 53 of the vacuum insulated cabinet structure 12 of the refrigerator 10, as shown in FIGS. 7-10. As noted above, apertures 143, 144, 146, 148, 150, 152 and 153 of the plurality of apertures 142 of the trim member 92 are positioned adjacent to the front edge 160 of the trim member 92. In this way, the apertures 143, 144, 146, 148, 150, 152 and 153 of the plurality of apertures 142 of the trim member 92 are accessible when the refrigerator 10 is positioned within the cabinet enclosure 80 for fastening the trim member 92 to the cabinet structure 60, as shown in FIG. 3C.

Referring now to FIG. 7, a cross-sectional view of the refrigerator 10 of FIG. 6 is shown with the trim member 92 positioned in an abutting position relative to the mounting bracket 90 for mounting the trim member 92 on the mounting bracket 90. Specifically, the outer wall 96 of the mounting bracket 90 abuts the inner surface 127 of the first mounting portion 126 of the trim member 92. Further, as shown in FIG. 7, the inner wall 94 of the mounting bracket 90 abuts the outer surface 47 of the first sidewall 46 of the external wrapper 20, as welded thereto. By welding the mounting bracket 90 to the outer surface 47 of the first sidewall 46 of the external wrapper 20, the mounting bracket 90 is securely mounted thereto without using fasteners which may pierce the external wrapper 20 and thereby cause the vacuum cavity 54 to lose its negative pressure, and its enhanced insulating properties as well. As further shown in FIG. 7, with the trim member 92 positioned on the mounting bracket 90, the abutment portion 130 of the trim member 92 includes the first and second abutment locations 131A, 131B which are shown abutting the outer surface 47 of the first sidewall 46 of the external wrapper 20. As further shown in FIG. 7, the external wrapper 20 and the liner 18 are interconnected by the trim breaker 52 in a sealed manner to define the vacuum cavity 54 of the vacuum insulated cabinet structure 12 therebetween.

With the trim member 92 positioned on the mounting bracket 90, aperture 104 of the mounting bracket 90 aligns with aperture 134 of the trim member 92 to define a first set of aligned apertures 104A. A fastener 204 includes a head portion 206 and a threaded shaft portion 208. The threaded shaft portion 208 is contemplated to have a complimentary thread pattern relative to the threaded inner cavity 202 of the threaded insert 200 to threadingly engage the same, as shown in FIG. 8. As such, it is contemplated that the fastener 204 may be a machine screw, or other like fastener. With reference to FIG. 8, the head portion 206 of the fastener 204 abuts the outer surface 129 of the first mounting portion 126 of the trim member 92 to secure the trim member 92 to the mounting bracket 90. Aperture 104 of the mounting bracket 90 is shown aligned with aperture 134 of the trim member 92 in FIGS. 7 and 8, however, it is contemplated that apertures 106, 108 and 110 (which are spaced-apart along a length of the mounting bracket 90) are also aligned with respective apertures 136, 138 and 140 (which are spaced-apart along a length of the trim member 92) to securely mount the trim member 92 to the mounting bracket 90 using fasteners, like fastener 204.

Referring now to FIG. 9, the refrigerator 10 is positioned adjacent to the first sidewall 66 of the cabinet structure 60, as the refrigerator 10 is received in the cabinet enclosure 80 of the cabinet structure 60, as best shown in FIG. 3C. As shown in FIG. 9, the front edge 160 of the trim member 92 extends outwardly from the front edge 53 of the vacuum insulated cabinet structure 12 of the refrigerator 10. In this way, the plurality of apertures 132 of the trim member 92 are accessible when the refrigerator 10 is received in the cabinet enclosure 80 of the cabinet structure 60. As shown in FIG. 9, a fastener 210 includes a head portion 212 and a threaded shaft portion 214. The threaded shaft portion 214 is contemplated to have a threaded pattern configured to engage the first sidewall 66 of the cabinet structure 60. It is contemplated that the cabinet structure 60 is comprised of a wood material, or other like composite material, suitable for receiving a fastener, such as fastener 210. As such, it is contemplated that the fastener 210 may be a self-tapping screw or wood screw. With reference to FIG. 10, the head portion 212 of the fastener 210 abuts the inner surface 133 of the second mounting portion 128 of the trim member 92 to secure the trim member 92 to the first sidewall 66 of the cabinet structure 60. The aperture 144 is shown being used to fasten the trim member 92 to the first sidewall 66 of the cabinet structure 60 in FIG. 10. It is further contemplated that apertures 146, 148, 150 and 152 (which are spaced-apart along a length of the trim member 92) of the plurality of apertures 142 also align with the inner surface 67 of the first sidewall 66 of the cabinet structure 60 to securely mount the trim member 92 to the first sidewall 66 of the cabinet structure 60 using fasteners, like fastener 210.

As shown in FIGS. 7-10, the inner surface 127 of the first mounting portion 126 of the trim member 92 abuts the outer surface 97 of the outer wall 96 of the mounting bracket 90 in assembly. Similarly, the outer surface 95 of the inner wall 94 of the mounting bracket 90 abuts the outer surface 47 of the first sidewall 46 of the refrigerator 10 in assembly.

Figure 11:
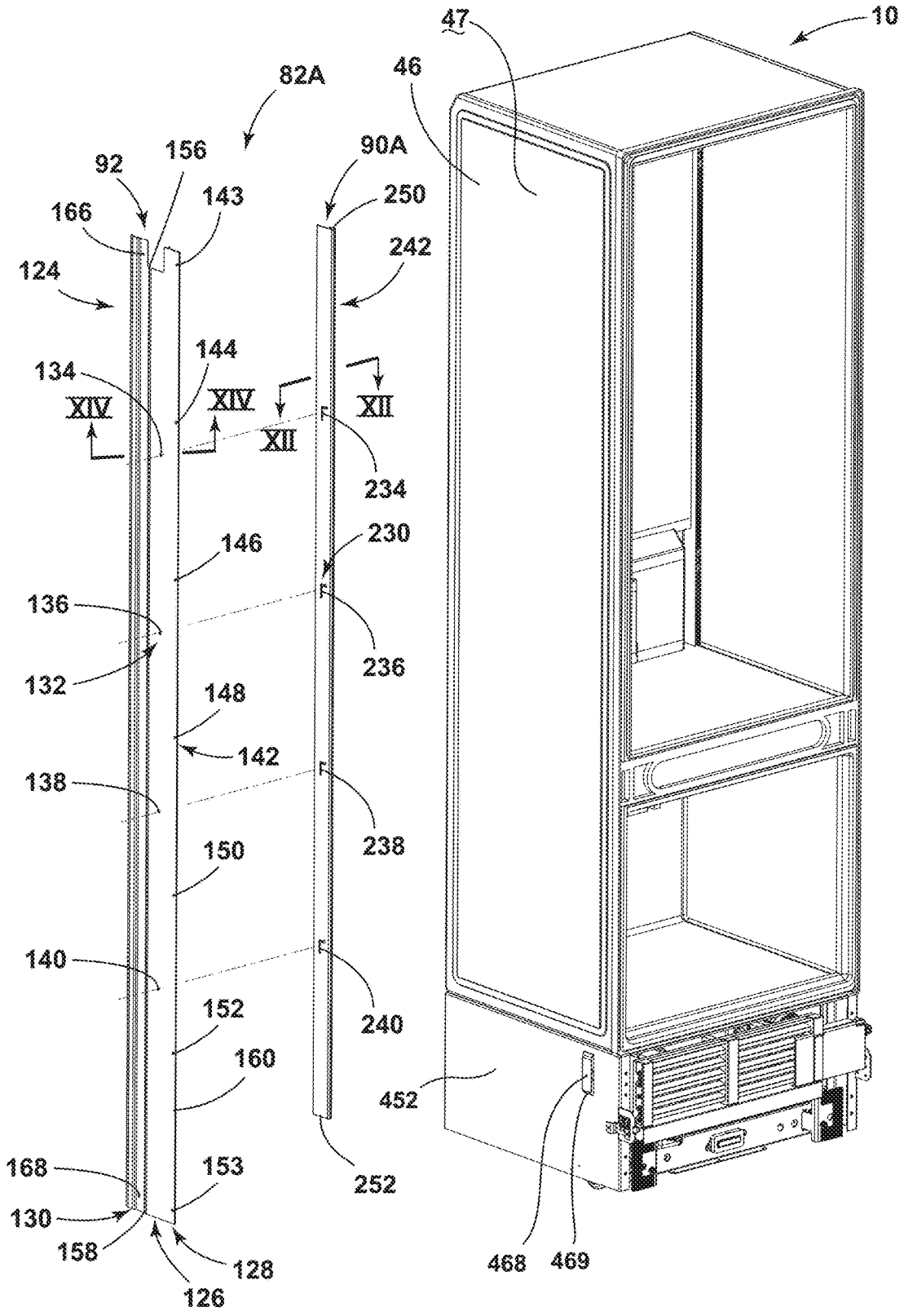
FIG. 11 is a front top perspective view of the refrigerator of FIG. 1 with a side-mounting bracket system exploded away therefrom.

Referring now to FIG. 11, the refrigerator 10 is shown with another side-mounting bracket system 82A shown exploded away from the outer surface 47 of the first sidewall 46 of the refrigerator 10. In the embodiment shown in FIG. 11, the side-mounting bracket system 82A includes a mounting bracket 90A and trim member 92 that is contemplated to be the same or similar to trim member 92 described above. The mounting bracket 90A is contemplated to be comprised of a metal material suitable for welding to the outer surface 47 of the first sidewall 46 of the refrigerator 10. Once the mounting bracket 90A is mounted on the refrigerator 10, the trim member 92 can then be mounted to the mounting bracket 90. In the embodiment shown in FIG. 11, the trim member 92 is mounted to the mounting bracket 90A using a channel-lock system, as further described below. The trim member 92 of side-mounting bracket system 82A connects to the cabinet structure 60 in the same manner as trim member 92 of side-mounting bracket system 82 described above, with specific reference to FIGS. 9-10.

Figure 12:
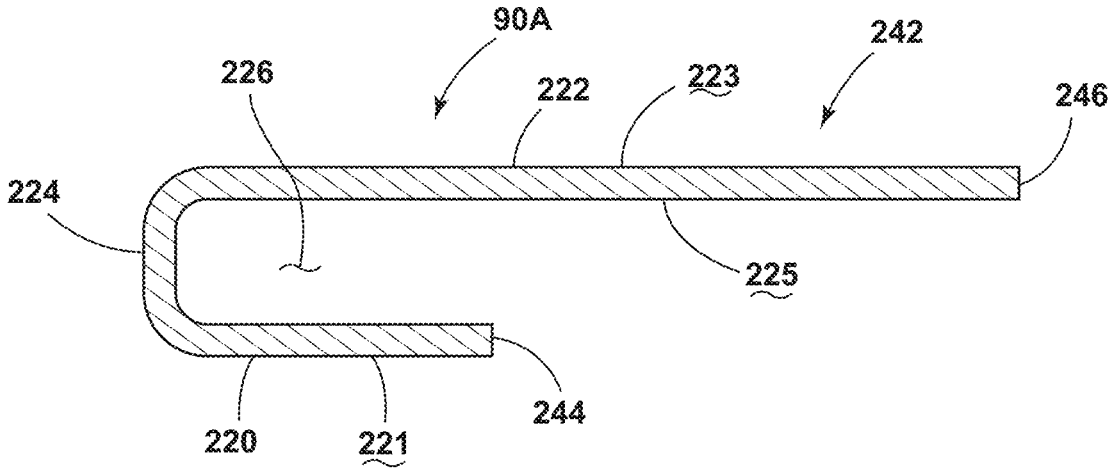
FIG. 12 is a cross-section view of a mounting bracket of the side-mounting bracket system of FIG. 11 taken at line XII.

Referring now to FIG. 12, the mounting bracket 90A is shown from a crossectional view. As shown in the FIG. 12, the mounting bracket 90A includes an inner wall 220 spaced-apart from an outer wall 222 with a sidewall 224 interconnecting the inner wall 220 and the outer wall 222. A channel 226 is defined between the inner wall 220, the outer wall 222 and the sidewall 224. The inner wall 220 and the outer wall 222 of the mounting bracket 90A both extend in a rearward direction from the sidewall 224, in the embodiment shown in FIG. 12. A plurality of slots 230 is provided through the outer wall 222, as best shown in FIG. 11 as slots 234, 236, 238 and 240 which are vertically spaced-apart along a length of the mounting bracket 90A. Each slot 234, 236, 238 and 240 of the plurality of slots 230 opens into the channel 226 of the mounting bracket 90A. With further reference to FIG. 12, the mounting bracket 90A includes a body portion 242 having first and second ends 244, 246, such that the mounting bracket 90A is contemplated to be comprised of an extruded or roll-formed sheet metal material that is shaped into the inner wall 220, the outer wall 222 and the sidewall 224 thereof. The body portion 242 of the mounting bracket 90A includes upper and lower ends 250, 252, as best shown in FIG. 11. With further reference to FIG. 12, the inner wall 220 and the outer wall 222 of the mounting bracket 90A are generally planar walls that run substantially parallel to one another, and include respective outer surfaces 221, 223. The outer surface 221 of the inner wall 220 is configured to abut the outer surface 47 of the first sidewall 46 of the external wrapper 20 of the refrigerator 10 in assembly, and is contemplated to be welded thereto to fixedly couple the mounting bracket 90A to the refrigerator 10. The outer surface 223 of the outer wall 222 is configured to abut the inner surface 127 of the first mounting portion 126 of the trim member 92, as further described below. The outer wall 222 of the mounting bracket 90A further includes an inner surface 225.

Figure 13:
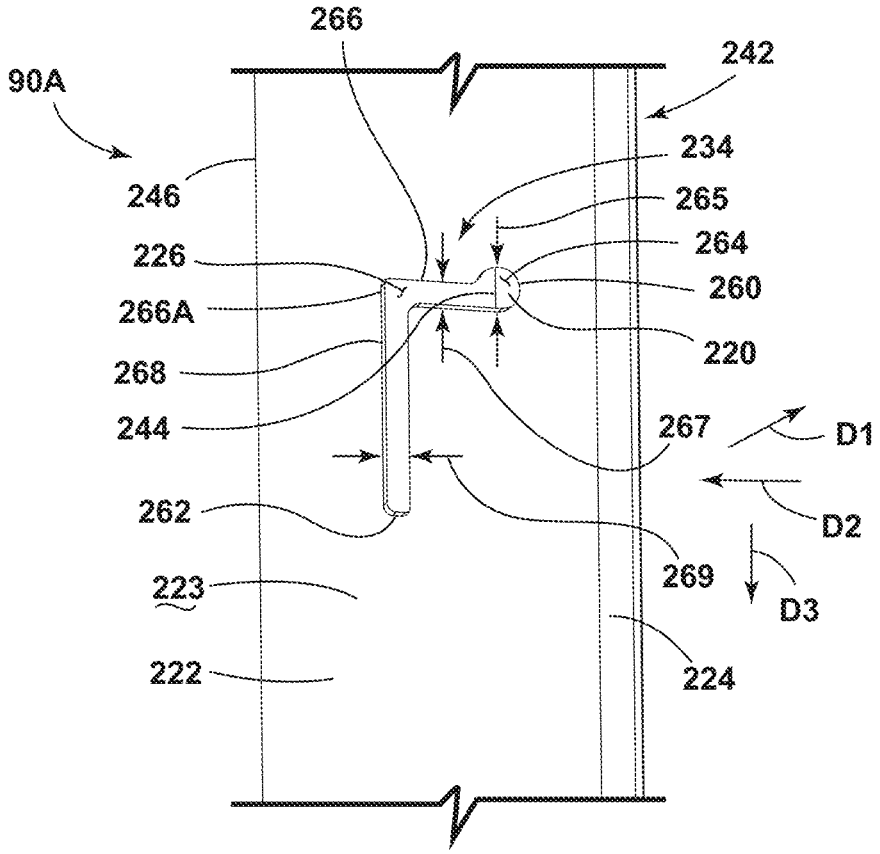
FIG. 13 is a fragmentary top perspective view of the mounting bracket of FIG. 11.

Referring now to FIG. 13, the slot 234 of the plurality of slots 230 is shown disposed through the outer wall 222 of the mounting bracket 90A. The slot 234, as shown in FIG. 13, is representative of slots 236, 238 and 240, with regards to configuration. As shown in FIG. 13, the slot 234 includes a first end 260 and a second end 262, which are both vertically and horizontally spaced-apart from one another. The first end 260 of the slot 234 includes an enlarged opening 264 which is configured to receive the head of a stud insert, as further described below. The enlarged opening 264 opens into a first portion 266 of the slot 234 which is generally disposed in a horizontal configuration. The slot 234 further includes a second portion 268 which is generally disposed in a vertical configuration, and which extends upwardly from the second end 262 towards the first portion 266 to interconnect with the first portion at a junction 266A disposed between the first and second portions 266, 268. In this way, the slot 234 includes an overall inverted L-shaped configuration. The enlarged opening 264 of the slot 234 includes a width 265 that is greater than a width 267 of the first portion 266 of the slot 234, and which is greater than a width 269 of the second portion 268 of the slot 234. It is contemplated that the widths 267 and 269 of the first and second portions 266, 268 of the slot 234 may be equal to one another. The widths 265, 267 and 269 of the slot 234 provide for a configuration that is suited for retaining a stud of the trim member 92 in a keyhole-style configuration, as further described below.

As noted above, and with reference to FIG. 3A, the first mounting portion 126 of the trim member 92 includes a plurality of apertures 132 disposed therethrough. The apertures 134, 136, 138 and 140 of the plurality of apertures 132 are vertically spaced-apart along a length of the trim member 92, such that the apertures 134, 136, 138 and 140 of the trim member 92 are configured to align with the slots 234, 236, 238 and 240, respectively, of the mounting bracket 90A in assembly.

Figure 14:
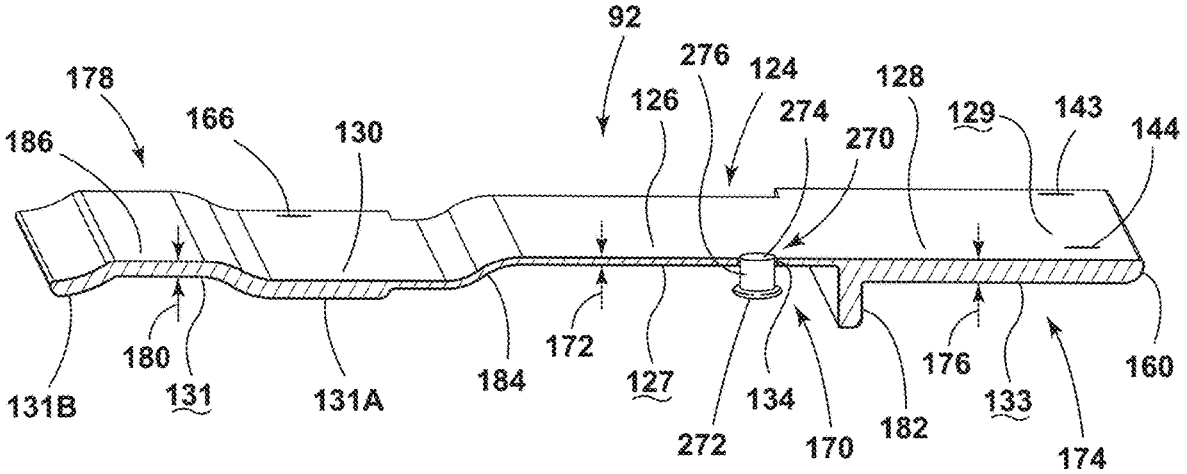
FIG. 14 is a bottom perspective cross-section view of a trim member of the side-mounting bracket system of FIG. 11 taken at line XIV.

Referring now to FIG. 14, the trim member 92 is shown having a stud insert 270 positioned within aperture 134. The stud insert 270 includes a head portion 272 and a rear portion 274 with a shaft portion 276 disposed therebetween. The rear portion 274 may abut or be flush with the outer surface 129 of the first mounting portion 126 of the trim member 92. The shaft portion 276 extends inwardly from the inner surface 127 of the first mounting portion 126, such that the head portion 272 of the stud insert 270 is inwardly spaced-apart from the first mounting portion 126 of the trim member 92. The stud insert 270 may be welded into place, or could also be a friction fit or self-cinching member, such as a swage stud, that is fixedly disposed on the aperture 134 of the trim member 92. The width of the head portion 272 is greater than the width of the shaft portion 276. In this way, it is contemplated that the head portion 272 of the stud insert 270 can be received within the enlarged opening 264 of the first end 260 of the slot 234 of the mounting bracket 90A, and then abut the inner surface 225 of the outer wall 222 of the mounting bracket 90A as the stud insert 270 is moved along the first and second portions 266, 268 of the slot 234 from the first end 260 towards second end 262. As such, the relative movement of the stud insert 270, and the trim member 92 to which it is attached, includes an inward movement in a first direction as indicated by arrow D1 (FIG. 13) to insert the head portion 272 of the stud insert 270 through the enlarged opening 264 of the first and 260 of the slot 234 of the mounting bracket 90A. From there, the stud insert 270, and the trim member 92 to which it is attached, moves rearward in the direction as indicated by arrow D2 (FIG. 13) until the shaft portion 276 of the stud insert 270 reaches the junction 266A disposed between the first and second portions 266, 268 of the slot 234. From the junction 266A, the stud insert 270, and the trim member 92 to which it is attached, moves downward in the direction as indicated by arrow D3 (FIG. 13) until it reaches the second end 262 of the slot 234. With the shaft portion 276 of the stud insert 270 disposed at the second end 262 of the slot 234 of the mounting bracket 90A, the trim member 92 is contemplated to be in-place on the refrigerator 10, in a similar mounted configuration as shown in FIG. 3B with reference to trim member 92 of side-mounting bracket system 82. In this way, the engagement between the stud insert 270 and the slot 234 serves to releasably couple the trim member 92 to the mounting bracket 90A.

Figure 15:
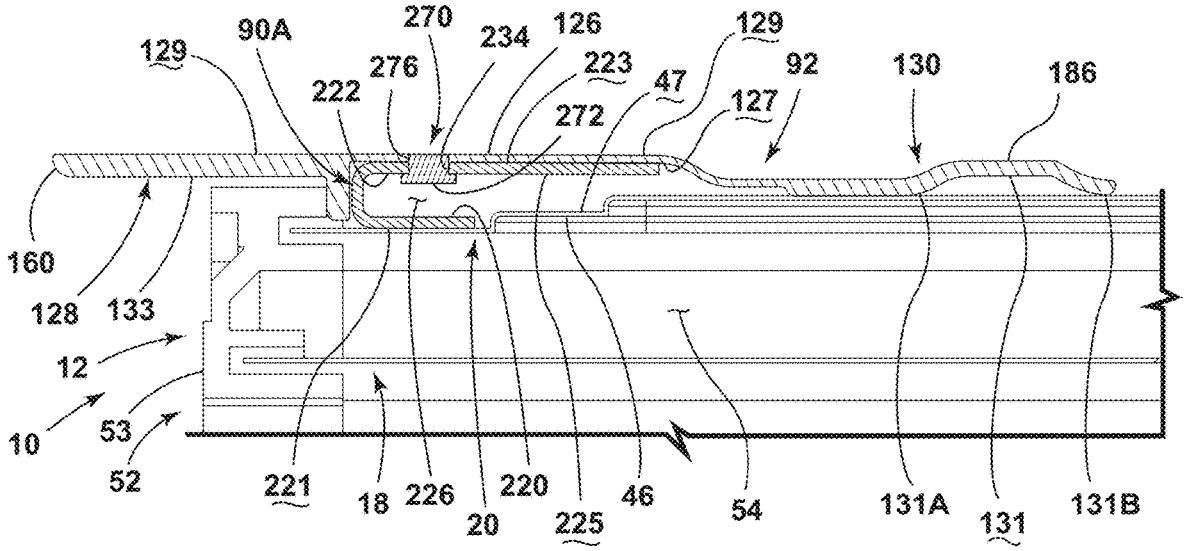
FIG. 15 is a fragmentary cross-section view of the side-mounting bracket system of FIG. 11 mounted to the refrigerator of FIG. 11.

Referring now to FIG. 15, the trim member 92 is shown mounted on the mounting bracket 90A. As mounted thereto, the stud insert 270 is received in the slot 234, such that the head portion 272 of the stud insert 270 abuts the inner surface 225 of the outer wall 222 of the mounting bracket 90A. In this way, the trim member 92 is retained in-place on the mounting bracket 90A, which is contemplated to be welded to the refrigerator 10. As shown in FIG. 15, the inner surface 127 of the first mounting portion 126 of the trim member 92 abuts the outer surface 223 of the outer wall 222 of the mounting bracket 90A in assembly. Similarly, the outer surface 221 of the inner wall 220 of the mounting bracket 90A abuts the outer surface 47 of the first sidewall 46 of the refrigerator 10 in assembly.

Figure 16:
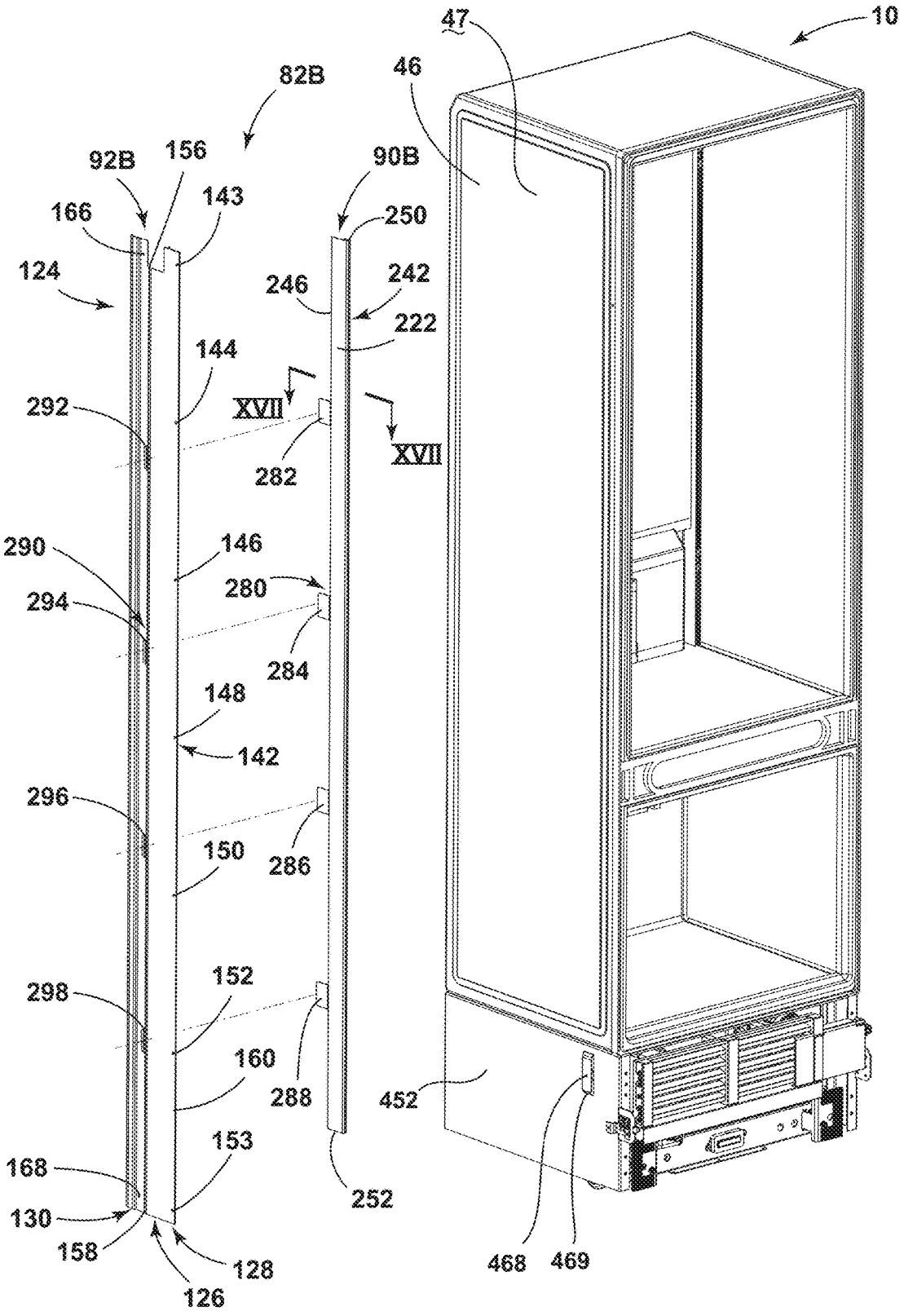
FIG. 16 is a front top perspective view of the refrigerator of FIG. 1 with a side-mounting bracket system exploded away therefrom.

Referring now to FIG. 16, the refrigerator 10 is shown with another side-mounting bracket system 82B shown exploded away from the outer surface 47 of the first sidewall 46 of the refrigerator 10. In the embodiment shown in FIG. 16, the side-mounting bracket system 82B includes a mounting bracket 90B and trim member 92B that is contemplated to be similar to trim member 92 described above. The mounting bracket 90B is contemplated to be comprised of a metal material suitable for welding to the outer surface 47 of the first sidewall 46 of the refrigerator 10. Once the mounting bracket 90B is mounted on the refrigerator 10, the trim member 92B can then be mounted to the mounting bracket 90B, as further described below. The trim member 92B of side-mounting bracket system 82B is contemplated to connect to the cabinet structure 60 in the same manner as trim member 92 described above with reference to FIGS. 9-10.

Figure 17:
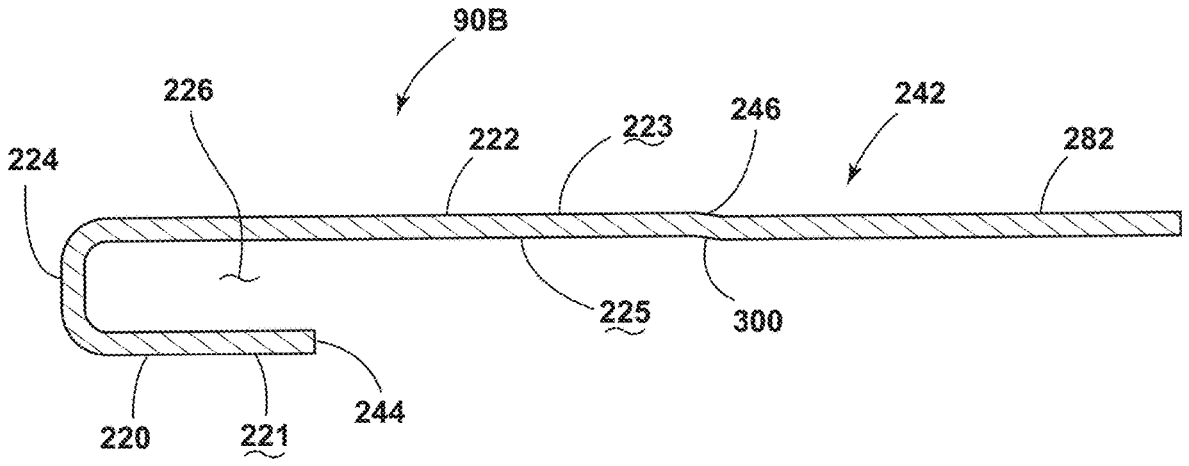
FIG. 17 is a cross-section view of a mounting bracket of the side-mounting bracket system of FIG. 16 taken at line XVII.

Referring now to FIG. 17, the mounting bracket 90B is shown from a crossectional view. Mounting bracket 90B includes a number of features in common with mounting bracket 90A described above. As such, reference numerals used to describe mounting bracket 90A will be used to describe mounting bracket 90B to indicate common features shared between mounting brackets 90A and 90B. As shown in the FIG. 17, the mounting bracket 90B includes an inner wall 220 spaced-apart from an outer wall 222 with a sidewall 224 interconnecting the inner wall 220 and the outer wall 222. A channel 226 is defined between the inner wall 220, the outer wall 222 and the sidewall 224. The inner wall 220 and the outer wall 222 of the mounting bracket 90B both extend in a rearward direction from the sidewall 224, in the embodiment shown in FIG. 17. The mounting bracket 90B includes a body portion 242 having first and second ends 244, 246, such that the mounting bracket 90B is contemplated to be comprised of an extruded or roll-formed sheet metal material that is shaped into the inner wall 220, the outer wall 222 and the sidewall 224 thereof. With reference to FIG. 16, the mounting bracket 90B includes a plurality of tabs 280 comprised of tabs 282, 284, 286 and 288 which are vertically spaced-apart from one another along a length of the body portion 242 of the mounting bracket 90B and outwardly extending from the second end 246 of the mounting bracket 90B. Each tab 282, 284, 286 and 288 of the plurality of tabs 280 is slightly inwardly disposed relative to the outer wall 222 by a transitional portion 300. The body portion 242 of the mounting bracket 90B further includes upper and lower ends 250, 252, as best shown in FIG. 16. With further reference to FIG. 17, the inner wall 220 and the outer wall 222 of the mounting bracket 90B are generally planar walls that run substantially parallel to one another, and include respective outer surfaces 221, 223. The outer surface 221 of the inner wall 220 is configured to abut the outer surface 47 of the first sidewall 46 of the external wrapper 20 of the refrigerator 10 in assembly, and is contemplated to be welded thereto to fixedly couple the mounting bracket 90B to the refrigerator 10. The outer surface 223 of the outer wall 222 is configured to abut the inner surface 127 of the first mounting portion 126 of the trim member 92B, as further described below.

Figure 18:
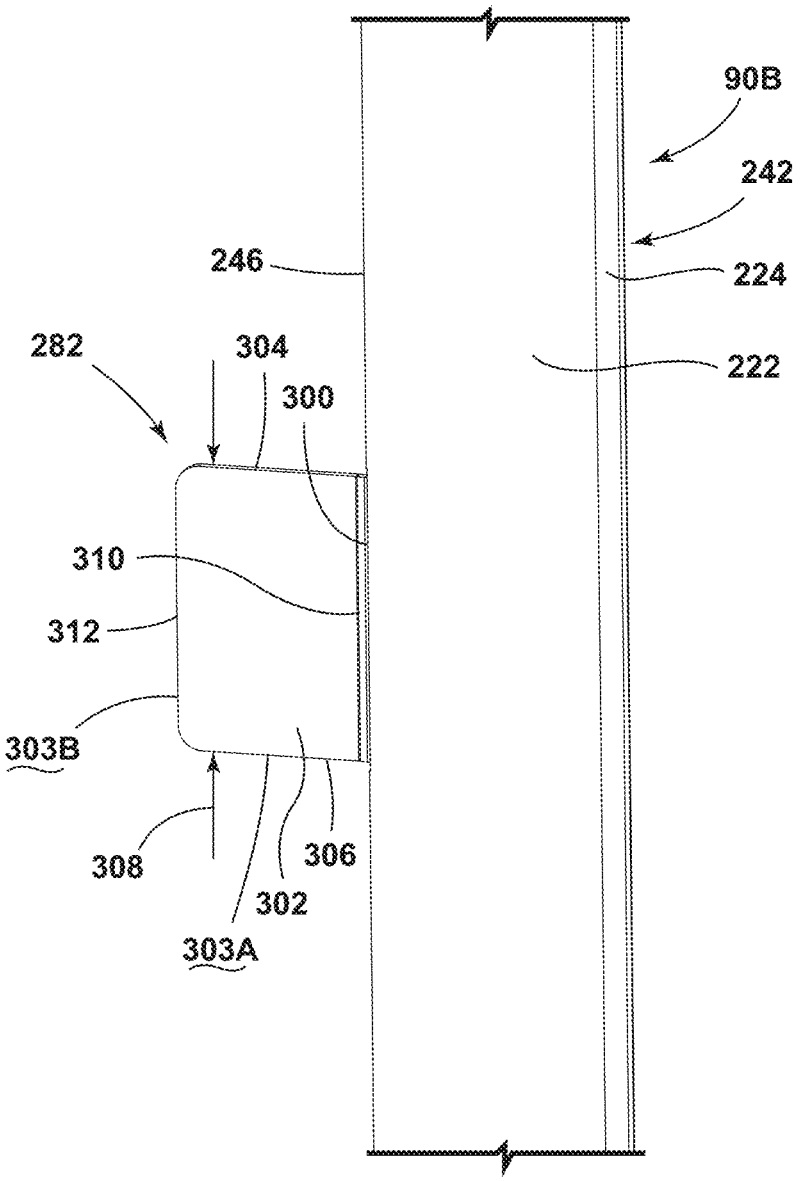
FIG. 18 is a fragmentary top perspective view of the mounting bracket of FIG. 16.

Referring now to FIG. 18, the tab 282 of the plurality of tabs 280 is shown rearwardly extending from the outer wall 222 of the mounting bracket 90B. The tab 282, as shown in FIG. 18, is representative of tabs 284, 286 and 288 with regards to configuration. As shown in FIG. 18, the tab 282 includes a body portion 302 having an upper edge 304 and a lower edge 306 to define a width 308 of the tab 282. The tab 282 further includes a rear edge 310 disposed adjacent to the transitional portion 300, and a front edge 312. The front edge 312 of the tab 282 defines a distal most end of the tab 282. The body portion 302 of the tab 282 includes an outer surface 303A and an inner surface 303B.

With reference to FIG. 16, the trim member 92B includes a plurality of slots 290 disposed therethrough. The slots 292, 294, 296 and 298 of the plurality of slots 290 are vertically spaced-apart along a length of the trim member 92B, such that the slots 292, 294, 296 and 298 of the trim member 92B are configured to align with the tabs 282, 284, 286 and 288, respectively, of the mounting bracket 90B. In this way, the tabs 282, 284, 286 and 288 of the mounting bracket 90B can be received through the slots 292, 294, 296 and 298 of the trim member 92B in assembly. It is contemplated that the slots 292, 294, 296 and 298 of the trim member 92B include a width that is commensurate with the width 308 of the tab 282, such that the reception of the tabs 282, 284, 286 and 288 through the slots 292, 294, 296 and 298 restricts vertical movement of the trim member 92B when mounted to the mounting bracket 90B.

Figure 19:
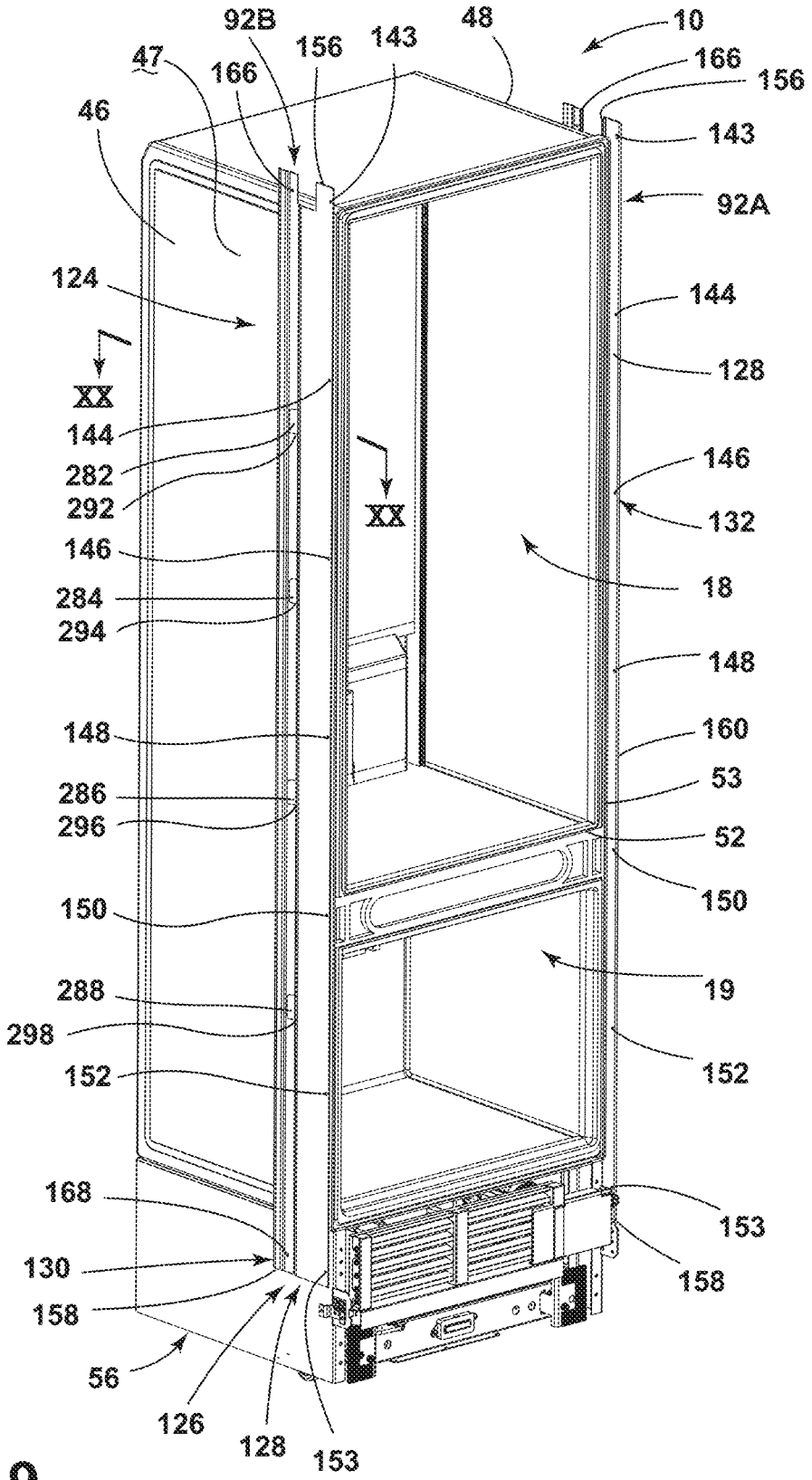
FIG. 19 is a front top perspective view of the refrigerator of FIG. 16 with the side-mounting bracket system mounted thereto.

Referring now to FIG. 19, the trim member 92B is shown mounted on the mounting bracket 90B, which is mounted on the refrigerator 10 at the outer surface 47 of the first sidewall 46 of the external wrapper 20. With the trim member 92B mounted on the mounting bracket 90B, the tabs 282, 284, 286 and 288 of the mounting bracket 90B are shown extending through the respective slots 292, 294, 296 and 298 of the trim member 92B.

Figure 20:
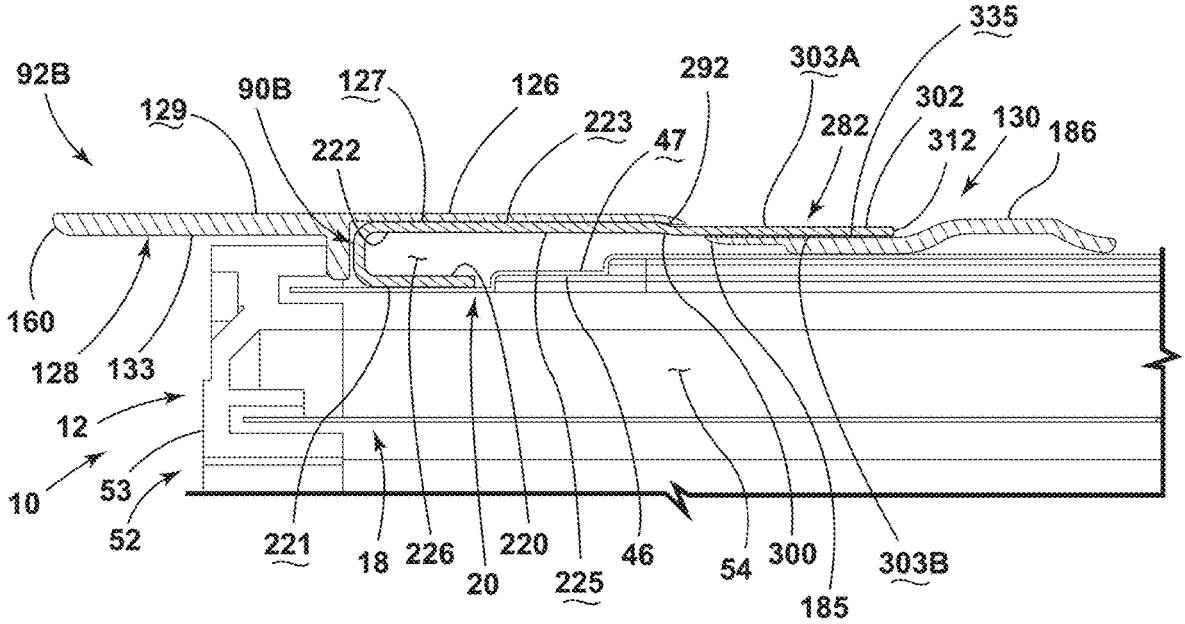
FIG. 20 is a fragmentary cross-section view of the side-mounting bracket system and the refrigerator of FIG. 19 taken at line XX.

Referring now to FIG. 20, the trim member 92B is shown mounted on the mounting bracket 90B in a cross-sectional view. As mounted thereto, the tab 282 of the mounting bracket 90B is received through the slot 292 of the trim member 92B. As further shown in FIG. 20, the slot 292 of the trim member 92B is positioned at the inwardly angled transverse portion 185 of the trim member 92B. In this way, the inner surface 303B of the tab 282 abuts an outer surface 135 of the abutment portion 130 of the trim member 92B. As shown in FIG. 20, the inner surface 127 of the first mounting portion 126 of the trim member 92B abuts the outer surface 223 of the outer wall 222 of the mounting bracket 90B in assembly. Similarly, the outer surface 221 of the inner wall 220 of the mounting bracket 90B abuts the outer surface 47 of the first sidewall 46 of the refrigerator 10 in assembly.

Figure 21:
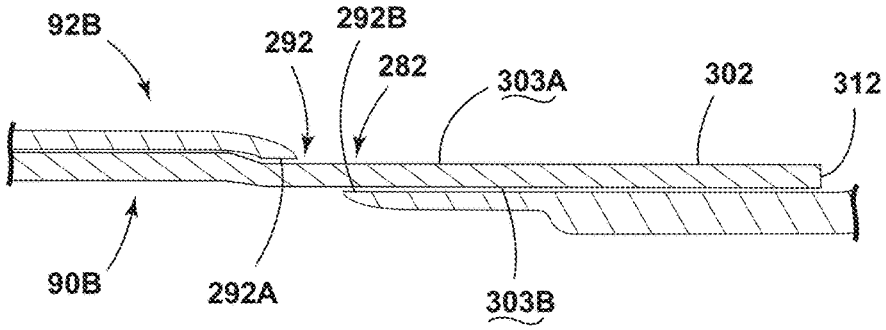
FIG. 21 is zoomed-in view of the mounting bracket and trim member of the side-mounting bracket system of FIG. 20.

Referring now to FIG. 21, the slot 292 includes a front edge 292A and a rear edge 292B which abut the outer surface 303A and the inner surface 303B, respectively, of the body portion 302 of the tab 282 on opposite sides of the tab 282. This abutting engagement provides for a low tolerance fit between the mounting bracket 90B and the trim member 92B to help prevent rotational movement of the trim member 92B as mounted to the mounting bracket 90B.

Figure 22:
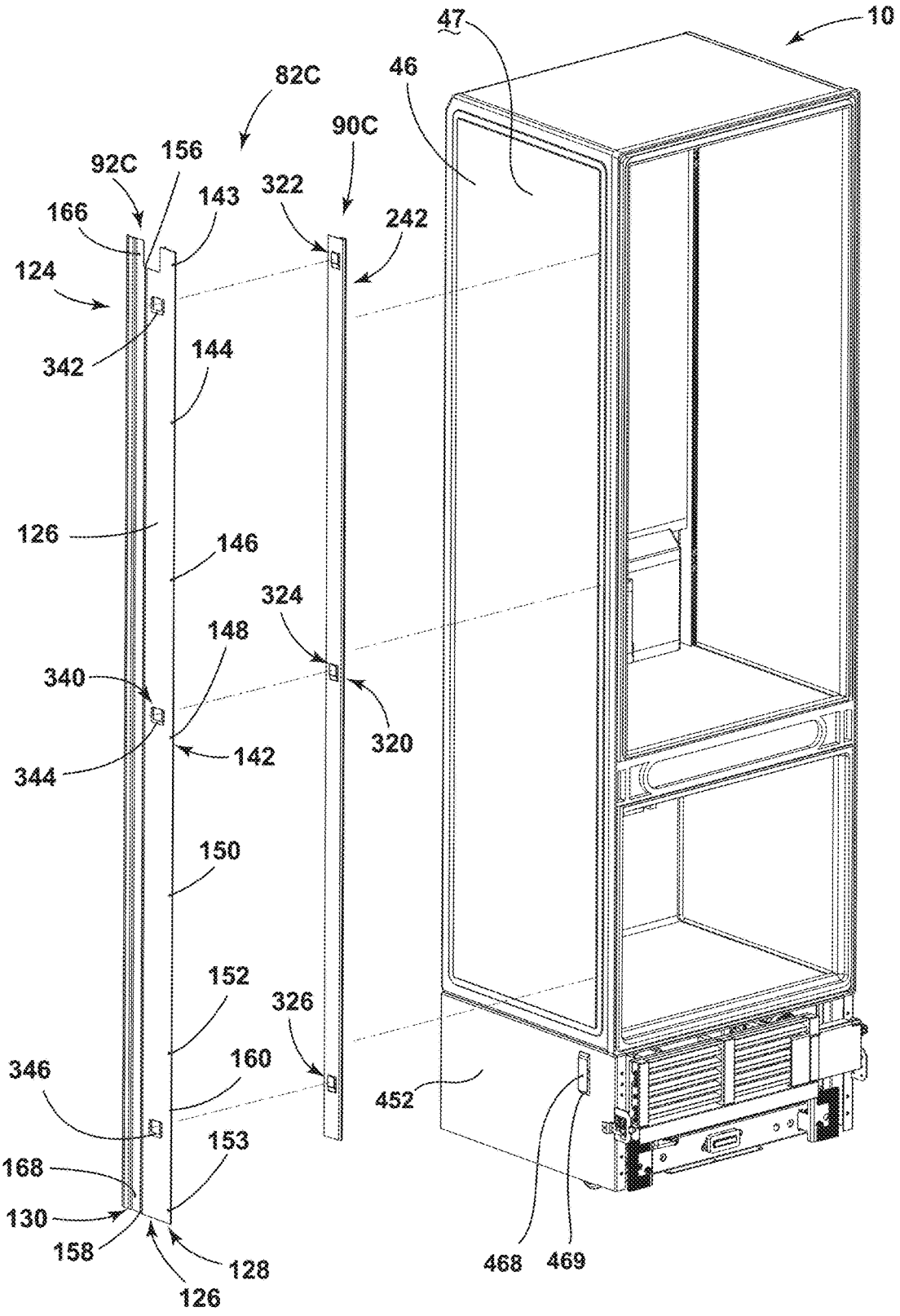
FIG. 22 is a front top perspective view of the refrigerator of FIG. 1 with a side-mounting bracket system exploded away therefrom.

Referring now to FIG. 22, the refrigerator 10 is shown with another side-mounting bracket system 82C shown exploded away from the outer surface 47 of the first sidewall 46 of the refrigerator 10. In the embodiment shown in FIG. 22, the side-mounting bracket system 82C includes a mounting bracket 90C and trim member 92C that is contemplated to be similar to trim member 92B described above. The mounting bracket 90C is contemplated to be comprised of a metal material suitable for welding to the outer surface 47 of the first sidewall 46 of the refrigerator 10. Once the mounting bracket 90C is mounted on the refrigerator 10, the trim member 92C can then be mounted to the mounting bracket 90C, as further described below. The trim member 92C of side-mounting bracket system 82C connects to the cabinet structure 60 in the same manner as trim member 92 described above with reference to FIGS. 9-10.

Figure 23:
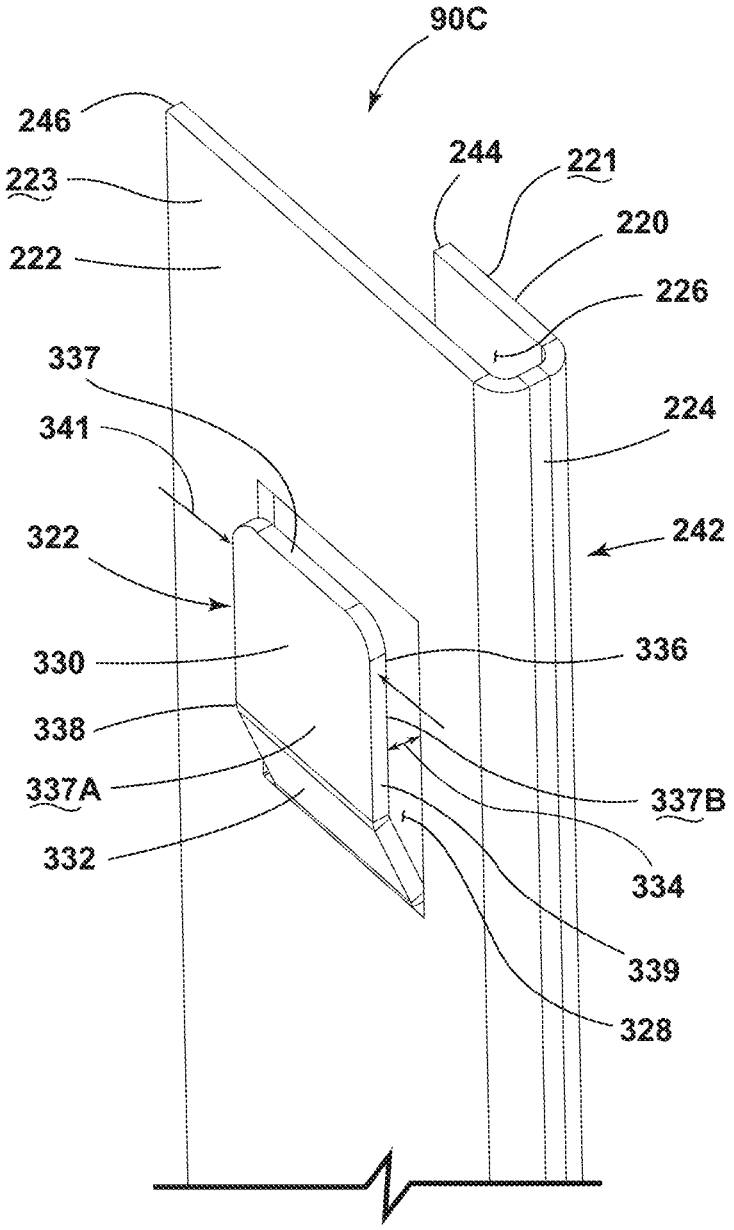
FIG. 23 is a fragmentary top perspective view of a mounting bracket of the side-mounting bracket system of FIG. 22.

Referring now to FIG. 23, the mounting bracket 90C is shown from a top perspective view. Mounting bracket 90C includes a number of features in common with mounting bracket 90A described above. As such, reference numerals used to describe mounting bracket 90A will be used to describe mounting bracket 90C to indicate like features. As shown in the FIG. 23, the mounting bracket 90C includes an inner wall 220 spaced-apart from an outer wall 222 with a sidewall 224 interconnecting the inner wall 220 and the outer wall 222. The inner wall 220 and the outer wall 222 of the mounting bracket 90C both extend in a rearward direction from the sidewall 224, in the embodiment shown in FIG. 23. A channel 226 is defined between the inner wall 220, the outer wall 222 and the sidewall 224. The mounting bracket 90C includes a body portion 242 having first and second ends 244, 246, such that the mounting bracket 90C is contemplated to be comprised of an extruded or roll-formed sheet metal material that is shaped into the inner wall 220, the outer wall 222 and the sidewall 224 thereof. With reference to FIG. 22, the mounting bracket 90C includes a plurality of hook members 320 comprised of hook members 322, 324 and 326 which are spaced-apart from one another along a length of the body portion 242 of the mounting bracket 90C. Each hook member 322, 324 and 326 of the plurality of hook members 320 includes an upwardly extending tab 330 disposed over an open aperture 328 as best shown in FIG. 23. The upwardly extending tab 330 is outwardly disposed relative to the outer wall 222 of the mounting bracket 90C by a transitional portion 332 to define a spacing 334 between the upwardly extending tab 330 and the outer wall 222 of the mounting bracket 90C.

With further reference to FIG. 23, the inner wall 220 and the outer wall 222 of the mounting bracket 90C are generally planar walls that run substantially parallel to one another, and include respective outer surfaces 221, 223. The outer surface 221 of the inner wall 220 is configured to abut the outer surface 47 of the first sidewall 46 of the external wrapper 20 of the refrigerator 10 in assembly, and is contemplated to be welded thereto to fixedly couple the mounting bracket 90C to the refrigerator 10. The outer surface 223 of the outer wall 222 is configured to abut the inner surface 127 of the first mounting portion 126 of the trim member 92C, as further described below. The hook member 322 of the plurality of hook members 320, as shown in FIG. 23, is representative of hook members 324 and 326 with regards to configuration. As shown in FIG. 23, the upwardly extending tab 330 of hook member 322 includes a body portion 336 having an upper edge 337, and first and second side edges 338, 339. Together, the first and second side edges 338, 339 define a width 341 of the hook member 322. The body portion 336 of the hook member 322 includes an outer surface 337A and an inner surface 337B.

With further reference to FIG. 22, the first mounting portion 126 of the trim member 92C includes a plurality of cutouts 340 disposed therethrough. The cutouts 342, 344 and 346 of the plurality of cutouts 340 are vertically spaced-apart along a length of the trim member 92C, such that the cutouts 342, 344 and 346 of the trim member 92C are configured to align with the hook members 322, 324 and 326, respectively, of the mounting bracket 90C. In this way, the hook members 322, 324 and 326 of the mounting bracket 90C can be received through the cutouts 342, 344 and 346 of the trim member 92C in assembly. The cutouts 342, 344 and 346 of the trim member 92C define open apertures disposed through the first mounting portion 126 of the trim member 92C. In FIG. 22, the cutouts 342, 344 and 346 are square-shaped cutouts, however, other shapes are contemplated for the cutouts 342, 344 and 346. The cutouts 342, 344 and 346 of the trim member 92C may include a width that is commensurate with the width 341 (FIG. 23) of hook member 322, such that the reception of the hook members 322, 324 and 326 through the respective cutouts 342, 344 and 346 restricts lateral movement of the trim member 92C when mounted to the mounting bracket 90C.

Figure 24:
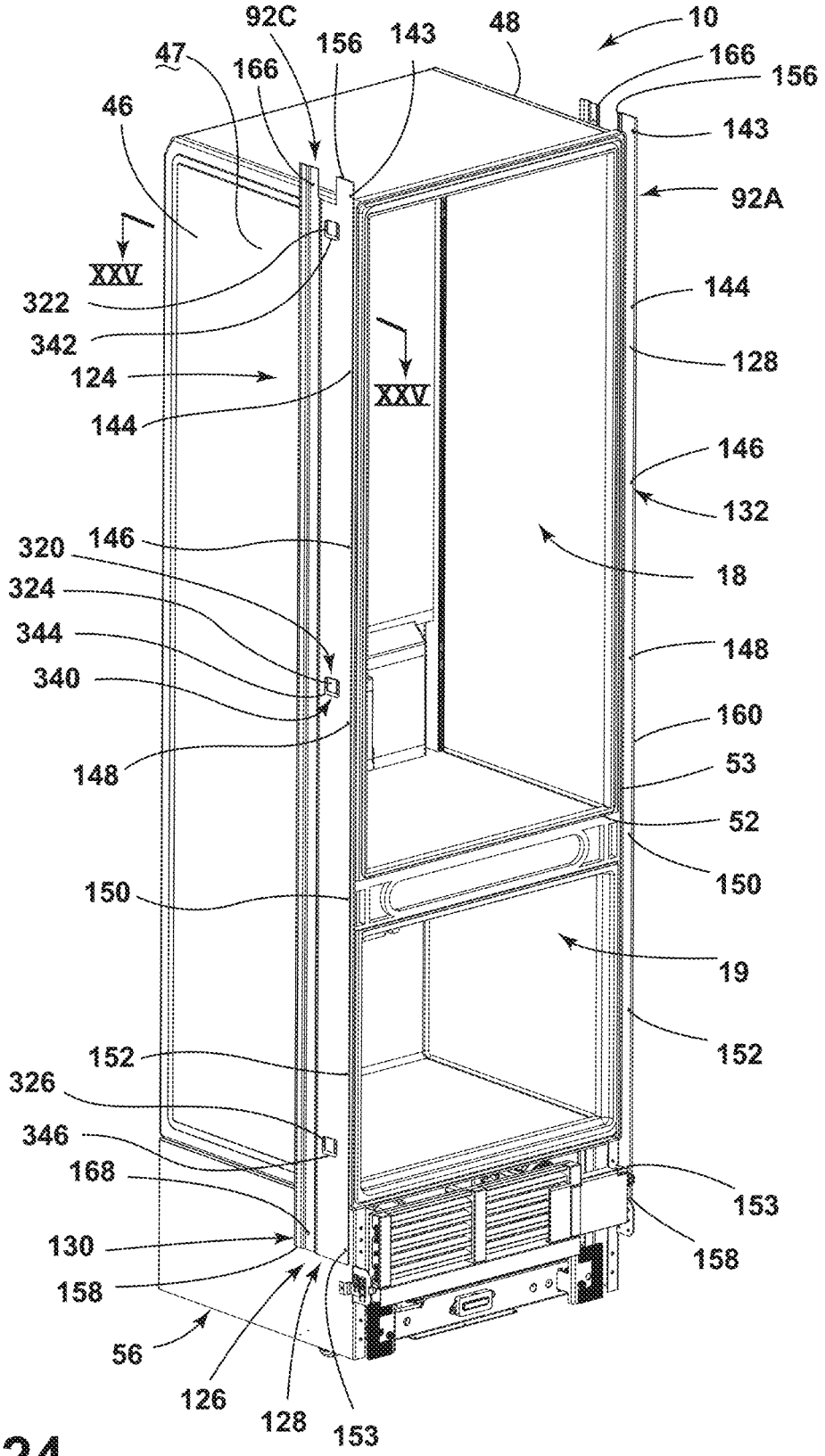
FIG. 24 is a front top perspective view of the refrigerator of FIG. 22 with the side-mounting bracket system mounted thereto.

Referring now to FIG. 24, the trim member 92C is shown mounted on the mounting bracket 90C, which is mounted on the refrigerator 10 at the outer surface 47 of the first sidewall 46 of the external wrapper 20. With the trim member 92C mounted on the mounting bracket 90C, the hook members 322, 324 and 326 of the mounting bracket 90C are shown extending through the respective cutouts 342, 344 and 346 of the trim member 92C.

Figure 25:
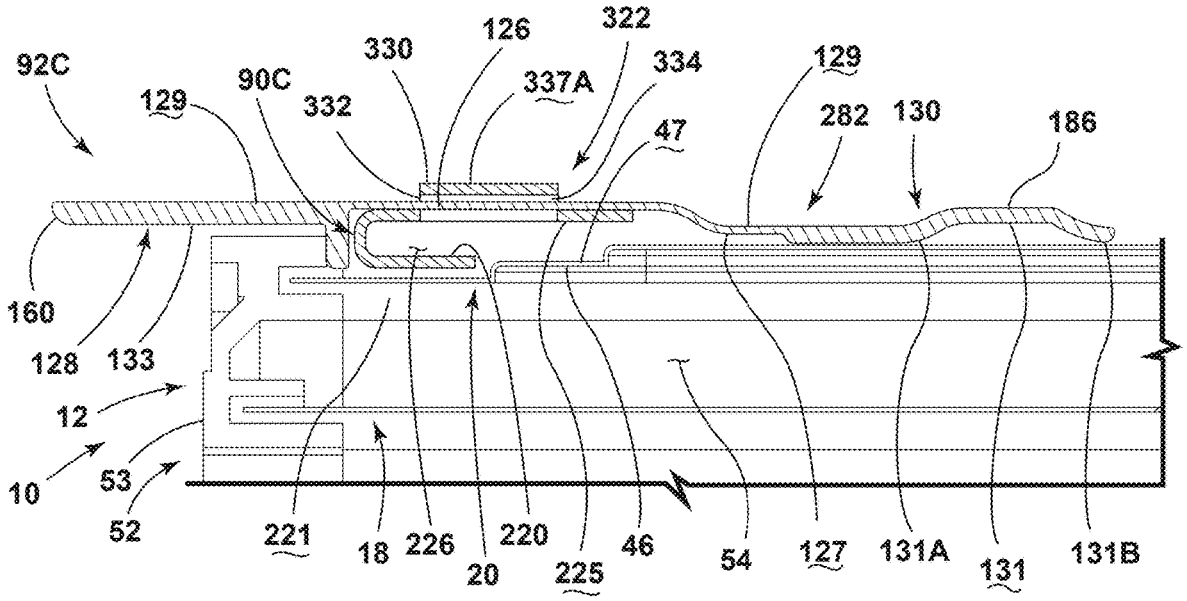
FIG. 25 is a fragmentary cross-section view of the side-mounting bracket system and the refrigerator of FIG. 24 taken at line XXV.

Referring now to FIG. 25, the trim member 92C is shown mounted on the mounting bracket 90C in a cross-sectional view. As mounted thereto, the hook member 322 of the mounting bracket 90C is received through the cutout 342 of the trim member 92C. As further shown in FIG. 25, the inner surface 127 of the first mounting portion 126 of the trim member 92C abuts the outer surface 223 of the outer wall 222 of the mounting bracket 90C in assembly. Similarly, the outer surface 221 of the inner wall 220 of the mounting bracket 90C abuts the outer surface 47 of the first sidewall 46 of the refrigerator 10 in assembly.

Figure 26:
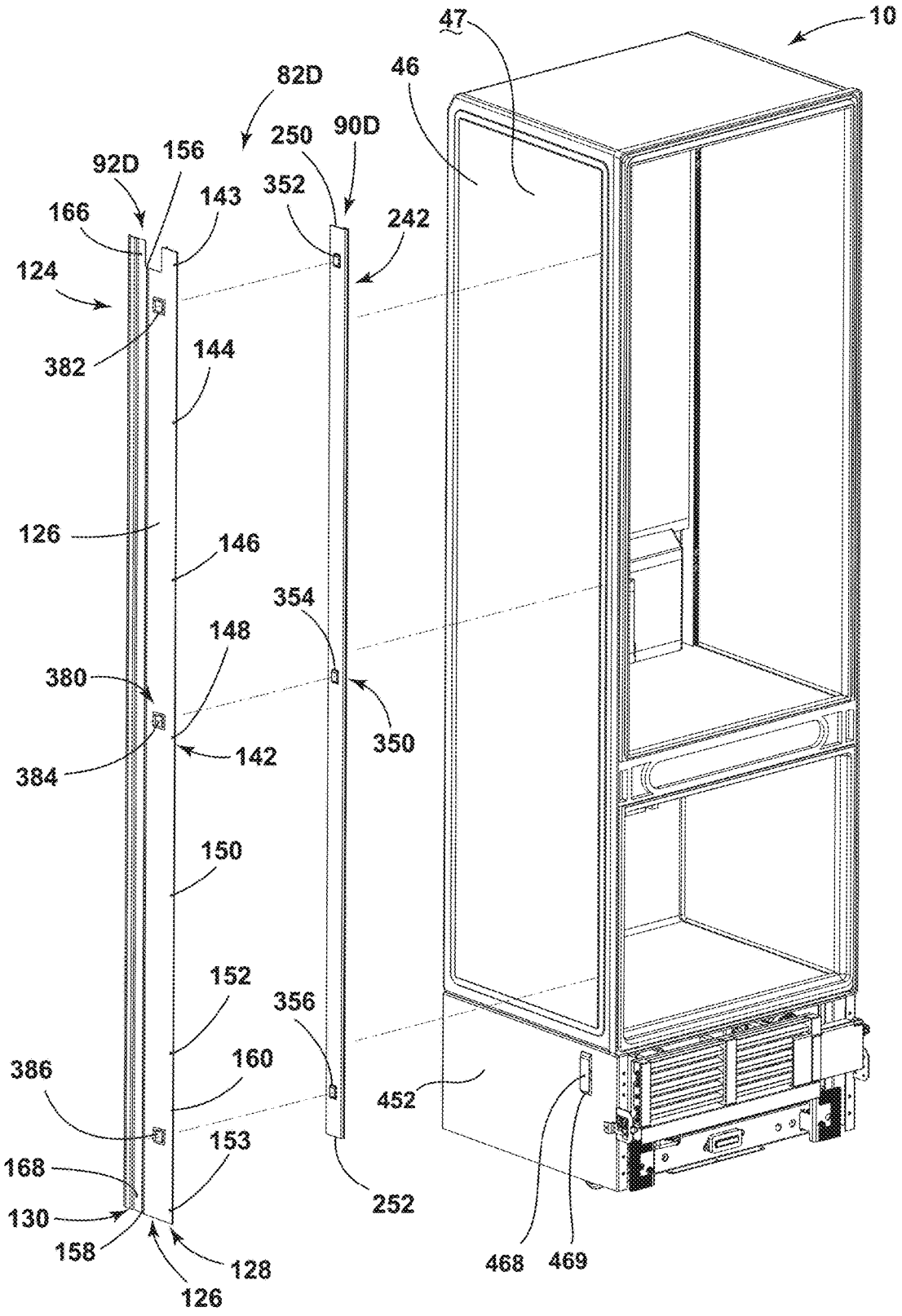
FIG. 26 is a front top perspective view of the refrigerator of FIG. 1 with a side-mounting bracket system exploded away therefrom.

Referring now to FIG. 26, the refrigerator 10 is shown with another side-mounting bracket system 82D shown exploded away from the outer surface 47 of the first sidewall 46 of the refrigerator 10. In the embodiment shown in FIG. 26, the side-mounting bracket system 82D includes a mounting bracket 90D and a trim member 92D that is contemplated to be similar to the trim member 92C described above. The mounting bracket 90D is contemplated to be comprised of a metal material suitable for welding to the outer surface 47 of the first sidewall 46 of the refrigerator 10. Once the mounting bracket 90D is mounted on the refrigerator 10, the trim member 92D can then be mounted to the mounting bracket 90D, as further described below. The trim member 92D of side-mounting bracket system 82D connects to the cabinet structure 60 in the same manner as trim member 92 described above with reference to FIGS. 9-10.

Figure 27:
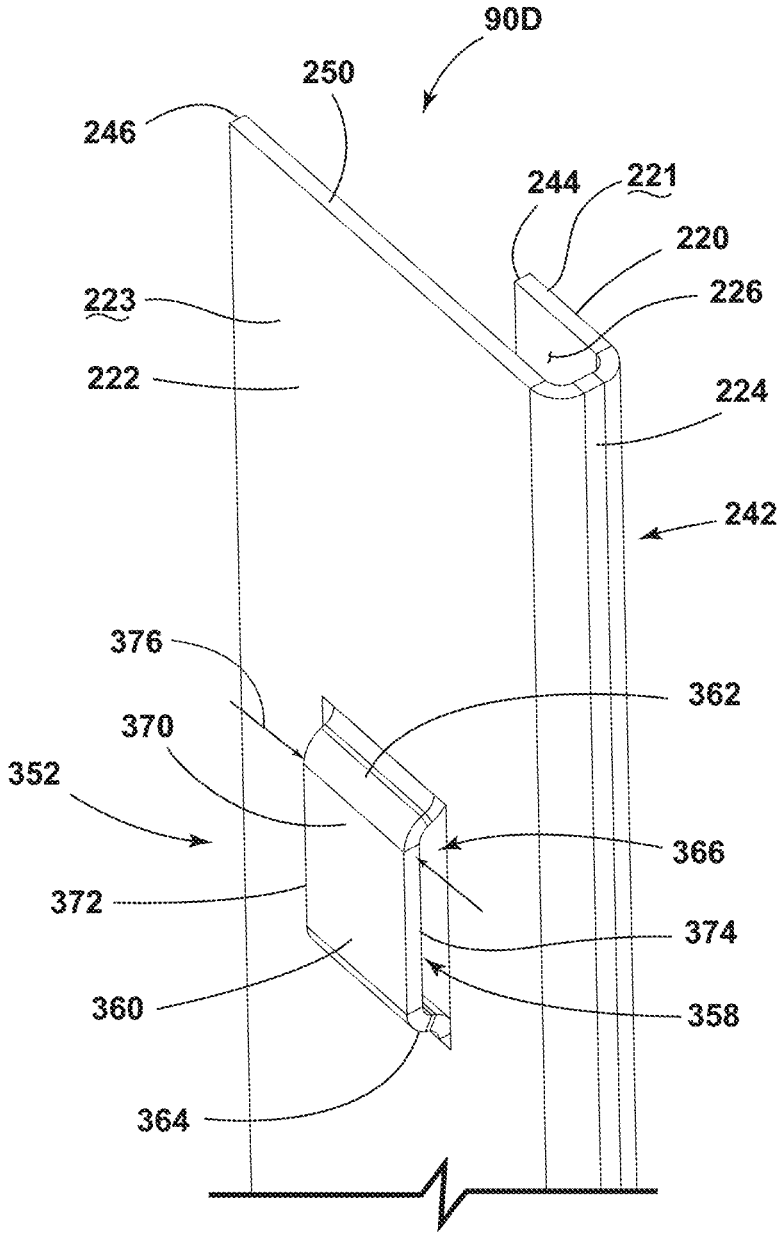
FIG. 27 is a fragmentary top perspective view of a mounting bracket of the side-mounting bracket system of FIG. 26.

Referring now to FIG. 27, the mounting bracket 90D is shown from a top perspective view. Mounting bracket 90D includes a number of features in common with mounting bracket 90C described above. As such, reference numerals used to describe mounting bracket 90C will be used to describe mounting bracket 90D to indicate like features. As shown in FIG. 27, the mounting bracket 90D includes an inner wall 220 spaced-apart from an outer wall 222 with a sidewall 224 interconnecting the inner wall 220 and the outer wall 222. The inner wall 220 and the outer wall 222 of the mounting bracket 90D both extend in a rearward direction from the sidewall 224, in the embodiment shown in FIG. 27. A channel 226 is defined between the inner wall 220, the outer wall 222 and the sidewall 224. The mounting bracket 90D includes a body portion 242 having first and second ends 244, 246, such that the mounting bracket 90D is contemplated to be comprised of an extruded or roll-formed sheet metal material that is shaped into the inner wall 220, the outer wall 222 and the sidewall 224 thereof. With reference to FIG. 26, the mounting bracket 90D includes a plurality of mounting flanges 350 comprised of mounting flanges 352, 354 and 356 which are vertically spaced-apart from one another along a length of the body portion 242 of the mounting bracket 90D. Each mounting flange 352, 354 and 356 of the plurality of mounting flanges 350 includes an outwardly extending tab 360 disposed over an open aperture 358 as best shown in FIG. 27. The outwardly extending tab 360 is outwardly disposed relative to the outer wall 222 of the mounting bracket 90D by upper and lower transitional portions 362, 364 to define a spacing 366 between the outwardly extending tab 360 and the outer wall 222 of the mounting bracket 90D.

With further reference to FIG. 27, the inner wall 220 and the outer wall 222 of the mounting bracket 90D are generally planar walls that run substantially parallel to one another, and include respective outer surfaces 221, 223. The outer surface 221 of the inner wall 220 is configured to abut the outer surface 47 of the first sidewall 46 of the external wrapper 20 of the refrigerator 10 in assembly, and is contemplated to be welded thereto to fixedly couple the mounting bracket 90D to the refrigerator 10. The outer surface 223 of the outer wall 222 is configured to abut the inner surface 127 of the first mounting portion 126 of the trim member 92D, as further described below. The mounting flange 352 of the plurality of mounting flanges 350, as shown in FIG. 27, is representative of mounting flanges 354 and 356 with regards to configuration. As shown in FIG. 27, the outwardly extending tab 360 of mounting flange 352 includes a body portion 370 having side edges 372, 374 to define a width 376 of the mounting flange 352.

With reference to FIG. 26, the first mounting portion 126 of the trim member 92D includes a plurality of cutouts 380 disposed therethrough. The cutouts 382, 384 and 386 of the plurality of cutouts 380 are vertically spaced-apart along a length of the trim member 92D, such that the cutouts 382, 384 and 386 of the trim member 92D are configured to align with the mounting flanges 352, 354 and 356, respectively, of the mounting bracket 90D. In this way, the mounting flanges 352, 354 and 356 of the mounting bracket 90D can be received through the cutouts 382, 384 and 386 of the trim member 92D in assembly. The cutouts 382, 384 and 386 define open apertures disposed through the first mounting portion 126 of the trim member 92D. In FIG. 26, the cutouts 382, 384 and 386 are square shaped cutouts, however, other shapes are contemplated for the cutouts 382, 384 and 386. The cutouts 382, 384 and 386 of the trim member 92D may include a width that is commensurate with the width 376 of mounting flange 352, such that the reception of the mounting flanges 352, 354 and 356 through the cutouts 382, 384 and 386 restricts lateral movement of the trim member 92D when mounted to the mounting bracket 90D.

Figure 28:
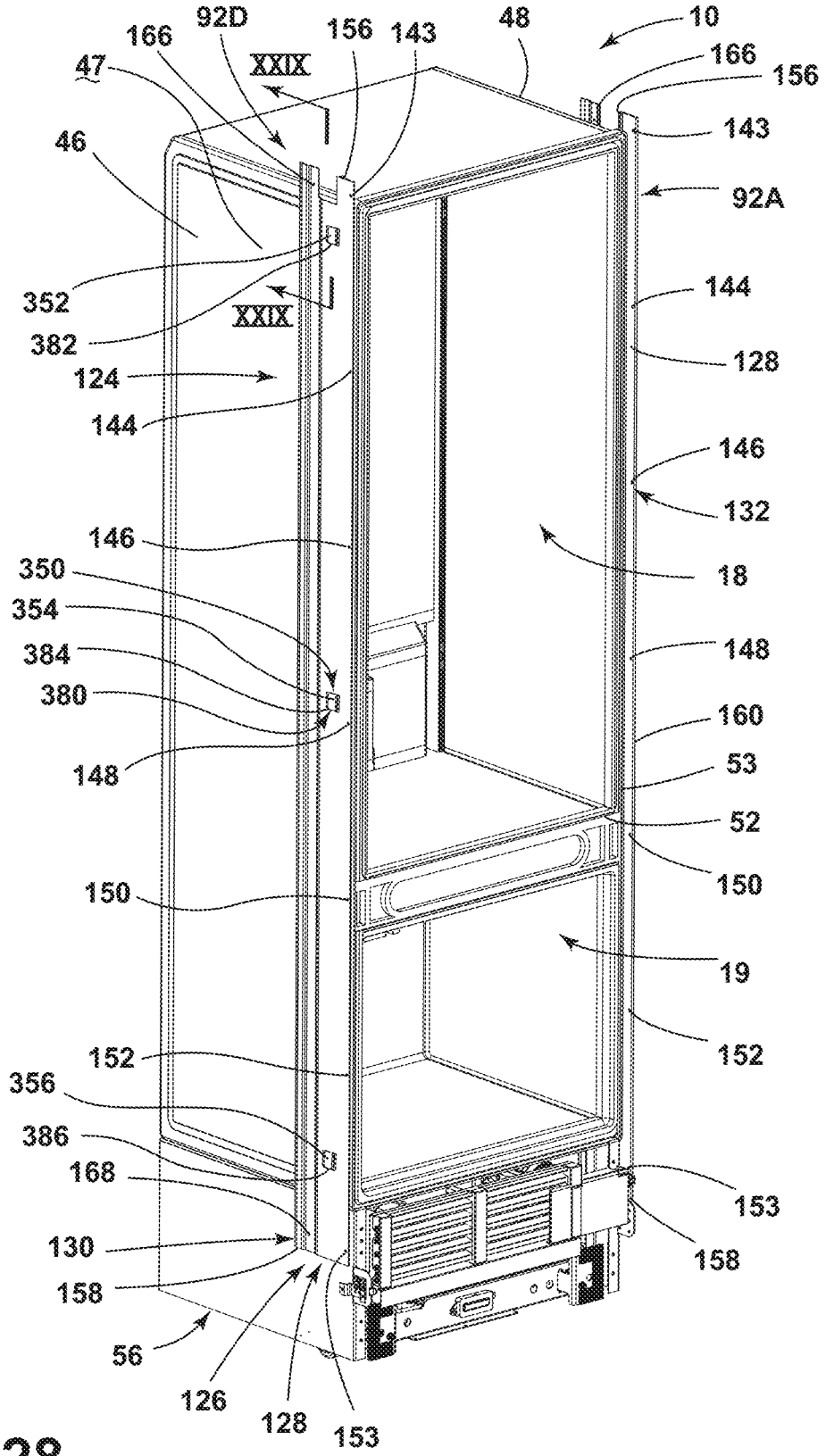
FIG. 28 is a front top perspective view of the refrigerator of FIG. 26 with the side-mounting bracket system mounted thereto.

Referring now to FIG. 28, the trim member 92D is shown mounted on the mounting bracket 90D, which is mounted on the refrigerator 10 at the outer surface 47 of the first sidewall 46 of the external wrapper 20. With the trim member 92D mounted on the mounting bracket 90D, the mounting flanges 352, 354 and 356 of the mounting bracket 90D are shown extending through the respective cutouts 382, 384 and 386 of the trim member 92D.

Figure 29:
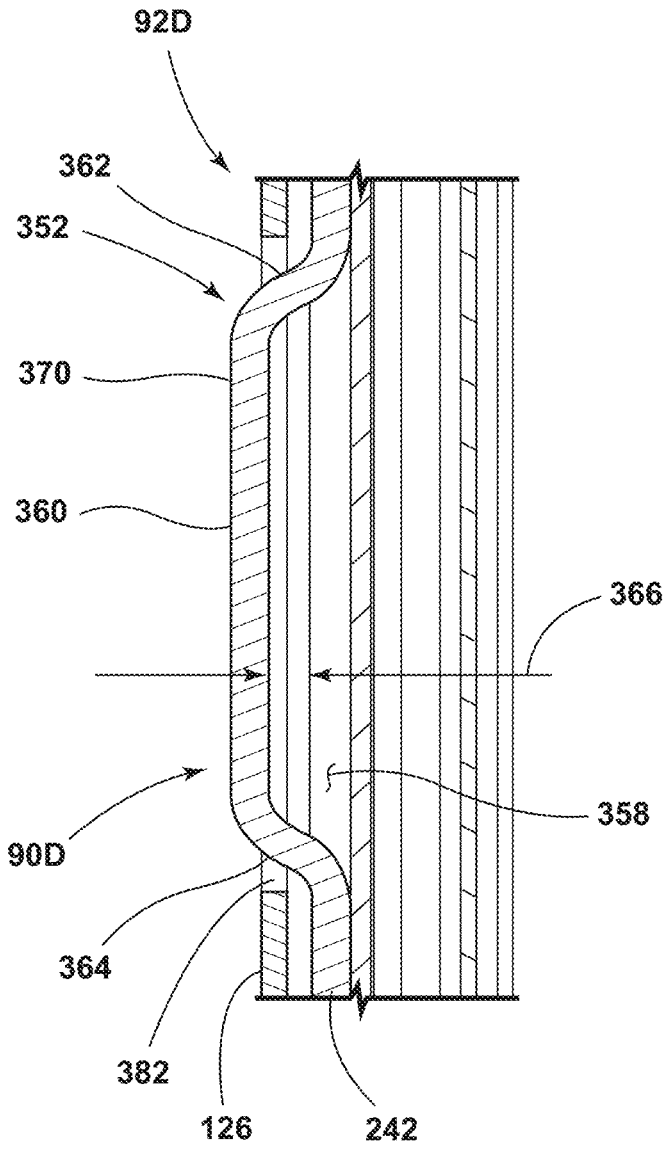
FIG. 29 is a fragmentary cross-section view of the side-mounting bracket system and the refrigerator of FIG. 28 taken at line XXIX.

Referring now to FIG. 29, the trim member 92D is shown mounted on the mounting bracket 90D in a cross-sectional view. As mounted thereto, the mounting flange 352 of the mounting bracket 90D is received through the cutout 382 of the trim member 92D. Much like mounting bracket 90C and trim member 92C shown in FIG. 25, the inner surface 127 of the first mounting portion 126 of the trim member 92D is contemplated to abut the outer surface 223 of the outer wall 222 of the mounting bracket 90D in assembly, and the outer surface 221 of the inner wall 220 of the mounting bracket 90D is contemplated to abut the outer surface 47 of the first sidewall 46 of the refrigerator 10 in assembly.

Figure 30:
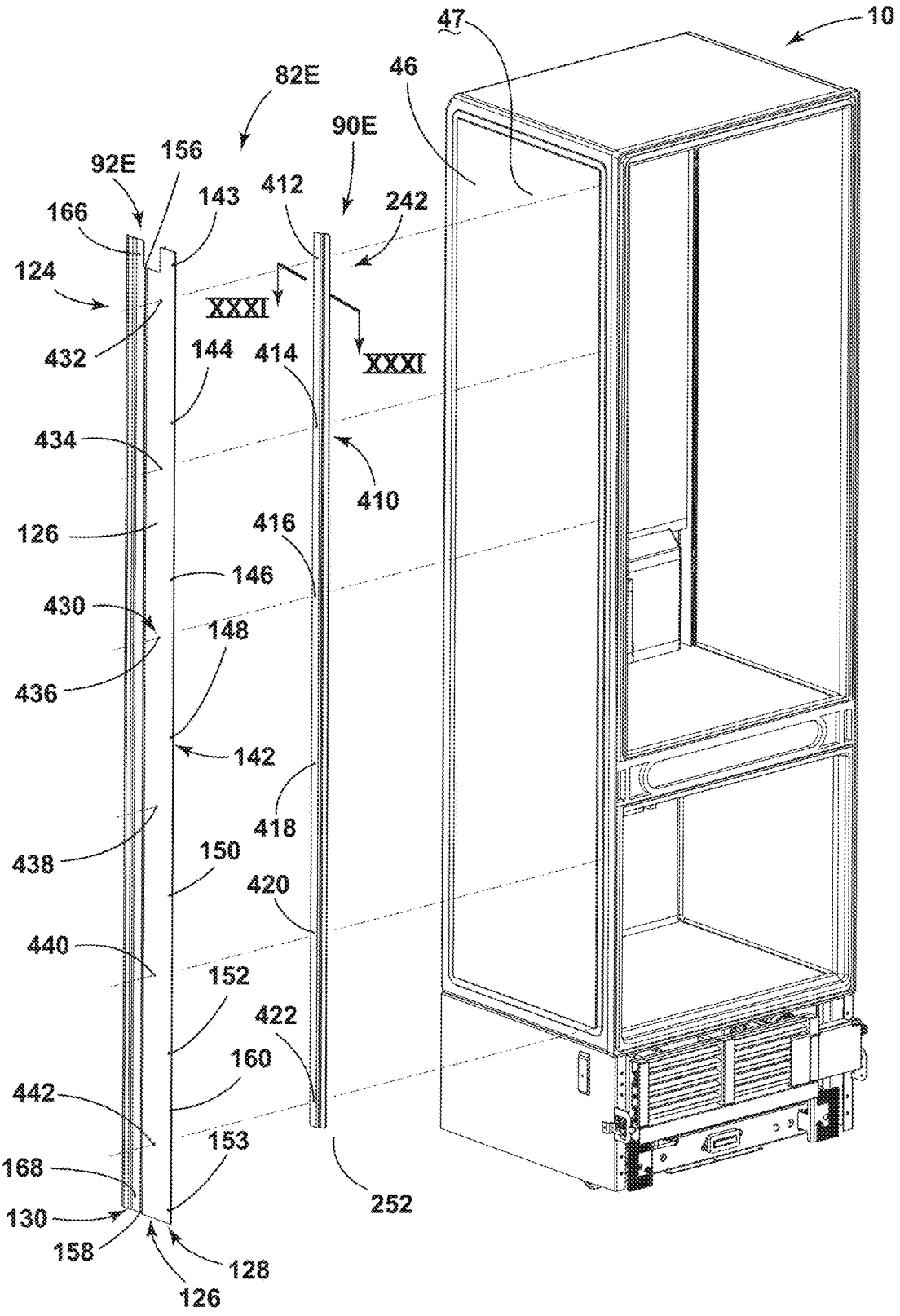
FIG. 30 is a front top perspective view of the refrigerator of FIG. 1 with a side-mounting bracket system exploded away therefrom.

Referring now to FIG. 30, the refrigerator 10 is shown with another side-mounting bracket system 82E shown exploded away from the outer surface 47 of the first sidewall 46 of the refrigerator 10. In the embodiment shown in FIG. 30, the side-mounting bracket system 82E includes a mounting bracket 90E and trim member 92 that is contemplated to be similar, if not identical, to trim member 92 described above with reference to FIGS. 3A and 3B. The mounting bracket 90E is contemplated to be comprised of a metal material suitable for welding to the outer surface 47 of the first sidewall 46 of the refrigerator 10. Once the mounting bracket 90E is mounted on the refrigerator 10, the trim member 92 can then be mounted to the mounting bracket 90E, as further described below.

Figure 31:
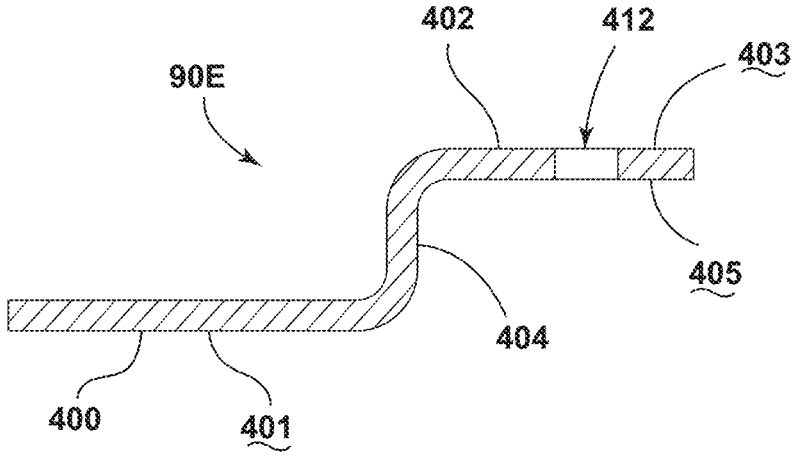
FIG. 31 is a cross-section view of a mounting bracket of the side-mounting bracket system of FIG. 30 taken at line XXXI.

Referring now to FIG. 31, the mounting bracket 90E is shown from a cross-sectional view. As shown in the FIG. 31, the mounting bracket 90E includes an inner wall 400 spaced-apart from an outer wall 402 with an intermediate wall 404 interconnecting the inner wall 400 and the outer wall 402. As further shown in the FIG. 31, the inner wall 400 projects in a forward direction relative to the intermediate wall 404, while the outer wall 402 projects in a rearward direction relative to the intermediate wall 404. The outer wall 402 is outwardly offset relative to the inner wall 400 by the intermediate wall 404. The mounting bracket 90E is contemplated to be comprised of an extruded or roll-formed sheet metal material that is shaped into the inner wall 400, the outer wall 402 and the intermediate wall 404 thereof. The inner wall 400 and the outer wall 402 of the mounting bracket 90E are generally planar walls that run substantially parallel to one another, and include respective outer surfaces 401, 403. The outer surface 401 of the inner wall 400 is configured to abut the outer surface 47 of the first sidewall 46 of the external wrapper 20 of the refrigerator 10 in assembly, and is contemplated to be welded thereto to fixedly couple the mounting bracket 90E to the refrigerator 10. The outer surface 403 of the outer wall 402 is configured to abut the inner surface 127 of the first mounting portion 126 of the trim member 92, as further described below. The outer wall 402 further includes an inner surface 405.

With further reference to FIG. 30, the mounting bracket 90E includes a plurality of apertures 410 extending along a length thereof in a vertically spaced-apart relationship. The plurality of apertures 410 of the mounting bracket 90E includes apertures 412, 414, 416, 418, 420 and 422 that are vertically spaced-apart from one another. Similarly, the first mounting portion 126 of the trim member 92 includes a plurality of apertures 430 extending along a length thereof in a vertically spaced-apart relationship. The plurality of apertures 430 of the trim member 92 includes apertures 432, 434, 436, 438, 440 and 442 that are vertically spaced-apart from one another. The apertures 432, 434, 436, 438, 440 and 442 of the trim member 92 are configured to align with the apertures 412, 414, 416, 418, 420 and 422, respectively, of the mounting bracket 90E to define aligned mounting apertures therebetween. Further, the apertures 412, 414, 416, 418, 420 and 422 of the plurality of apertures 410 of the mounting bracket 90E are contemplated to have threaded inserts coupled thereto, much like threaded insert 200 described above.

Figure 32:
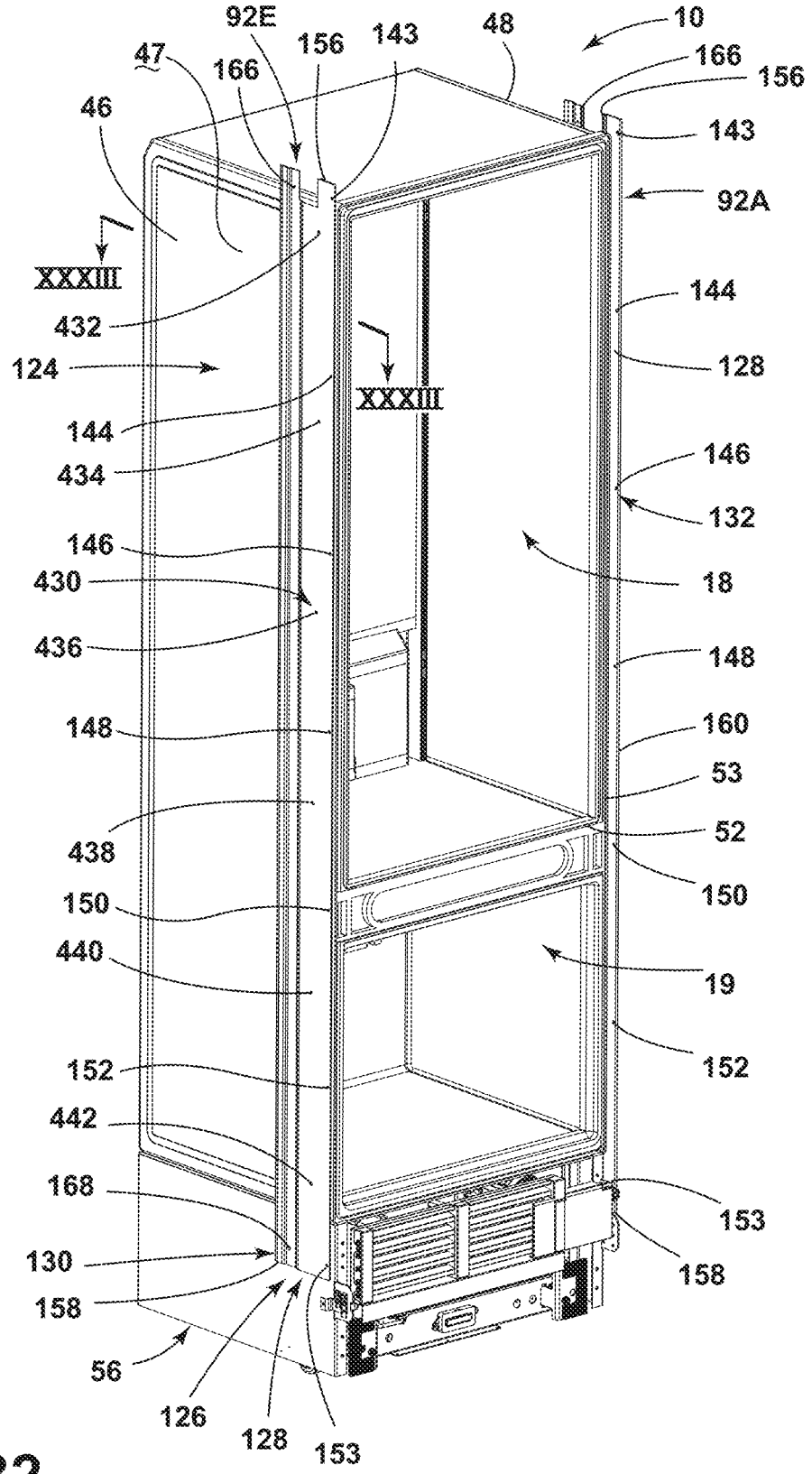
FIG. 32 is a front top perspective view of the refrigerator of FIG. 30 with the side-mounting bracket system mounted thereto.

Referring now to FIG. 32, the trim member 92 is shown mounted on the mounting bracket 90E, which is mounted on the refrigerator 10 at the outer surface 47 of the first sidewall 46 of the external wrapper 20. With the trim member 92 mounted on the mounting bracket 90E, the apertures 432, 434, 436, 438, 440 and 442 of the trim member 92 are accessible and configured to receive fasteners therethrough to secure the trim member 92 to the mounting bracket 90E.

Figure 33:
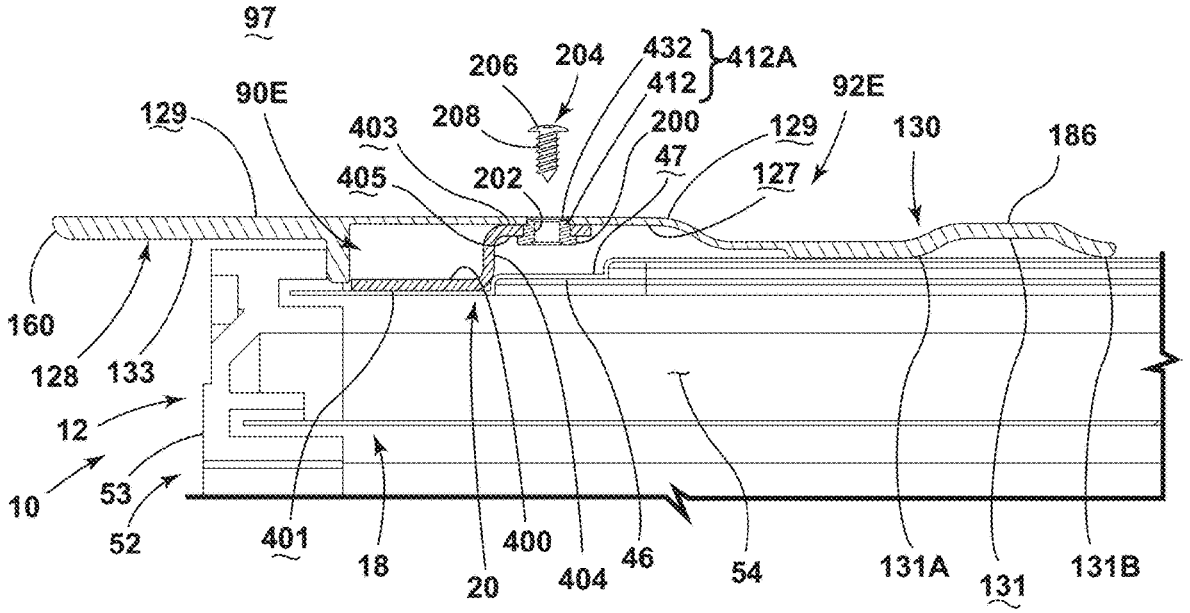
FIG. 33 is a fragmentary cross-section view of the side-mounting bracket system and the refrigerator of FIG. 32 taken at line XXXIII.

Referring now to FIG. 33, the trim member 92 is shown mounted on the mounting bracket 90E in a cross-sectional view. With the trim member 92 positioned on the mounting bracket 90E, aperture 412 of the mounting bracket 90E aligns with aperture 432 of the trim member 92 to define a first set of aligned apertures 412A, therebetween. Fastener 204, having a head portion 206 and a threaded shaft portion 208, is configured to be received in the aligned apertures 412A. The threaded insert 200 is shown mounted to aperture 412 of the mounting bracket 90E. The threaded shaft portion 208 of fastener 204 is contemplated to have a complimentary thread pattern relative to the threaded inner cavity 202 of the threaded insert 200 to threadingly engage the same, thereby securely fastening the trim member 92 to the mounting bracket 92E.

As further shown in FIG. 33, the inner surface 127 of the first mounting portion 126 of the trim member 92 abuts the outer surface 403 of the outer wall 402 of the mounting bracket 90E in assembly, and the outer surface 401 of the inner wall 400 of the mounting bracket 90E abuts the outer surface 47 of the first sidewall 46 of the refrigerator 10, as welded thereto.

With reference to the side-mounting bracket systems 82-82E discussed above, it is contemplated that any number of apertures, mounting apertures, cutouts, slots, hook members, tabs and the like may be used to mount a trim member to a mounting bracket for use with the present concept.

Figure 34A:
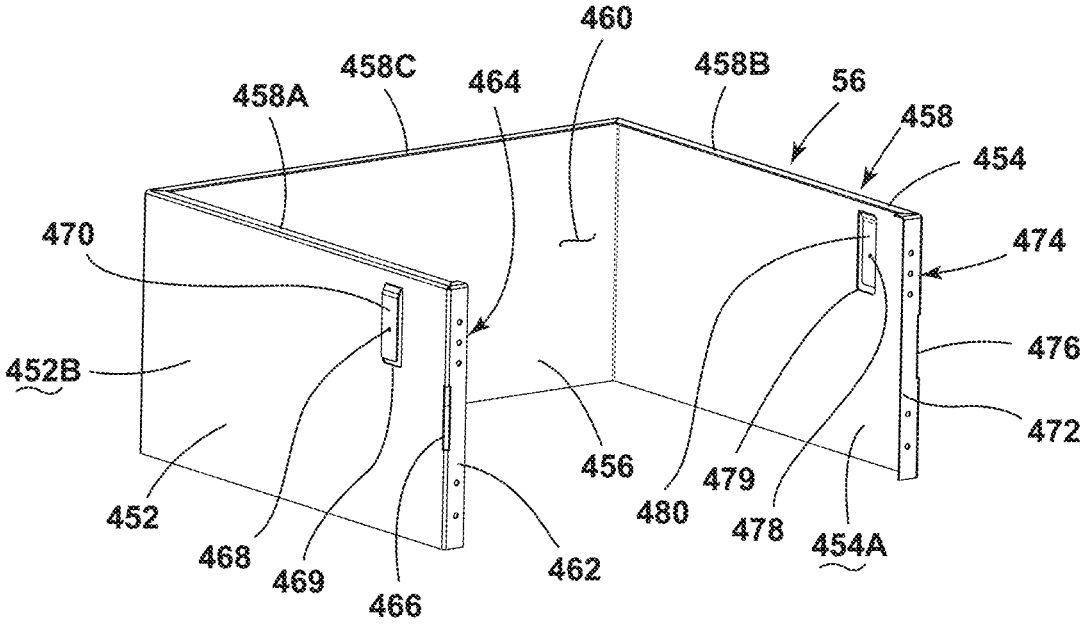
FIG. 34A is a front top perspective view of a machine room cover.
Figure 34B:
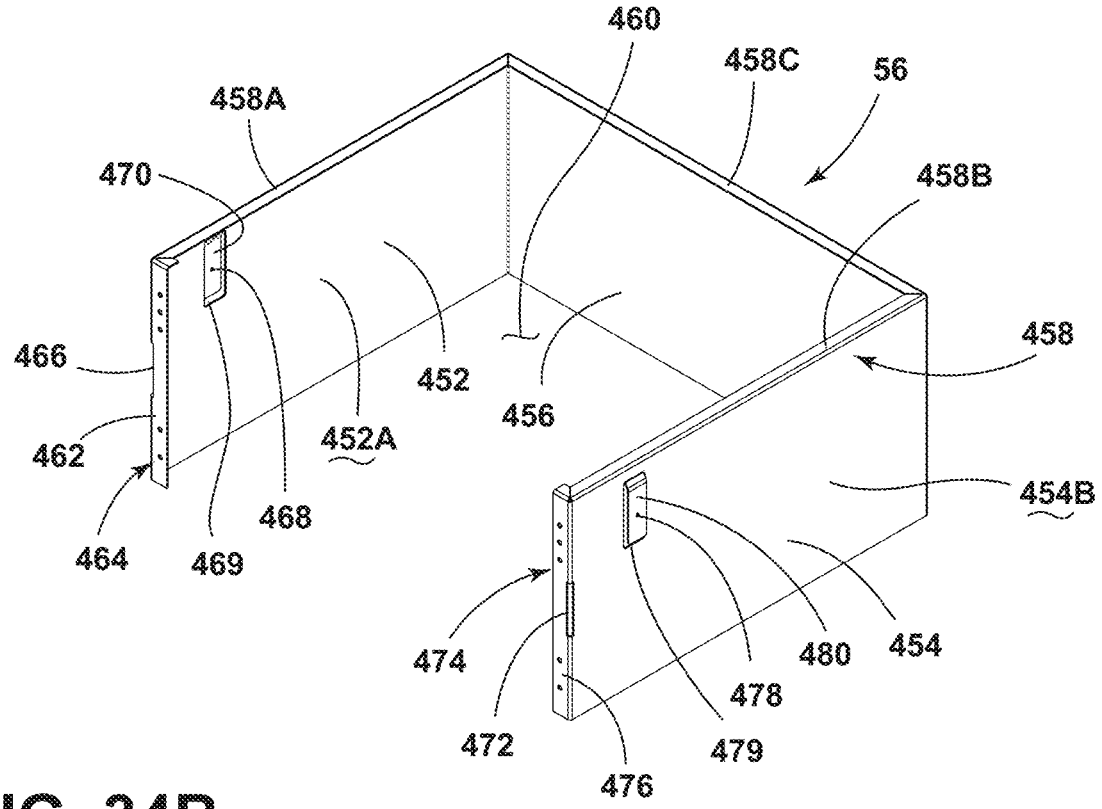
FIG. 34B is a front top perspective view of the machine room cover of FIG. 34A from another perspective.

Referring now to FIGS. 34A and 34B, the machine room cover 56 is shown having a body portion 450 comprised of first and second sidewalls 452, 454 with a rear wall 456 interconnecting the first and second sidewalls 452, 454 to form a generally U-shaped configuration surrounding a cavity 460. In assembly, the component parts of the refrigeration system 58 are contemplated to be housed within the cavity 460 of the machine room cover 56. The first sidewall 452 includes inner and outer surfaces 452A, 452B. Similarly, the second sidewall 454 includes inner and outer surfaces 454A, 454B. An inwardly extending flange 458 includes first and second portions 458A, 458B extending along upper portions of the first and second sidewalls 452, 454, and a third portion 458C extending along an upper portion of the rear wall 456.

With specific reference to FIG. 34A, the first sidewall 452 includes an inwardly turned front flange 462 extending inwardly from the inner surface 452A of the first sidewall 452 into the cavity 460. A plurality of apertures 464 are disposed through the front flange 462 along with a slot 466 that is vertically disposed along the front flange 462. In the embodiment shown in FIG. 34A, the plurality of apertures 464 includes sets of apertures disposed above and below the slot 466. The first sidewall 452 further includes the mounting aperture 468 that is configured to align with an aperture of a trim member to couple the same thereto. As shown in FIGS. 3A, 3B, the lower mounting aperture 168 of the first mounting portion 126 of the trim member 92 aligns with mounting aperture 468 of the machine room cover 56 for mounting the lower end 158 of the trim member 92 to the machine room cover 56 using a fastener. In the embodiment shown in FIGS. 34A, 34B, the mounting aperture 468 is disposed on a tab 470 that downwardly extends over an aperture 469 and outwardly extends from the outer surface 452B of the first sidewall 452.

With specific reference to FIG. 34B, the second sidewall 454 includes an inwardly turned front flange 472 extending inwardly from the inner surface 454A of the second sidewall 454 into the cavity 460. A plurality of apertures 474 are disposed through the front flange 472 of the second sidewall 454, along with a slot 476 that is vertically disposed along the front flange 462 of the second sidewall 454. In the embodiment shown in FIG. 34B, the plurality of apertures 464 includes sets of apertures disposed above and below the slot 466. The second sidewall 454 further includes a mounting aperture 478 that is configured to align with an aperture of a trim member to couple the same thereto in manner as described above with reference to mounting aperture 468 of the first sidewall 452. Thus, it is contemplated that the second trim member 92A (FIG. 3B) also includes a lower mounting aperture for coupling a lower end of the second trim member 92A to the mounting aperture 478 of the second sidewall 454 of the machine room cover 56. In the embodiment shown in FIGS. 34A, 34B, the mounting aperture 478 is disposed on a tab 480 that downwardly extends over an aperture 479 and outwardly extends from the outer surface 454B of the second sidewall 454. In use, the plurality of apertures 464 of the front flange 462 of the first sidewall 452 and the plurality of apertures 464 of the front flange 462 of the second sidewall 454 are provided to secure lower braces to the machine room cover 56, as further described below.

Figure 35:
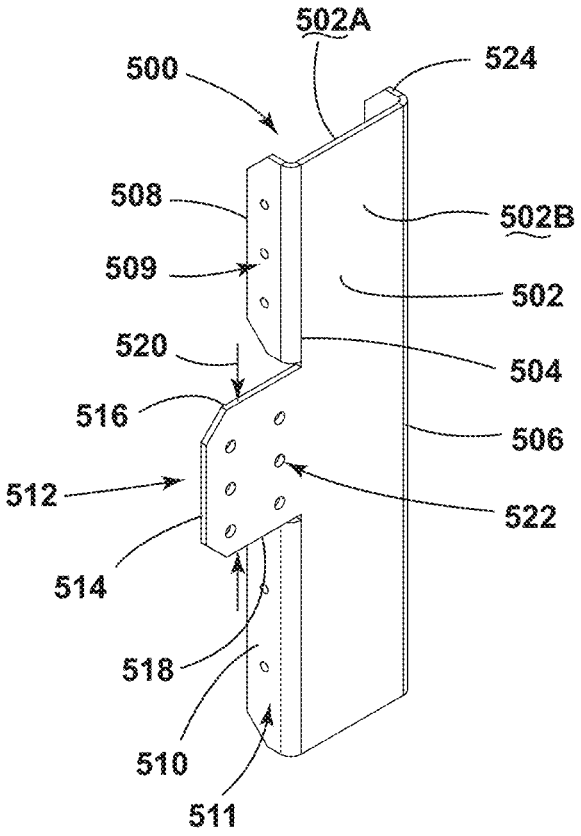
FIG. 35 is a front top perspective view of a brace member.
Figure 36:
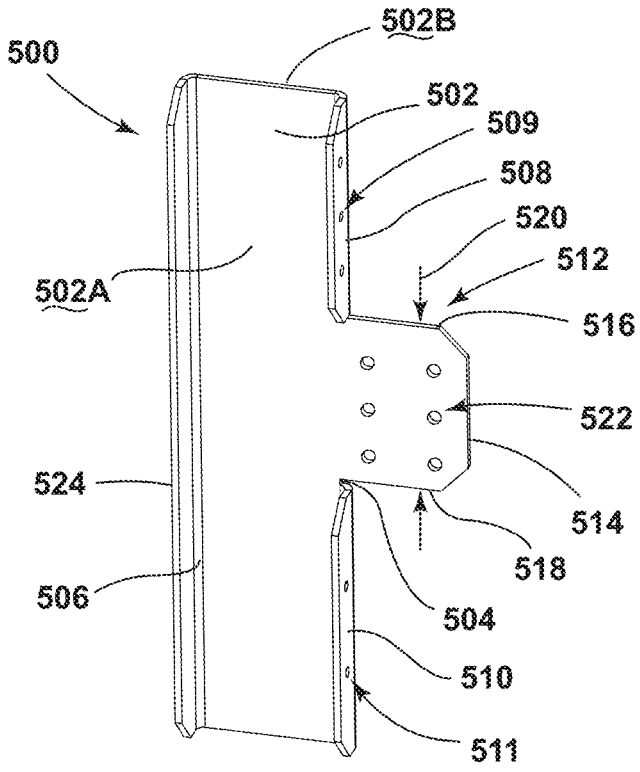
FIG. 36 is a rear top perspective view of the brace member of FIG. 35.

Referring now to FIGS. 35 and 36, a brace member 500 is shown, and is contemplated to be a lower brace member for securing the machine room cover 56 to the cabinet structure 60. The brace member 500 includes a body portion 502 having inner and outer surfaces 502A, 502B. The brace member 500 further includes upper and lower front flanges 508, 510 disposed on a front portion 504 of the body portion 502. The upper and lower front flanges 508, 510 are vertically spaced-apart from one another to define first and second flanges with an outwardly extending tab 512 disposed therebetween. The upper front flange 508 extends inwardly from the inner surface 502A of the body portion 502, and includes a plurality of apertures 509 disposed therethrough. In the embodiment shown in FIGS. 35 and 36, the plurality of apertures 509 disposed through the upper front flange 508 includes three spaced-apart apertures. The lower front flange 510 extends inwardly from the inner surface 502A of the body portion 502, and includes a plurality of apertures 511 disposed therethrough. In the embodiment shown in FIGS. 35 and 36, the plurality of apertures 511 disposed through the lower front flange 510 includes two spaced-apart apertures. The outwardly extending tab 512 is an extension of the body portion 502 of the brace member 500 and includes the inner and outer surfaces 502A, 502B discussed above. The outwardly extending tab 512 further includes a front edge 514 and upper and lower edges 516, 518 that are spaced-apart from one another to define a width 520 of the outwardly extending tab 512. The outwardly extending tab 512 further includes a plurality of apertures 522 disposed therethrough. In the embodiment shown in FIGS. 35 and 36, the plurality of apertures 522 includes six apertures evenly spaced-apart along the outwardly extending tab 512. As further shown in FIGS. 35 and 36, the brace member 500 further includes a rear flange 524 which inwardly extends from the inner surface 502A of the body portion 502 at a rear portion 506 thereof, as best shown in FIG. 36.

Figure 37:
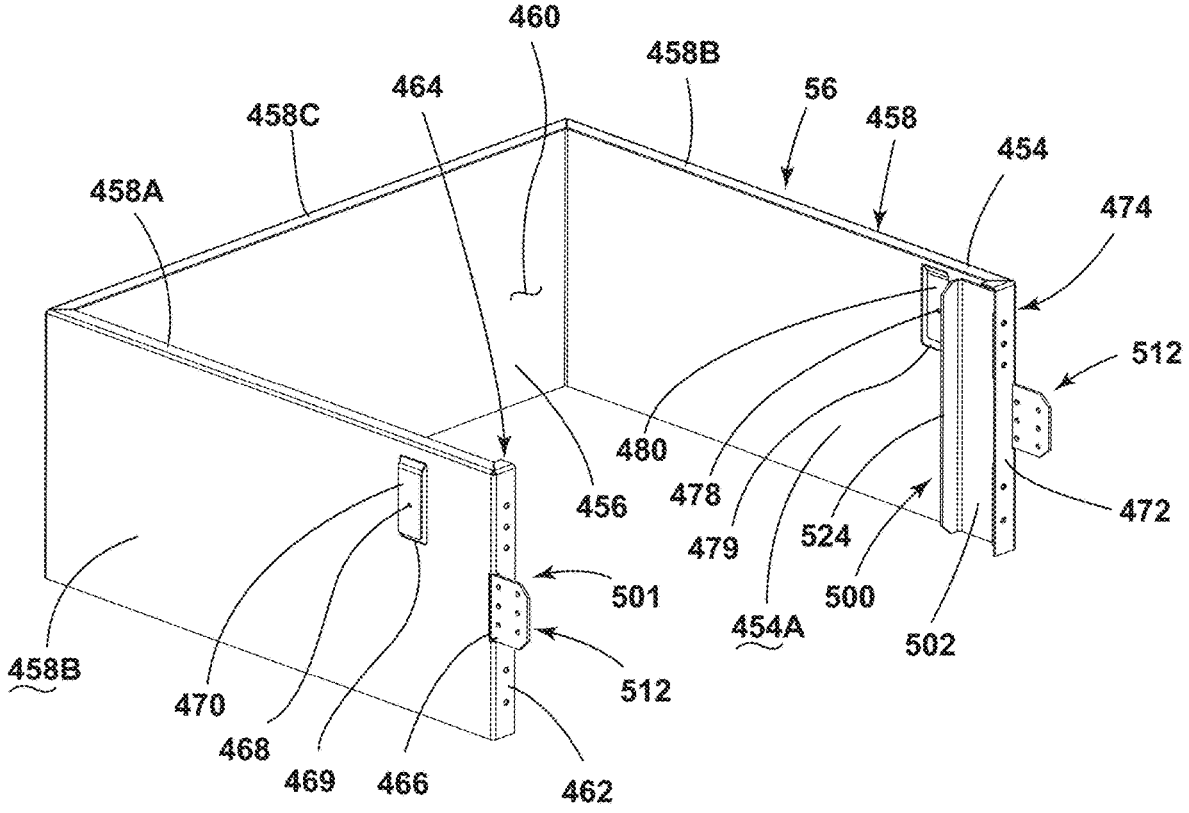
FIG. 37 is a front top perspective view of the machine room cover of FIG. 34A with brace members of FIG. 35 affixed thereto.

Referring now to FIG. 37, the machine room cover 56 is shown having the brace member 500 coupled to the second sidewall 454 thereof. As coupled thereto, the body portion 502 of the brace member 500 is positioned against the inner surface 454A of the second sidewall 454. The outwardly extending tab 512 of the brace member 500 is shown extending through the slot 476 disposed along the front flange 474 of the machine room cover 56. In this way, the plurality of apertures 522 of the outwardly extending tab 512 are accessible for mounting the brace member 500 to the cabinet structure 60 using fasteners. Specifically, the brace member 500 is contemplated to be mounted to the inner surface 69 of the second sidewall 68 of the cabinet structure 60. As further shown in FIG. 37, a second brace member 501 is shown coupled to the first sidewall 452 of the machine room cover 56. The second brace member 501 is contemplated to be a mirror image of the brace member 500 described above, and is configured to be mounted to the inner surface 67 of the first sidewall 66 of the cabinet structure 60. In this way the brace members 500, 501 secure the refrigerator 10 to the opposed first and second sidewalls 66, 68 of the cabinet structure 60 at the machine room cover 56 of the refrigerator 10 using fasteners, as shown with respect to brace member 500 in FIG. 3C.

Figure 38:
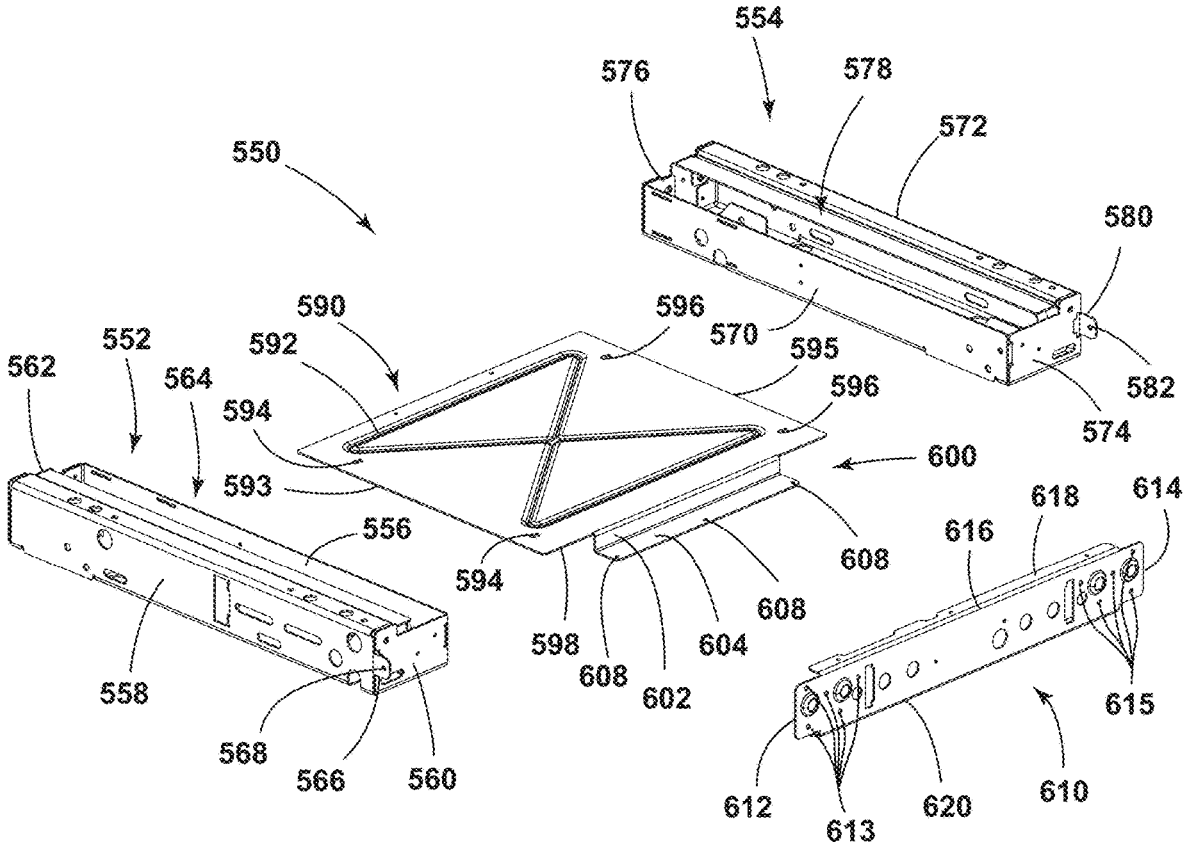
FIG. 38 is an exploded top perspective view of a roller box assembly.

Referring now to FIG. 38, a roller box assembly 550 is shown in an exploded view. The roller box assembly 550 is used to support the refrigerator 10 in a rolling capacity, as shown in FIG. 3C. As shown in FIG. 38, the roller box assembly 550 includes first and second housing assemblies 552, 554. The first housing assembly 552 includes an inner wall 556, an outer wall 558, a front wall 560 and rear wall 562 which cooperate together to define an interior cavity 564. In use, the interior cavity 564 is contemplated to house one or more wheel assemblies, such that a refrigerator supported on the roller box assembly 550 can be wheeled to a destination, such as the cabinet enclosure 80 of the cabinet structure 60 described above. The outer wall 558 of the first housing assembly 552 includes a forward extending tab 566 having an aperture 568 disposed therethrough. As shown in FIG. 38, the forward extending tab 566 extends forward of the front wall 560, such that the forward extending tab 566, and the aperture 568 thereof, are accessible for mounting to a sidewall of the cabinet structure 60. Similarly, the second housing assembly 554 includes an inner wall 570, an outer wall 572, a front wall 574 and rear wall 576 which cooperate together to define an interior cavity 578. In use, the interior cavity 578, much like interior cavity 564 of the first housing assembly 552, is contemplated to house one or more wheel assemblies to further support a refrigerator in a rolling manner. The outer wall 558 of the second housing assembly 554 includes a forward extending tab 580 having an aperture 582 disposed therethrough. The forward extending tab 580 extends forward of the front wall 574, such that the forward extending tab 580, and the aperture 582 thereof, are accessible for mounting to a sidewall of the cabinet structure 60, using a fastener. In this way, the roller box assembly 550 is configured to couple to the opposing first and second sidewalls 66, 68 of the cabinet structure 60 at the respective inner surfaces 67, 69 thereof, as shown in FIGS. 1 and 2. Specifically, the outer walls 558 and 572 of the first and second housing assemblies 552, 554 are disposed adjacent to the inner surfaces 67, 69 of the first and second sidewalls 66, 68 of the cabinet structure 60, when the refrigerator 10 is positioned therein. In this way, a fastener can be used at the respective apertures 568, 582 of the first and second housing assemblies 552, 554 for securely mounting the same to the cabinet structure 60. As mounted thereto, the roller box assembly 550 restricts fore and aft movement of a refrigerator assembly housed within the cabinet structure 60.

Figure 39:
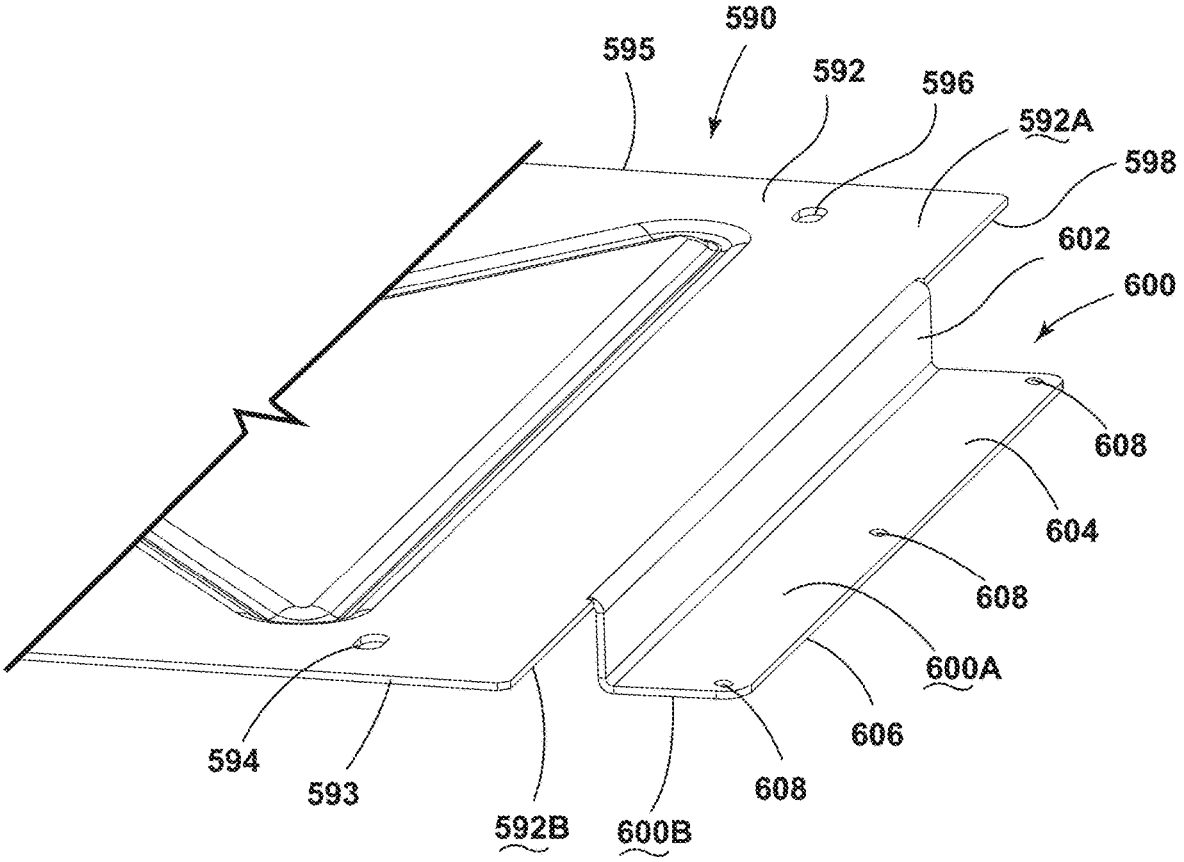
FIG. 39 is a fragmentary top perspective view of a bottom plate of the roller box assembly of FIG. 38.

As further shown in FIG. 38, and the reference to FIG. 39, the roller box assembly 550 includes a bottom plate 590 having a body portion 592 that is used to interconnect the first and second housing assemblies 552, 554. The body portion 592 of the bottom plate 590 includes upper and lower surfaces 592A, 592B. The bottom plate 590 further includes opposed first and second side edges 593, 595 having respective apertures 594, 596 disposed therethrough for mounting to the first and second housing assemblies 552, 554 to the upper surface 592A of the bottom plate 590. The bottom plate 590 further includes a front edge 598 with an anchor bracket 600 disposed thereon. The anchor bracket 600 includes first and second portions 602, 604. The first portion 602 of the anchor bracket 600 downwardly extends from the lower surface 592B, as best shown in FIG. 39. The second portion 604 of the anchor bracket 600 outwardly extends in a forward direction from the first portion 602, as best shown in FIG. 39. In this way, the second portion 604 of the anchor bracket 600 is substantially parallel with the body portion 592 of the bottom plate 590 as extending outward in an orthogonal direction relative to the first portion 602 of the anchor bracket 600. Disposed along a front edge 606 of the second portion 604 of the anchor bracket 600 mounting apertures 608 are positioned therealong and are configured to mount the bottom plate 590 to the inner surface 65 of the bottom wall 64 of the cabinet structure 60 in assembly. Specifically, an outer surface 600B of the anchor bracket 600 of the bottom plate 590 is configured to abut the inner surface 65 (FIG. 1) of the bottom wall 64 of the cabinet structure 60 in assembly.

As further shown in FIG. 38, the roller box assembly 550 includes a front bracket 610 having opposed side edges 612, 614 having respective apertures 613, 615 for mounting the front bracket 610 to the front walls 560, 574 of the first and second housing assemblies 552, 554. In this way, the front bracket 610 also serves to interconnect the first and second housing assemblies 552, 554 of the roller box assembly 550. The front bracket 610 further includes an upper edge 616 with the rearwardly extending flange 618 which is contemplated to couple to a top wall of the roller box assembly 550 in assembly.

Figure 40:
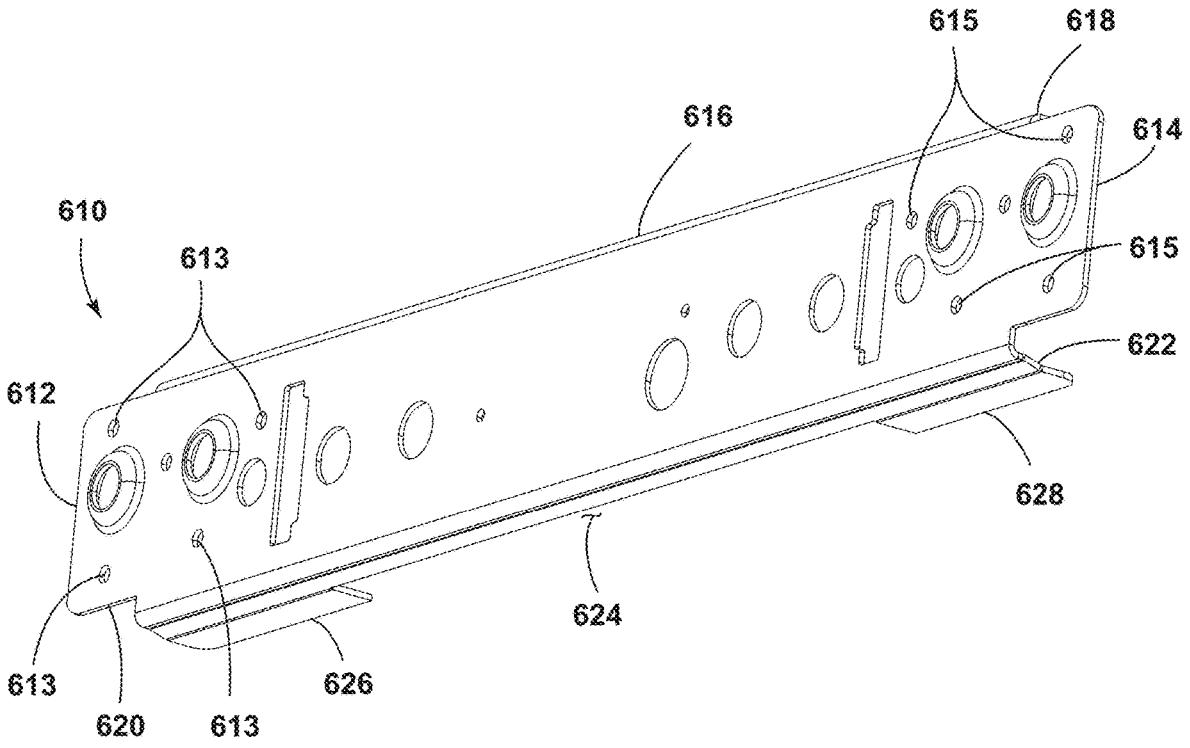
FIG. 40 is a bottom perspective view of a front bracket of the roller box assembly of FIG. 38.
Figure 41:
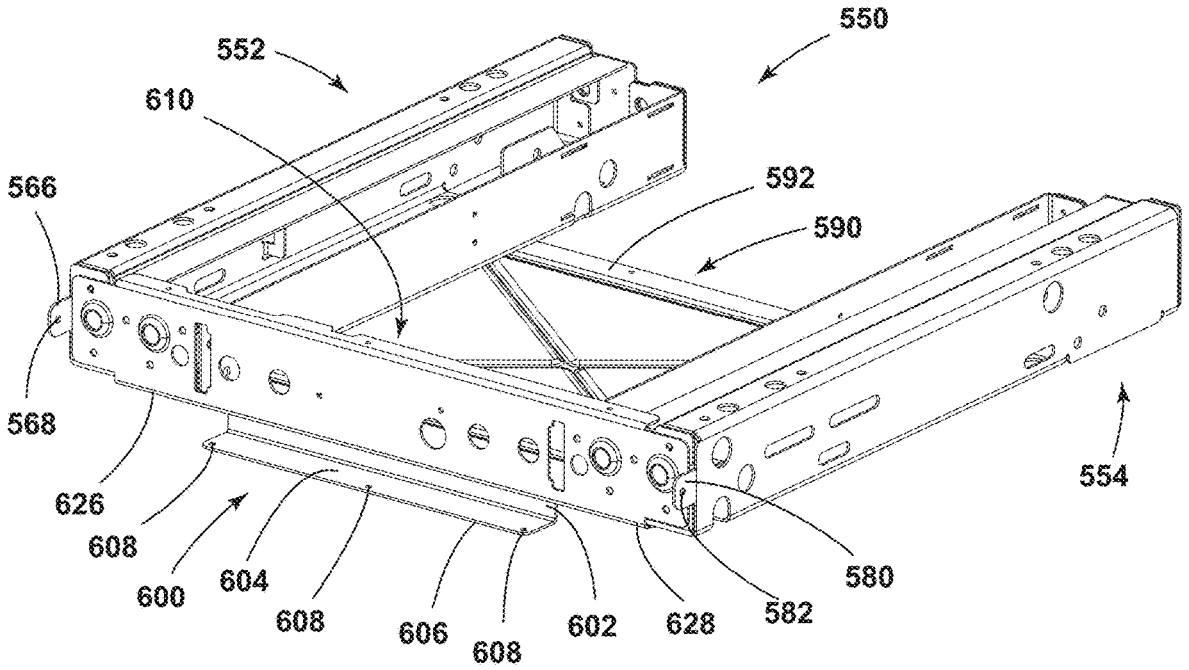
FIG. 41 is a top perspective view of the roller box assembly of FIG. 38 in an assembled condition.
Figure 42:
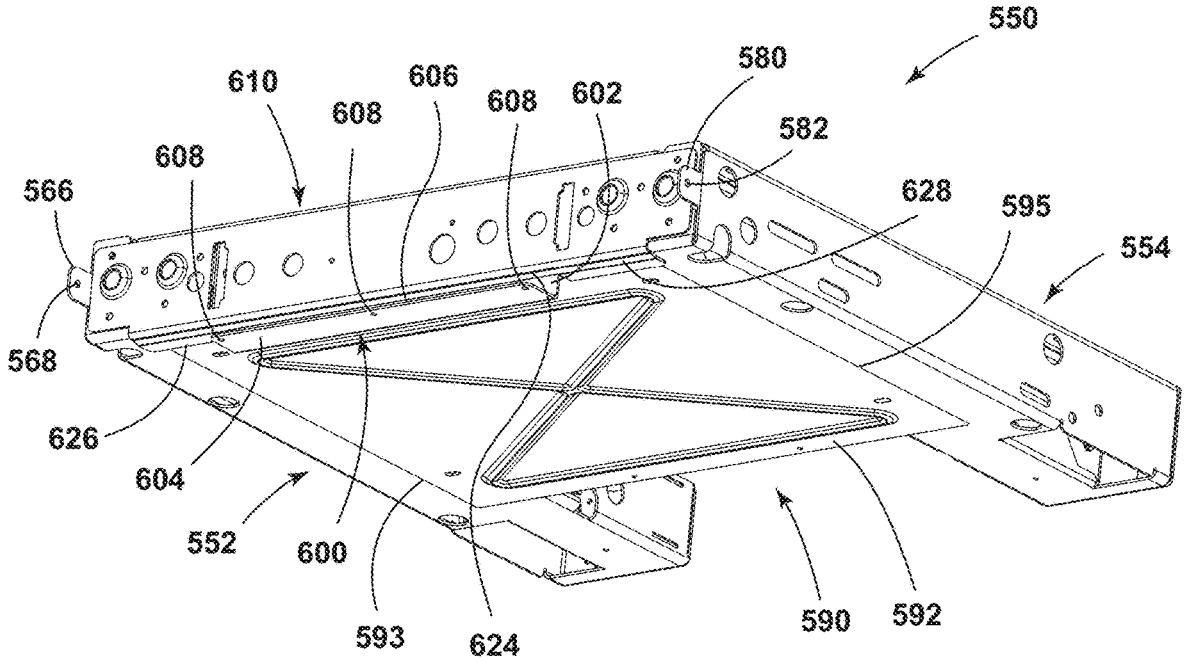
FIG. 42 is a top perspective view of the roller box assembly of FIG. 41.

Referring now to FIG. 40, the front bracket 610 is shown having a rearwardly extending flange 622 that extends rearwardly from the bottom edge 620 of the front bracket 610. The rearwardly extending flange 622 includes a relief portion 624 disposed in a middle portion thereof to define first and second tabs 626, 628 disposed on either sides of the relief portion 624. The relief portion 624 is a cutout portion of the rearwardly extending flange 622 which is configured to receive the second portion 604 of the anchor bracket 600 of the bottom plate 590 therethrough. This configuration is best shown in FIGS. 41 and 42. In FIGS. 41 and 42, the roller box assembly 550 is shown in an assembled condition with the first and second housing assemblies 552, 554 disposed on the opposite side edges 593, 595 of the bottom plate 590. Further, the anchor bracket 600 of the bottom plate 590 is shown having the second portion 604 thereof extending outwardly through the relief portion 624 of the front bracket 610, such that the second portion 604 of the anchor bracket 600 of the bottom plate 590 is accessible for mounting to the cabinet structure 60 at the bottom wall 64 thereof.

Figure 43:
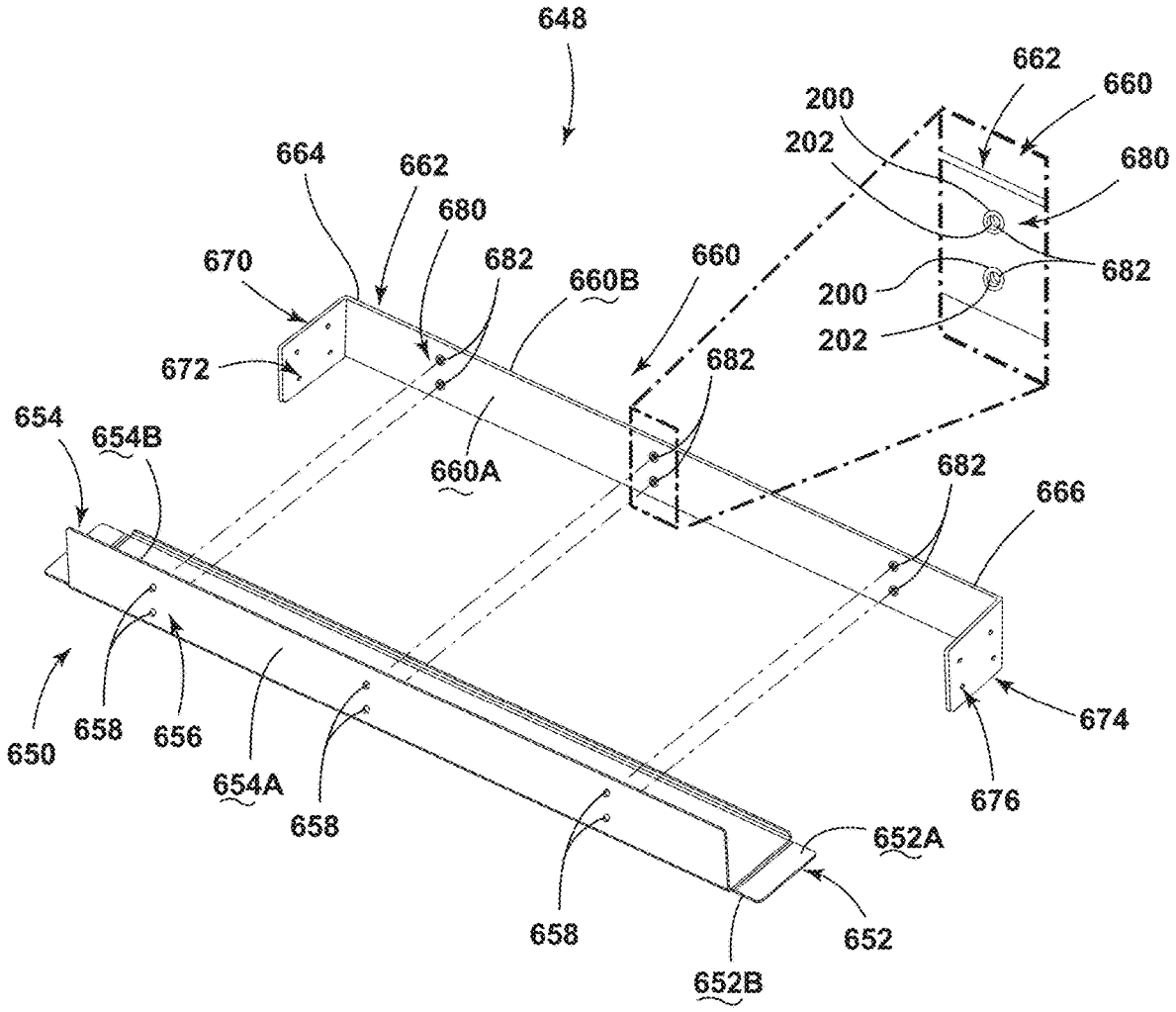
FIG. 43 is an exploded top perspective view of an upper bracket system.
Figure 44:
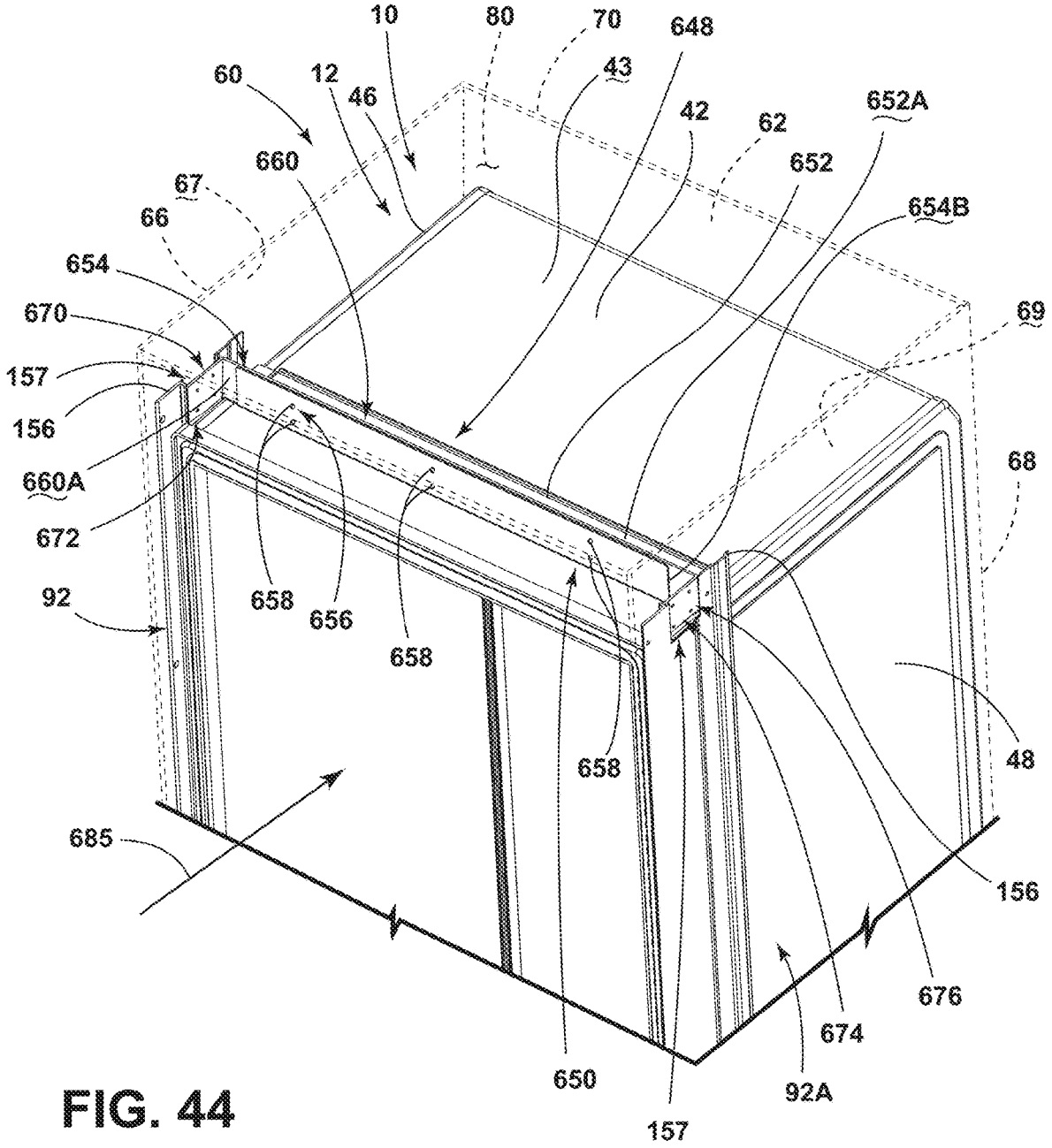
FIG. 44 is a fragmentary top perspective view of the upper bracket system of FIG. 43 in an assembled condition and supported on a refrigerator received in a cabinet structure, with the cabinet structure shown in phantom.

Referring now to FIG. 43, an upper bracket system 648 is shown with a hinge bracket 650 having a first portion 652 and a second portion 654. The first portion 652 of the hinge bracket 650 is a substantially horizontal portion that includes upper and lower surfaces 652A, 652B. The second portion 654 of the hinge bracket 650 is a substantially upright portion that extends orthogonally in an upright direction from the upper surface 652A of the first portion 652 of the hinge bracket 650. The second portion 654 of the hinge bracket 650 includes front and rear surfaces 654A, 654B. The hinge bracket 650 includes an overall L-shaped configuration between the first and second portions 652, 654, and is contemplated to be comprised of a metal material suitable for welding the first portion 652 of the hinge bracket 650 to the outer surface 43 of the top wall 42 of the vacuum insulated cabinet structure 12 of the refrigerator 10, as best shown in FIG. 44. As shown in FIG. 44, the upper bracket system 648 is mounted between the refrigerator 10 and the cabinet structure 60. The lower surface 652B of the first portion 652 of the hinge bracket 650 abuts the outer surface 43 of the top wall 42 of the refrigerator 10 in assembly, and may be fixedly coupled thereto, as further described below. The hinge bracket 650 may be used to mount one or more hinges thereto for use in operating doors positioned on the refrigerator 10 to selectively provide access to refrigerated storage compartments. In the embodiment shown in FIG. 43, the hinge bracket 650 includes a plurality of apertures 656 disposed along the second portion 654 of the hinge bracket 650. The plurality of apertures 656 shown in the embodiment of the hinge bracket 650 in FIG. 43 includes three sets of apertures 658 for a total of six apertures, altogether.

As further shown in FIG. 43, the upper bracket system 648 includes a mounting bracket 660 having a body portion 662 with opposed first and second ends 664, 666. The body portion 662 of the mounting bracket 660 is positioned in a generally upright manner and includes front and rear surfaces 660A, 660B. The first end 664 of the mounting bracket 660 includes a first side bracket 670 extending orthogonally in a forward direction from the front surface 660A of the mounting bracket 660. The first side bracket 670 includes a plurality of apertures 672 which, in the embodiment of FIG. 43 includes four spaced-apart apertures. The second end 666 of the mounting bracket 660 also includes a second side bracket 674 extending orthogonally in a forward direction from the front surface 660A of the mounting bracket 660. The second side bracket 674 also includes a plurality of apertures 676 which, in the embodiment of FIG. 43 includes four spaced-apart apertures. The apertures provided in the plurality of apertures 672, 676 of the first and second side brackets 670, 674 are used to couple the mounting bracket 660 to the opposed first and second sidewalls 66, 68 of the cabinet structure 60 at the respective inner surfaces 67, 69 thereof, as best shown in FIG. 44. In the embodiment shown in FIG. 43, the mounting bracket 660 includes a plurality of mounting apertures 680 disposed along the body portion 662 of the mounting bracket 660. The plurality of mounting apertures 680 shown in the embodiment of the mounting bracket 660 in FIG. 43 includes three sets of mounting apertures 682 for a total of six apertures, altogether. The plurality of mounting apertures 680 of the mounting bracket 660 are provided in a reciprocal pattern relative to the plurality of apertures 656 of the hinge bracket 650. In this way, the plurality of mounting apertures 680 of the mounting bracket 660 can be aligned with the plurality of apertures 656 of the hinge bracket 650 for interconnecting the mounting bracket 660 and the hinge bracket 650. Specifically, the apertures 658 of the plurality of apertures 656 of the hinge bracket 650 are contemplated to be through apertures that will allow for a threaded shaft of a fastener to pass through. As shown in FIG. 43, the mounting apertures 682 of the plurality of mounting apertures 680 are contemplated to receive a threaded insert 200 having a threaded inner cavity 202, in a similar manner as described above. Thus, a suitable fastener can be used to couple to the threaded insert 200 in a threaded engagement to fixedly couple the component parts together. As described herein, apertures identified with reference numeral 682, and pluralities of the same identified with reference numeral 680, are contemplated to be mounting apertures fitted with a threaded insert, in a manner as described above with reference to threaded insert 200. Similarly, as described herein, apertures identified with reference numeral 658, and pluralities of the same identified with reference numeral 656, are contemplated to be through apertures, allowing for fastener shafts to pass therethrough, in a manner as described above.

Referring now to FIG. 44, the cabinet structure 60 is shown in phantom to reveal the mounting bracket 660 mounted to the inner surfaces 67, 69 of the opposed first and second sidewalls 66, 68. As shown in FIG. 44, the mounting bracket 660 is mounted to the inner surfaces 67, 69 of the opposed first and second sidewalls 66, 68 of the cabinet structure 60 at the first and second side brackets 670, 674 of the mounting bracket 660. As further illustrated in FIG. 44, the trim members 92, 92A are shown mounted to the opposed first and second sidewalls 46, 48 of the refrigerator 10. The trim members 92, 92A each include upper ends 156 having cutout portions 157. As shown in FIG. 44, the first and second side brackets 670, 674 of the mounting bracket 660 are aligned with the cutout portions 157 of the trim members 92, 92A, such that the respective apertures provided in the plurality of apertures 672, 676 of the first and second side brackets 670, 674 can be used to couple the mounting bracket 660 to the inner surfaces 67, 69 of the opposed first and second sidewalls 66, 68 of the cabinet structure 60.

As further illustrated in FIG. 44, the first portion 652 of the hinge bracket 650 is shown abutting the outer surface 43 of the top wall 42 of the refrigerator 10. The rear surface 654B of the second portion 654 of the hinge bracket 650 is shown as abutting the front surface 660A of the mounting bracket 660 in the arrangement of FIG. 44. In this configuration, the plurality of mounting apertures 680 of the mounting bracket 660 (FIG. 43) are aligned with the plurality of apertures 656 of the hinge bracket 650 (FIG. 44) for interconnecting the mounting bracket 660 and the hinge bracket 650 using fasteners. It is contemplated that the mounting bracket 660 is mounted to the opposed first and second sidewalls 66, 68 of the cabinet structure 60, before the refrigerator 10 is inserted into the cabinet enclosure 80 of the cabinet structure 60. Similarly, the hinge bracket 650 may be welded, or otherwise fixedly coupled, to the top wall 42 of the refrigerator 10, before the refrigerator 10 is inserted into the cabinet enclosure 80 of the cabinet structure 60. Further, it is contemplated that the hinge bracket 650 may be positioned on the outer surface 43 of the top wall 42 of the refrigerator 10, such that the lower surface 652B of the first portion 652 of the hinge bracket 650 abuts the outer surface 43 of the top wall 42 of the refrigerator 10, without the need to fixedly couple the hinge bracket 650 thereto. With the hinge bracket 650 and the mounting bracket 660 set in their respective positions, the refrigerator 10 can be inserted into the cabinet enclosure 80 of the cabinet structure 60 in the direction as indicated by arrow 685 in FIG. 44 until the rear surface 654B of the hinge bracket 650 abuts the front surface 660A of the mounting bracket 660. When this abutting arrangement is provided between the rear surface 654B of the hinge bracket 650 and the front surface 660A of the mounting bracket 660, the plurality of mounting apertures 680 of the mounting bracket 660 are contemplated to be aligned with the plurality of apertures 656 of the hinge bracket 650 for threaded engagement with the threaded inserts provided in the mounting apertures 680 of the plurality of mounting apertures 682 of the mounting bracket 660. Thus, fasteners can be used to fixedly couple the hinge bracket 650 to the mounting bracket 660 while the hinge bracket 650 is supported on the refrigerator 10, and the mounting bracket 660 is fixedly coupled to the cabinet structure 60.

Figure 45:
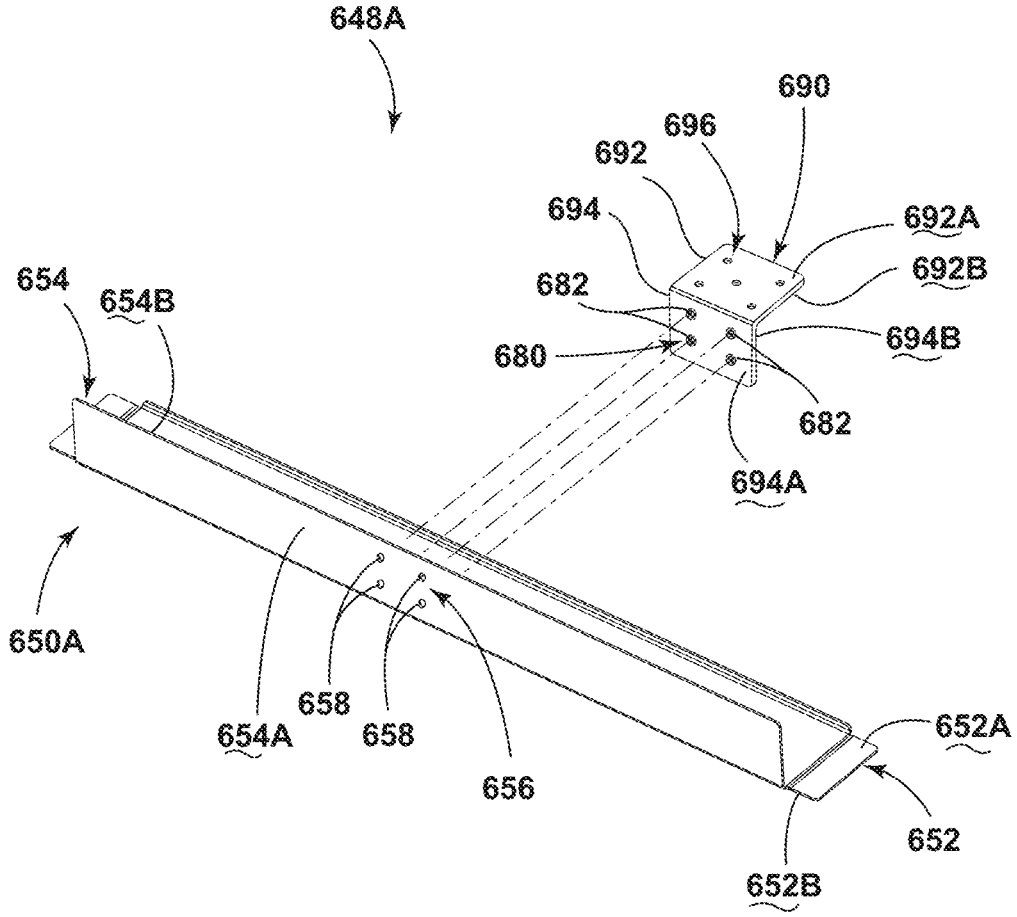
FIG. 45 is an exploded top perspective view of an upper bracket system.

Referring now to FIG. 45, an upper bracket system 648A is shown with a hinge bracket 650A which includes a number of features in common with the hinge bracket 650 described above. As such, like reference numerals are used in FIG. 45 to identify common features shared between the hinge brackets 650 and 650A. In the embodiment shown in FIG. 45, the plurality of apertures 656 are disposed on the second portion 694 of the hinge bracket 650A and are clustered in a middle portion thereof. The plurality of apertures 656 shown in the embodiment of the hinge bracket 650A in FIG. 45 includes two sets of spaced-apart apertures 658 for a total of four apertures, altogether.

As further shown in FIG. 45, the upper bracket system 648A includes a mounting bracket 690, wherein the mounting bracket 690 includes first and second portions 692, 694. The first portion 692 of the mounting bracket 690 is a substantially horizontal portion that includes upper and lower surfaces 692A, 692B. The second portion 694 of the mounting bracket 690 is a substantially vertical portion that extends orthogonally in a downward direction from the lower surface 692B of the first portion 692 of the mounting bracket 690. The second portion 694 of the mounting bracket 690 includes front and rear surfaces 694A, 694B. The mounting bracket 690 includes an overall L-shaped configuration between the first and second portions 692, 694 thereof, and is contemplated to be comprised of a metal material.

Figure 46:
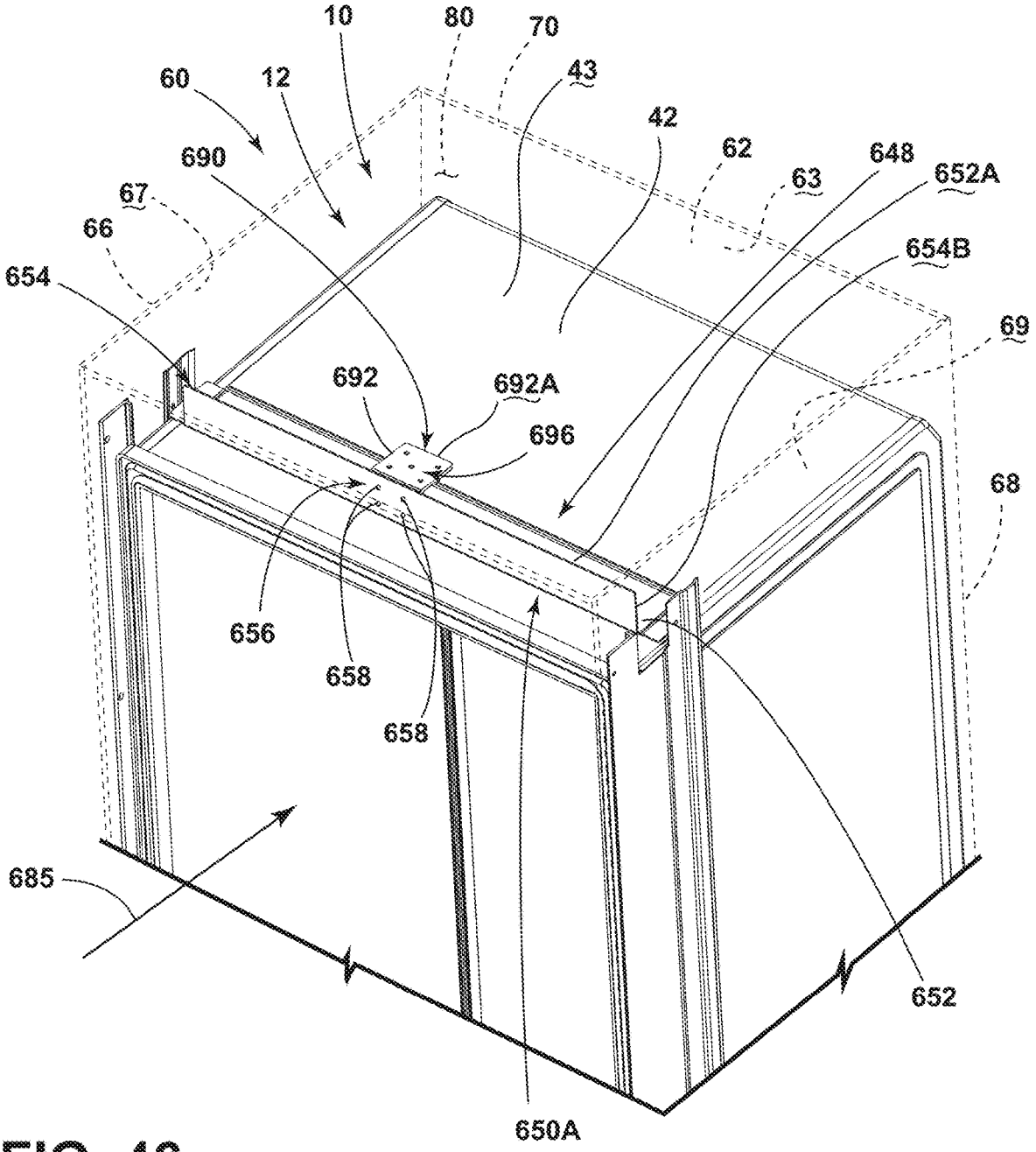
FIG. 46 is a fragmentary top perspective view of the upper bracket system of FIG. 45 in an assembled condition and supported on a refrigerator that is received within a cabinet structure, with the cabinet structure shown in phantom.

As further shown in FIG. 45, the first portion 692 of the mounting bracket 690 includes a plurality of apertures 696 which, in the embodiment of FIG. 45 includes five spaced-apart apertures. The apertures provided in the plurality of apertures 696 of the first portion 692 of the mounting bracket 690 are used to couple the mounting bracket 690 to the top wall 62 of the cabinet structure 60 at the inner surface 63 thereof, as best shown in FIG. 46. In the embodiment shown in FIG. 45, the mounting bracket 690 includes a plurality of mounting apertures 680 disposed along the second portion 694 of the mounting bracket 690. The plurality of mounting apertures 680 shown in the embodiment of the mounting bracket 690 in FIG. 45 includes two sets of mounting apertures 682 for a total of four apertures, altogether. The plurality of mounting apertures 680 of the mounting bracket 690 are provided in a reciprocal pattern relative to the plurality of apertures 656 of the hinge bracket 650A. In this way, the plurality of mounting apertures 680 of the mounting bracket 690 can be aligned with the plurality of apertures 656 of the hinge bracket 650A for interconnecting the mounting bracket 690 and the hinge bracket 650A in assembly.

Referring now to FIG. 46, the cabinet structure 60 is shown in phantom to reveal the upper bracket system 648A mounted between the refrigerator 10 and the cabinet structure 60. As shown, the mounting bracket 690 is mounted to the inner surface 63 of the top wall 62 of the cabinet structure 60. As shown in FIG. 46, the mounting bracket 690 is mounted to the inner surface 63 of the top wall 62 of the cabinet structure 60 at the first portion 692 of the mounting bracket 690. Specifically, the upper surface 692A of the first portion 692 of the mounting bracket 690 is configured to abut the inner surface 63 of the top wall 62 of the cabinet structure 60, such that the plurality of apertures 696 can be used to fasten the mounting bracket 690 thereto. As further illustrated in FIG. 46, the hinge bracket 650A is shown positioned on the outer surface 43 of the top wall 42 of the refrigerator 10 at the first portion 652 thereof. The rear surface 654B of the hinge bracket 650A is contemplated to be abutting the front surface 694A (FIG. 45) of the mounting bracket 690 in the arrangement of FIG. 46. In this configuration, the plurality of mounting apertures 680 (FIG. 45) of the mounting bracket 690 are aligned with the plurality of apertures 656 of the hinge bracket 650A for interconnecting the mounting bracket 690 and the hinge bracket 650A using fasteners. It is contemplated that the mounting bracket 690 is mounted to the top wall 62 of the cabinet structure 60, before the refrigerator 10 is inserted into the cabinet enclosure 80 of the cabinet structure 60. Similarly, the hinge bracket 650A may be welded, or otherwise fixedly coupled, to the top wall 42 of the refrigerator 10, before the refrigerator 10 is inserted into the cabinet enclosure 80 of the cabinet structure 60. Further, it is contemplated that the hinge bracket 650A may be positioned on the outer surface 43 of the top wall 42 of the refrigerator 10, such that the lower surface 652B of the first portion 652 of the hinge bracket 650A abuts the outer surface 43 of the top wall 42 of the refrigerator 10, without the need to fixedly couple the hinge bracket 650A thereto.

With the hinge bracket 650A and the mounting bracket 690 set in their respective positions, the refrigerator 10 can be inserted into the cabinet enclosure 80 of the cabinet structure 60 in the direction as indicated by arrow 685 in FIG. 46 until the rear surface 654B of the hinge bracket 650A abuts the front surface 694A of the mounting bracket 690. When this abutting arrangement is provided between the rear surface 654B of the hinge bracket 650A and the front surface 694A of the mounting bracket 690, the plurality of mounting apertures 680 of the mounting bracket 690 are aligned with the plurality of apertures 656 of the hinge bracket 650A for threaded engagement with the threaded inserts provided in the mounting apertures 680 of the plurality of mounting apertures 682 of the mounting bracket 690. Thus, fasteners can be used to fixedly couple the hinge bracket 650A to the mounting bracket 690 while the hinge bracket 650A is supported on the refrigerator 10, and the mounting bracket 690 is fixedly coupled to the cabinet structure 60.

Figure 47:
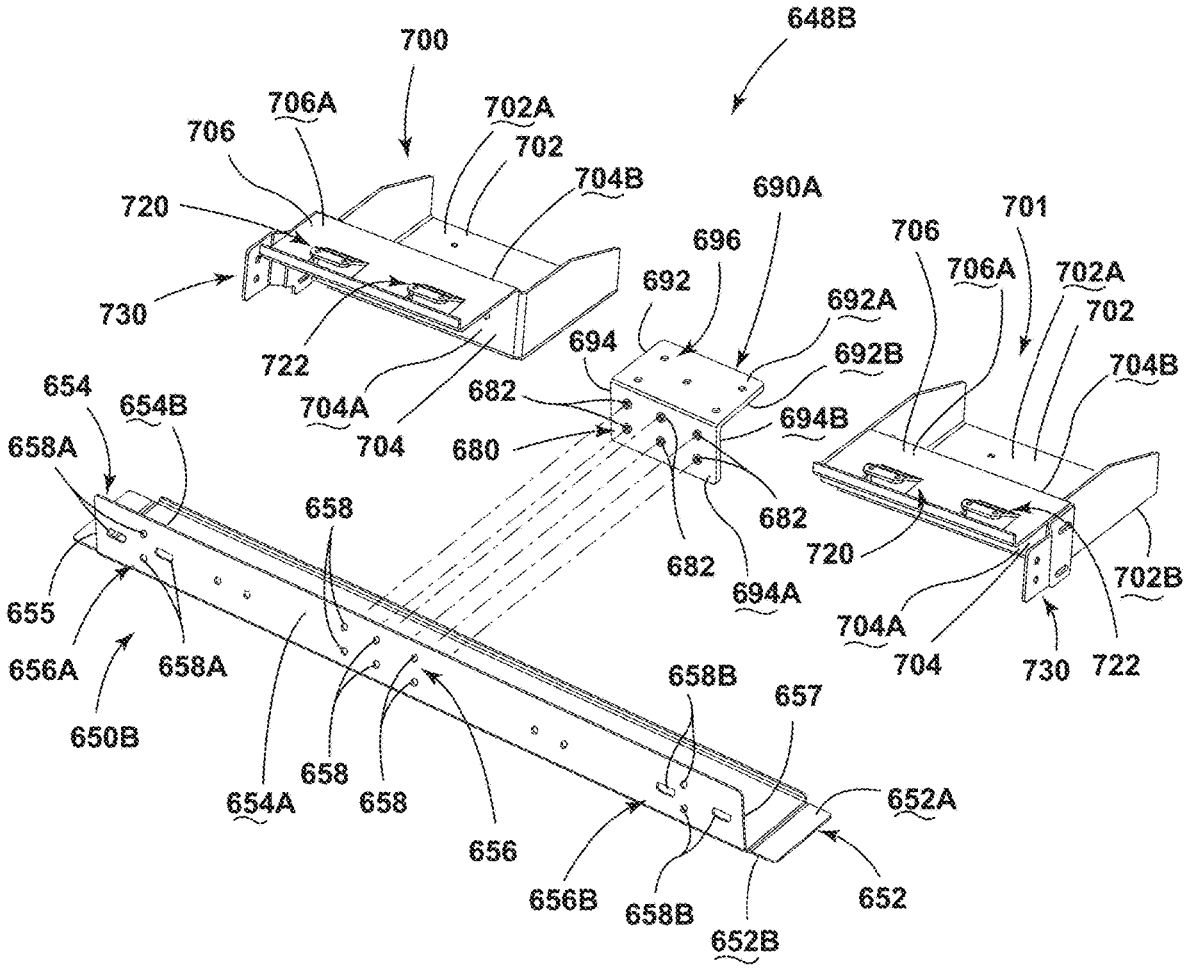
FIG. 47 is an exploded top perspective view of an upper bracket system.

Referring now to FIG. 47, an upper bracket system 648B is shown with a hinge bracket 650B having a number of features in common with hinge brackets 650 and 650A described above. As such, like reference numerals are used in FIG. 47 to denote common features shared between the hinge brackets 650, 650A and 6506. In the embodiment shown in FIG. 47, a plurality of apertures 656 are disposed on the second portion 694 of the hinge bracket 6506 and are clustered in a middle portion thereof. The plurality of apertures 656 shown in the embodiment of the hinge bracket 650B in FIG. 47 includes three sets of spaced-apart apertures 658 for a total of six apertures, altogether.

Figure 48:
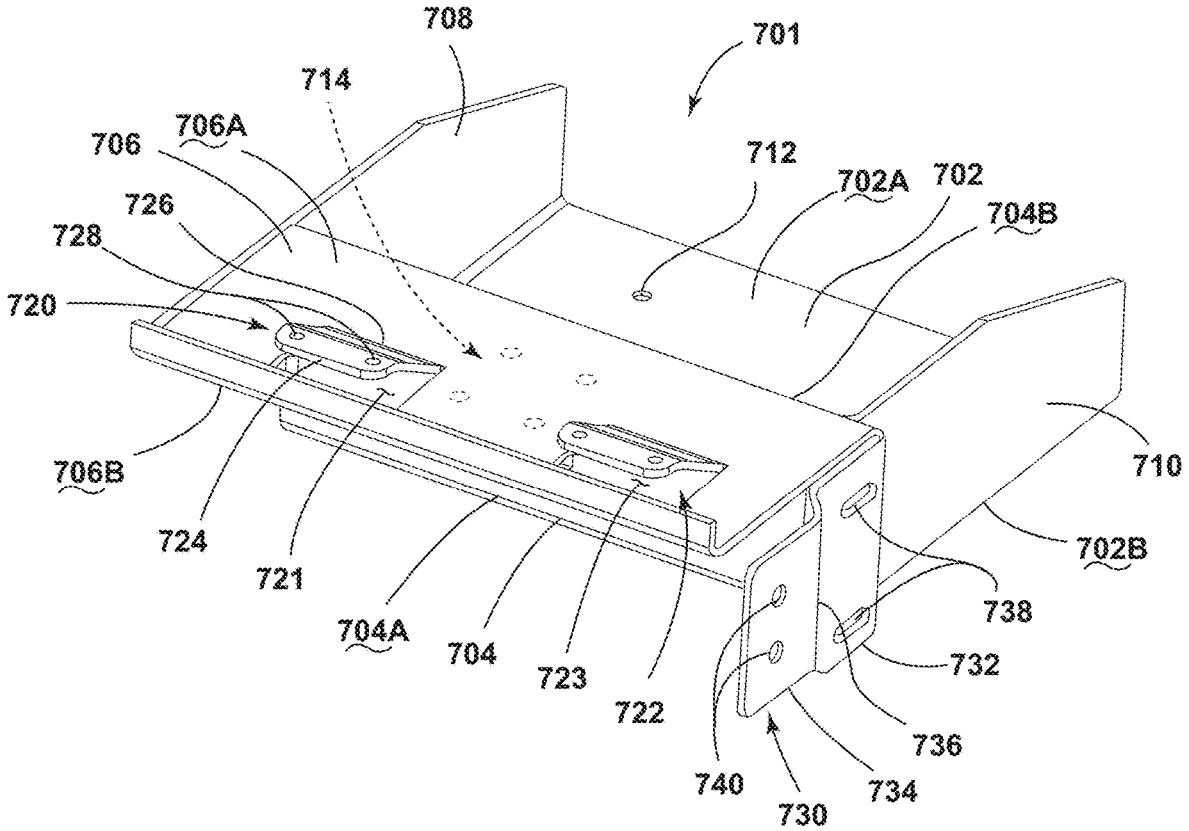
FIG. 48 is a top perspective view of a hinge support bracket of the upper bracket system of FIG. 47.

As further shown in FIG. 47, the upper bracket system 648B includes a mounting bracket 690A shown exploded away from the hinge bracket 650B, and having a number of features in common with mounting bracket 690 described above. As such, like reference numerals are used in FIG. 47 to denote common features shared between the mounting brackets 690 and 690A. The first portion 692 of the mounting bracket 690A includes a plurality of apertures 696 which, in the embodiment of FIG. 47 includes five spaced-apart apertures. The apertures provided in the plurality of apertures 696 of the first portion 692 of the mounting bracket 690A are used to couple the mounting bracket 690A to the top wall 62 of the cabinet structure 60 at the inner surface 63 thereof, as best shown in FIG. 48. In the embodiment shown in FIG. 47, the mounting bracket 690A further includes a plurality of mounting apertures 680 disposed along the second portion 694 of the mounting bracket 690A. The plurality of mounting apertures 680 shown in the embodiment of the mounting bracket 690A in FIG. 47 includes three sets of mounting apertures 682 for a total of six apertures, altogether. The plurality of mounting apertures 680 of the mounting bracket 690A are provided in a reciprocal pattern relative to the plurality of apertures 656 of the hinge bracket 6506. In this way, the plurality of mounting apertures 680 of the mounting bracket 690A can be aligned with the plurality of apertures 656 of the hinge bracket 6506 for interconnecting the mounting bracket 690A and the hinge bracket 6506 in assembly.

With further reference to FIG. 47, the hinge bracket 650B also includes a plurality of apertures 656A disposed on a first end 655 of the second portion 654 of the hinge bracket 650B. The plurality of apertures 656A includes a number of apertures 658A, which may be in the form of round apertures or oblong-shaped slots, or any combination thereof. The plurality of apertures 656A is used to mount a first hinge support bracket 700 to the hinge bracket 650A, as further described below. Similarly, the hinge bracket 650B further includes a plurality of apertures 656B disposed on a second end 657 of the second portion 654 of the hinge bracket 650B. The second end 657 of the second portion 654 of the hinge bracket 650B is contemplated to be an opposite or opposed end relative to the first end 655 of the second portion 654 of the hinge bracket 650B. As such, the plurality of apertures 656 disposed at the middle portion of the second portion 654 of the hinge bracket 650B is disposed between the plurality of apertures 656A, 656B which are disposed at the first and second ends 655, 657, respectively, of the second portion 654 of the hinge bracket 6506. The plurality of apertures 656B includes a number of apertures 658B, which may be in the form of round apertures or oblong-shaped slots, or any combination thereof. The plurality of apertures 656B is used to mount a second hinge support bracket 701 to the hinge bracket 650A, as further described below.

As further shown in FIG. 47, the first and second hinge support brackets 700, 701 are shown exploded away from the hinge bracket 6506. The first and second hinge support brackets 700, 701 are contemplated to be mirror images of each other, such that like reference numerals will be used to describe common features between the first and second hinge support brackets 700, 701. Further, the description of one hinge support bracket provided herein also describes the other reciprocal hinge support bracket. The first and second hinge support brackets 700, 701 each include a first portion 702 and a second portion 704. The first portion 702 of the first and second hinge support brackets 700, 701 is a substantially horizontal portion that includes upper and lower surfaces 702A, 702B. The second portion 704 of the first and second hinge support brackets 700, 701 is a substantially upright portion that extends orthogonally in an upright direction from the upper surface 702A of the first portion 702 of the first and second hinge support brackets 700, 701. The second portion 704 of the first and second hinge support brackets 700, 701 includes front and rear surfaces 704A, 704B. The first and second hinge support brackets 700, 701 each include a third portion 706 extending outwardly in a forward direction from the front surface 704A of the second portion 704 of the first and second hinge support brackets 700, 701. The third portion 706 includes an upper surface 706A and a lower surface 706B. As shown in FIG. 47, the third portion 706 extends outwardly from an upper portion of the second portion 704 of the first and second hinge support brackets 700, 701, while the first portion 702 extends rearwardly from a lower portion of the second portion 704 of the first and second hinge support brackets 700, 701. Thus, the first portion 702 is vertically offset from, but substantially parallel to, the third portion 706. The second portion 704 of the first and second hinge support bracket 700, 701 is substantially perpendicular to both the first portion 702 and the third portion 706. In this way, the first and second hinge support brackets 700, 701 each include an overall S-shaped configuration between the first, second and third portions 702, 704 and 706 thereof. The remaining features of the first and second hinge support brackets 700, 701 are further described with reference to FIG. 48 in which the second hinge support bracket 701 is shown in greater detail.

Figure 49:
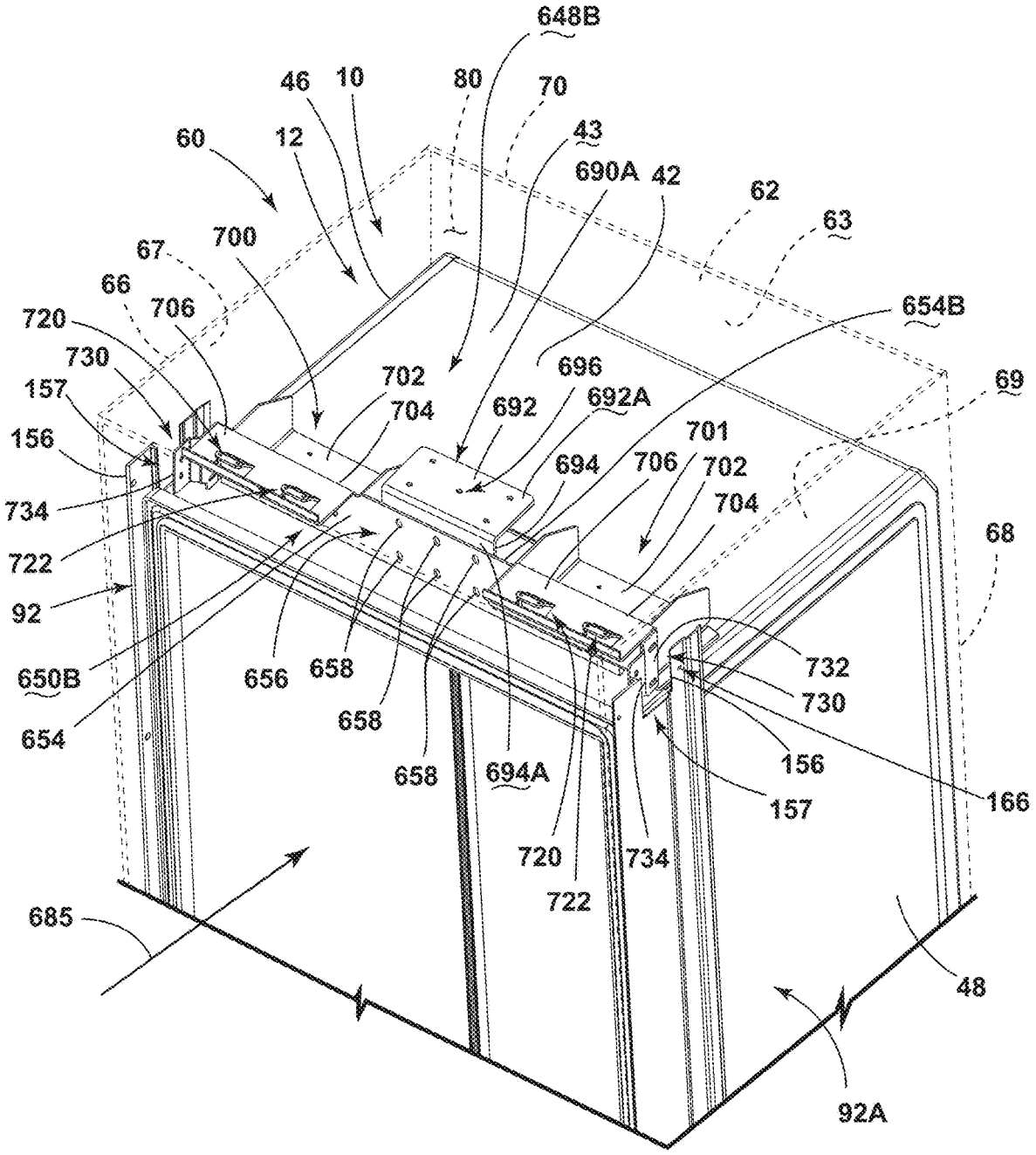
FIG. 49 is a fragmentary top perspective view of the upper bracket system of FIG. 47 in an assembled condition and supported on a refrigerator that is received within a cabinet structure, with the cabinet structure shown in phantom.

Referring now to FIG. 48, the second hinge support bracket 701 is shown having an inner sidewall 708 and an outer sidewall 710. The inner sidewall 708 and outer sidewall 710 are disposed in a substantially upright position and spaced-apart from each other on opposite sides of the first and second portions 702, 704 of the second hinge support bracket 701. The inner sidewall 708 and the outer sidewall 710 interconnect the first and second portions 702, 704 of the second hinge support bracket 701 to provide a bracing feature therebetween. In assembly, the lower surface 702B of the second hinge support bracket 701 is configured to abut the upper surface 652A of the first portion 652 of the hinge bracket 650B, as best shown in FIG. 49. In FIG. 48, the first portion 702 is shown having one or more apertures 712 which can be used to mount the second hinge support bracket 701 to the first portion 652 of the hinge bracket 650B, at the upper surface 652A thereof. The second portion 704 of the second hinge support bracket 701 is shown having a plurality of apertures 714 which can be used to mount the second hinge support bracket 701 to the second portion 654 of the hinge bracket 650B, at the plurality of apertures 656B of the hinge bracket 650B. The plurality of apertures 714 illustrated in FIG. 48 are shown in phantom, as they are covered by the third portion 706 of the second hinge support bracket 701. However, the plurality of apertures 714 of the second hinge support bracket 701 are contemplated to be disposed in a reciprocal pattern relative to the plurality of apertures 656B disposed on the hinge bracket 650B. In this way, it is contemplated that the front surface 704A of the second portion 704 of the second hinge support bracket 701 is configured to abut the rear surface 654B of the second portion 654 of the hinge bracket 650B in assembly, as best shown in FIG. 49.

As further shown in FIG. 48, the third portion 706 of the second hinge support bracket 701 includes first and second mounting flanges 720, 722 which are disposed over respective apertures 721, 723. The first and second mounting flanges 720, 722 include similar features, such that the description of the first mounting flange 720 will describe the second mounting flange 722 as well. The first mounting flange 720 includes a tab portion 724 that is vertically spaced-apart from the upper surface 706A of the third portion 706 by an angled portion 726. Specifically, the angled portion 726 extends upwardly at a forward angle from the upper surface 706A of the third portion 706 of the second hinge support bracket 701. The tab portion 724 is contemplated to be vertically spaced-apart, but substantially planar with the upper surface 706A of the third portion 706 of the second hinge support bracket 701. Apertures 728 define one or more apertures disposed through the tab portion 724, and are used to couple the second hinge support bracket 701 to the top wall 62 of the cabinet structure 60 at the inner surface 63 thereof, as best shown in FIG. 49.

As further shown in FIG. 48, the second hinge support bracket 701 further includes a side mounting flange 730 disposed adjacent to the outer sidewall 710. The side mounting flange 730 includes a first tab portion 732 that is inwardly spaced-apart from a second tab portion 734 by a transverse portion 736. Said differently, the second tab portion 734 of the side mounting flange 730 is spaced outwardly relative to the first tab portion 732. The first and second tab portions 732, 734 are disposed below the third portion 706 of the second hinge support bracket 701, and are substantially perpendicular thereto. The first tab portion 732 of the side mounting flange 730 includes one or more apertures 738 disposed therethrough. In assembly, the one or more apertures 738 of the first tab portion 732 of the side mounting flange 730 may be used to couple the second hinge support bracket 701 to an upper end of a trim member, such as the upper end 156 of trim member 92A at upper mounting aperture 166 shown in FIG. 49. The second tab portion 734 of the side mounting flange 730 also includes one or more apertures 740 disposed therethrough. In assembly, the one or more apertures 740 of the second tab portion 734 of the side mounting flange 730 may be used to couple the second hinge support bracket 701 to a sidewall of the cabinet structure, such as the second sidewall 68 of the cabinet structure 60 at the inner surface 69 thereof, as best shown in FIG. 49.

Referring now to FIG. 49, the upper bracket system 648B is shown mounted between the refrigerator 10 and the cabinet structure 60. As shown in FIG. 49, the cabinet structure 60 is shown in phantom to reveal the mounting bracket 690A mounted to the inner surface 63 of the top wall 62 of the cabinet structure 60. As shown in FIG. 49, the mounting bracket 690A is mounted to the inner surface 63 of the top wall 62 of the cabinet structure 60 at the first portion 692 of the mounting bracket 690A. Specifically, the upper surface 692A of the first portion 692 of the mounting bracket 690A is configured to abut the inner surface 63 of the top wall 62 of the cabinet structure 60, such that the plurality of apertures 696 can be used to fasten the mounting bracket 690A thereto. As further illustrated in FIG. 49, the hinge bracket 650B is shown positioned on the outer surface 43 of the top wall 42 of the refrigerator 10 at the first portion 652 thereof. The rear surface 654B of the hinge bracket 650B abuts the front surface 694A of the mounting bracket 690A in the arrangement of FIG. 49. In this configuration, the plurality of mounting apertures 680 (FIG. 47) of the mounting bracket 690A are aligned with the plurality of apertures 656 of the hinge bracket 650B for interconnecting the mounting bracket 690A and the hinge bracket 650B using fasteners. It is contemplated that the mounting bracket 690A is mounted to the top wall 62 of the cabinet structure 60, before the refrigerator 10 is inserted into the cabinet enclosure 80 of the cabinet structure 60. Similarly, the hinge bracket 650B may be welded, or otherwise fixedly coupled, to the top wall 42 of the refrigerator 10, before the refrigerator 10 is inserted into the cabinet enclosure 80 of the cabinet structure 60. Further, it is contemplated that the hinge bracket 650B may be positioned on the outer surface 43 of the top wall 42 of the refrigerator 10, such that the lower surface 652B of the first portion 652 of the hinge bracket 650B abuts the outer surface 43 of the top wall 42 of the refrigerator 10, without the need to fixedly couple the hinge bracket 650B thereto.

With the hinge bracket 650B and the mounting bracket 690A set in their respective positions, the refrigerator 10 can be inserted into the cabinet enclosure 80 of the cabinet structure 60 in the direction as indicated by arrow 685 in FIG. 49 until the rear surface 654B of the hinge bracket 650B abuts the front surface 694A of the mounting bracket 690A. When this abutting arrangement is provided between the rear surface 654B of the hinge bracket 650B and the front surface 694A of the mounting bracket 690A, the plurality of mounting apertures 680 (FIG. 47) of the mounting bracket 690A are aligned with the plurality of apertures 656 of the hinge bracket 650B for threaded engagement with the threaded inserts provided in the mounting apertures 680 of the plurality of mounting apertures 682 of the mounting bracket 690. Thus, fasteners can be used to fixedly couple the hinge bracket 650B to the mounting bracket 690A while the hinge bracket 650B is supported on the refrigerator 10, and the mounting bracket 690A is fixedly coupled to the cabinet structure 60.

As further shown in FIG. 49, first and second hinge support brackets 700, 701 are shown coupled to the hinge bracket 650B. Specifically, the lower surfaces 702B of the first portions 702 of the first and second hinge support brackets 700, 701 abut the upper surface 652A of the first portion 652 of the hinge bracket 650B. Further, the front surfaces 704A (FIG. 48) of the second portions 704 of the first and second hinge support brackets 700, 701 abut the rear surface 654B of the second portion 654 of the hinge bracket 650B. The first and second mounting flanges 720, 722 of the first and second hinge support brackets 700, 701 are shown upwardly extending from the third portions 706 of the first and second hinge support brackets 700, 701, such that the apertures 728 thereof can be used to couple the first and second hinge support brackets 700, 701 to the top wall 62 of the cabinet structure 60 at the inner surface 63 thereof.

As further shown in FIG. 49, the first tab portions 732 of the side mounting flanges 730 have apertures 738 (FIG. 48) accessible to couple the first and second hinge support brackets 700, 701 to the upper ends 156 of the first and second trim members 92 and 92A. The one or more apertures 740 (FIG. 48) of the second tab portions 734 of the side mounting flanges 730 are aligned with the cutout portions 157 of the first and second trim members 92 and 92A, such that the one or more apertures 740 thereof are accessible to couple the first and second hinge support brackets 700, 701 to the first and second sidewalls 66, 68, respectively, at the respective inner surfaces 67, 69 thereof.

Figure 50:
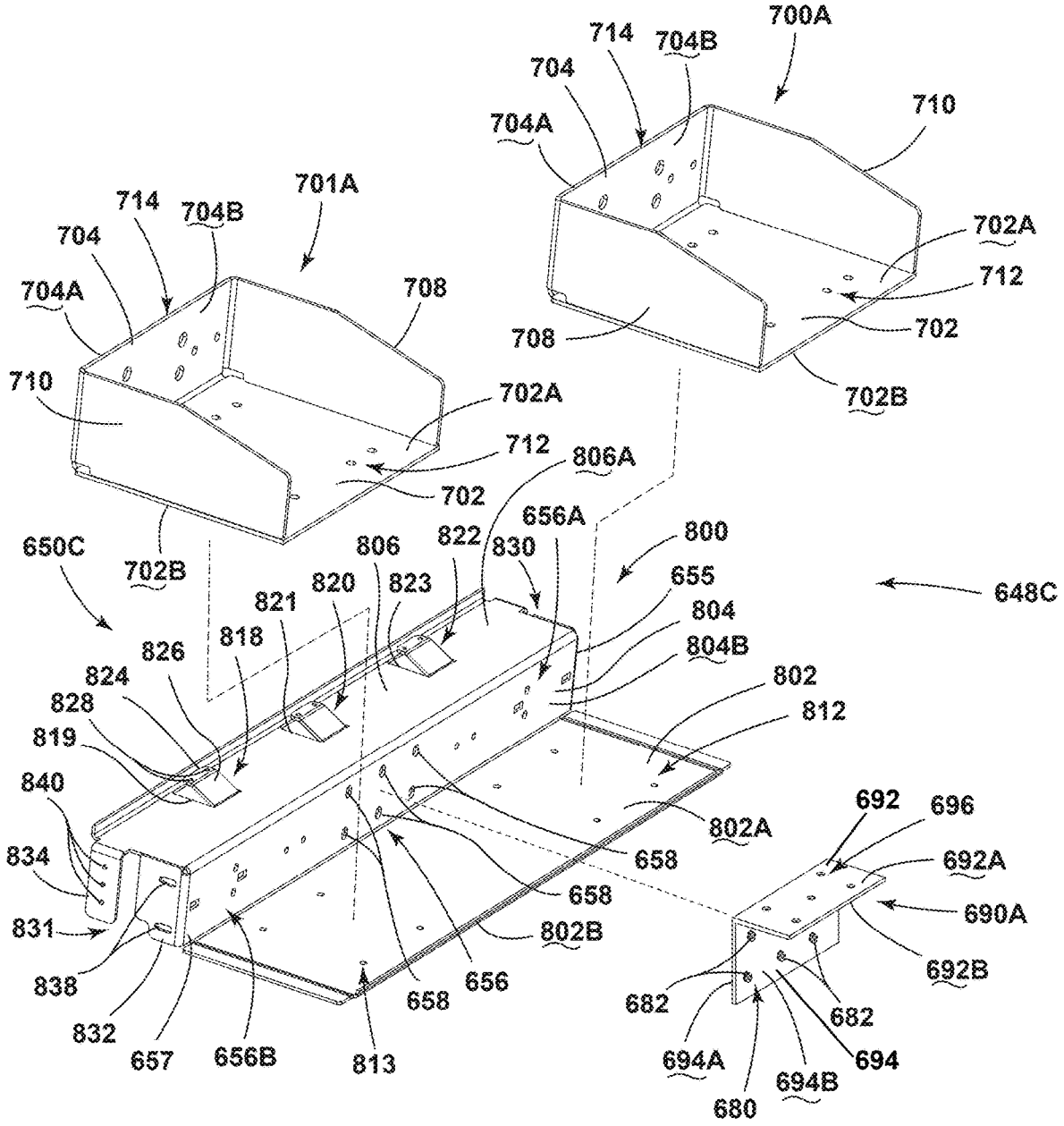
FIG. 50 is an exploded top perspective view of an upper bracket system.
Figure 51:
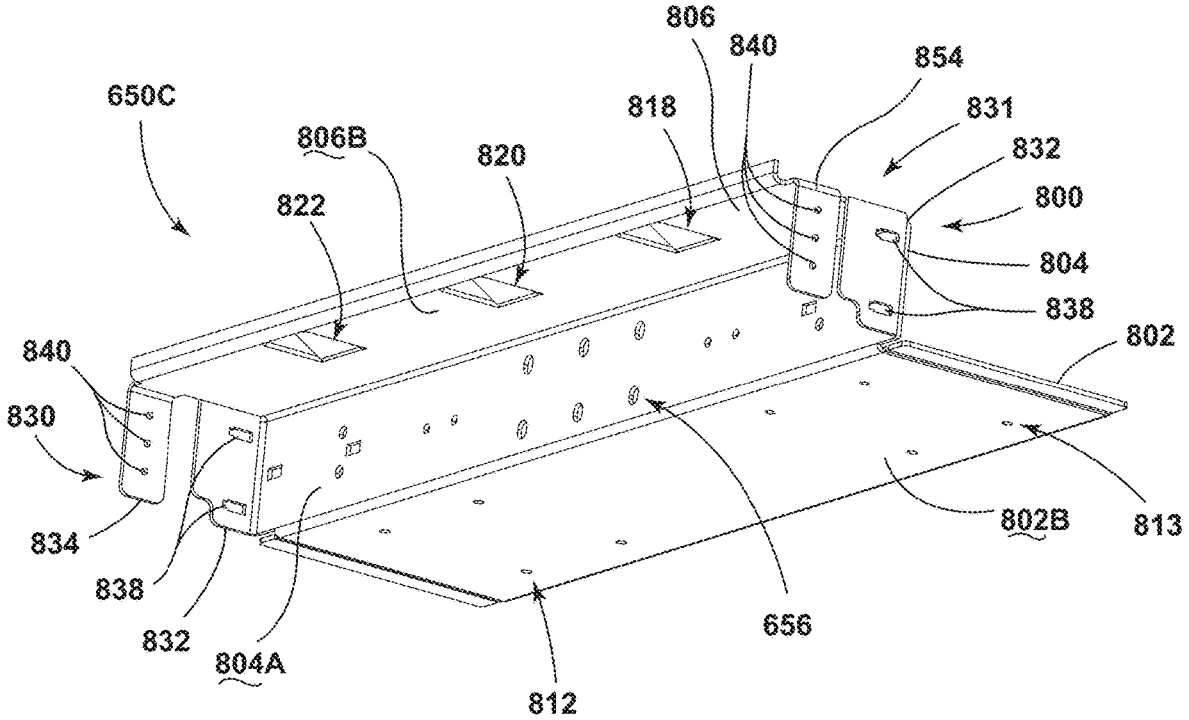
FIG. 51 is an front bottom perspective view of a hinge bracket of the upper bracket system of FIG. 50.
Figure 52:
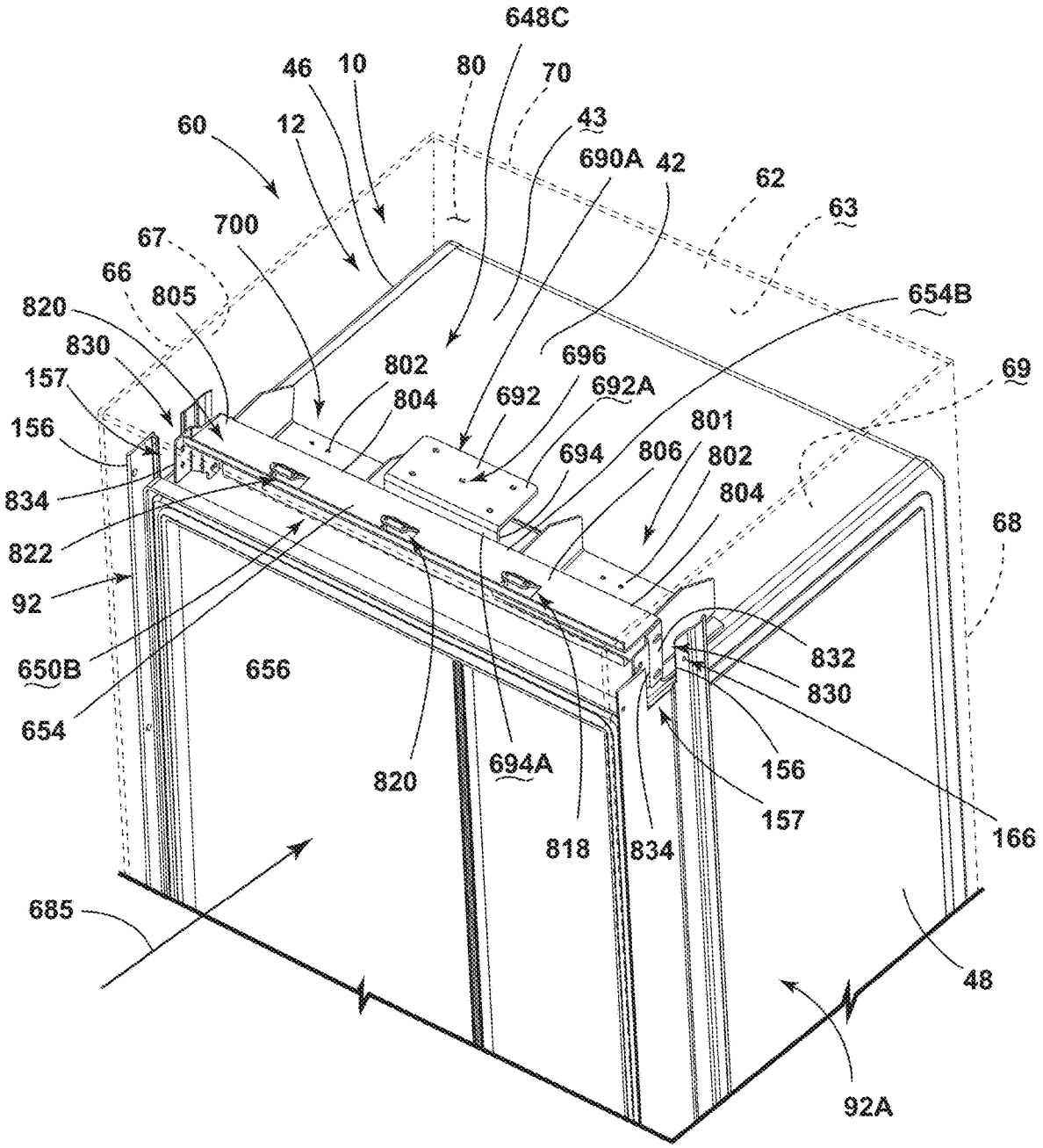
FIG. 52 is a fragmentary top perspective view of the upper bracket system of FIG. 50 in an assembled condition and supported on a refrigerator that is received within a cabinet structure, with the cabinet structure shown in phantom.

Referring now to FIGS. 50 and 51, an upper bracket system 648C is shown having another embodiment of a hinge bracket 650C. The hinge bracket 650C includes body portion 800 having a first portion 802, a second portion 804 and a third portion 806. The first portion 802 of the hinge bracket 650C is a substantially horizontal portion that includes upper and lower surfaces 802A, 802B. The second portion 804 of the hinge bracket 650C is a substantially upright portion that extends orthogonally in an upright direction from the upper surface 802A of the first portion 802 of the hinge bracket 650C. The second portion 804 of the hinge bracket 650C includes a front surface 804A (FIG. 51) and a rear surface 804B (FIG. 50). The third portion 806 of the hinge bracket 650C extends outwardly in a forward direction from the front surface 804A of the second portion 804 of the hinge bracket 650C. The third portion 806 of the hinge bracket 650C includes an upper surface 806A and a lower surface 806B. As shown in FIGS. 50 and 51, the third portion 806 extends outwardly from an upper portion of the second portion 804 of the hinge bracket 650C, while the first portion 802 extends rearwardly from a lower portion of the second portion 804 of the hinge bracket 650C. Thus, the first portion 802 is vertically offset from, but substantially parallel to, the third portion 806. The second portion 804 of the hinge bracket 650C is substantially perpendicular to both the first portion 802 and the third portion 806. In this way, the hinge bracket 650C includes an overall S-shaped configuration between the first, second and third portions 802, 804 and 806 thereof. The lower surface 802B of hinge bracket 650C is configured to abut the outer surface 43 of the top wall of the refrigerator 10, as best shown in FIG. 52.

In FIGS. 50 and 51, the first portion 802 of the hinge bracket 650C is shown having first and second sets of apertures 812, 813 that can be used to mount first and second hinge support brackets 700A, 701A (FIG. 50) to opposed sides of the first portion 802 of the hinge bracket 650C, at the upper surface 802A thereof.

With reference to FIGS. 50 and 51, the second portion 804 of hinge bracket 650C is shown having a number of sets of apertures similar to the configuration of apertures found on the second portion 654 of the hinge bracket 650B discussed above. As such, like reference numerals used to describe the aperture arrangement and other features of the second portion 654 of the hinge bracket 650B discussed above will also be used to describe apertures and features of the second portion 802 of the hinge bracket 650C. As shown in FIGS. 50 and 51, a plurality of apertures 656A is disposed on the first end 655 of the second portion 802 of the hinge bracket 650C and is used to mount a first hinge support bracket 700A (FIG. 50) to the hinge bracket 650C, as further described below. Similarly, the hinge bracket 650C further includes a plurality of apertures 656B disposed on a second end 657 of the second portion 802 of the hinge bracket 650C. The plurality of apertures 656B is used to mount a second hinge support bracket 701A (FIG. 50) to the hinge bracket 650C, as further described below. The second end 657 of the second portion 802 of the hinge bracket 650C is contemplated to be an opposite or opposed end relative to the first end 655 of the second portion 802 of the hinge bracket 650C. A plurality of apertures 656 is disposed at the middle portion of the second portion 802 of the hinge bracket 650C between the plurality of apertures 656A, 656B, and is configured to mount the second portion 802 of the hinge bracket 650C to the mounting bracket 690A (FIG. 50). The plurality of apertures 656 shown in the embodiment of the hinge bracket 650C in FIGS. 50 and 51 includes three sets of spaced-apart apertures 658 for a total of six apertures, altogether.

As further shown in FIG. 50, the mounting bracket 690A is shown exploded away from the hinge bracket 650C. In the same manner as described above, the first portion 692 of the mounting bracket 690A includes the plurality of apertures 696 which, in the embodiment of FIG. 50 includes five spaced-apart apertures for coupling the mounting bracket 690A to the top wall 62 of the cabinet structure 60 at the inner surface 63 thereof, as best shown in FIG. 52. In the embodiment shown in FIG. 50, the mounting bracket 690A further includes the plurality of mounting apertures 680 disposed along the second portion 694 of the mounting bracket 690A in a reciprocal pattern relative to the plurality of apertures 656 of the hinge bracket 650C. In this way, the plurality of mounting apertures 680 of the mounting bracket 690A can be aligned with the plurality of apertures 656 of the hinge bracket 650C for interconnecting the mounting bracket 690A and the hinge bracket 650C in assembly.

As further shown in FIG. 50, first and second hinge support brackets 700A, 701A are shown exploded away from the hinge bracket 650B. The first and second hinge support brackets 700A, 701A are contemplated to be mirror images of each other, and are also contemplated to include a number of features in common with first and second hinge support brackets 700, 701 described above. As such, like reference numerals will be used to describe common features between the first and second hinge support brackets 700, 701 and the first and second hinge support brackets 700A, 701A. The first and second hinge support brackets 700A, 701A each include a first portion 702 having upper and lower surfaces 702A, 702B, and a second portion 704 having front and rear surfaces 704A, 704B. The first portion 702 of the first and second hinge support brackets 700A, 701A is substantially perpendicular to the second portion 704. Inner and outer sidewalls 708, 710 interconnect the first and second portions 702, 704. The first portion 702 of the first hinge support bracket 700A includes apertures 712 that are configured to couple to apertures 812 of the hinge bracket 650C to mount the first hinge support bracket 700A to the first portion 802 of the hinge bracket 650C. The first portion 702 of the second hinge support bracket 701A includes apertures 712 that are configured to couple to apertures 813 of the hinge bracket 650C to mount the second hinge support bracket 701A to the first portion 802 of the hinge bracket 650C. The second portion 704 of the first hinge support bracket 700A includes apertures 714 that are configured to couple to apertures 656A of the hinge bracket 650C to mount the first hinge support bracket 700A to the second portion 804 of the hinge bracket 650C. The second portion 704 of the second hinge support bracket 701A includes apertures 714 that are configured to couple to apertures 656B of the hinge bracket 650C to mount the second hinge support bracket 701A to the second portion 804 of the hinge bracket 650C.

As further shown in FIGS. 50 and 51, the third portion 806 of hinge bracket 650C includes first, second and third mounting flanges 818, 820 and 822 which are disposed over respective apertures 819, 821 and 823. The mounting flanges 818, 820 and 822 include similar features, such that the description of the first mounting flange 818 will describe the second and third mounting flanges 820, 822 as well. The first mounting flange 818 includes a tab portion 824 that is vertically spaced-apart from the upper surface 806A of the third portion 806 by an angled portion 826. Specifically, the angled portion 826 extends upwardly at a forward angle from the upper surface 806A of the third portion 806 of hinge bracket 650C. The tab portion 824 is contemplated to be vertically spaced-apart, but substantially planar with the upper surface 806A of the third portion 806 of hinge bracket 650C. Apertures 828 define one or more apertures disposed through the tab portion 824 of the first mounting flange 818, and are used to couple the hinge bracket 650C to the top wall 62 of the cabinet structure 60 at the inner surface 63 thereof, as best shown in FIG. 52.

As further shown in FIGS. 50 and 51, the hinge bracket 650C further includes first and second side mounting flanges 830, 831. The first and second side mounting flanges 830, 831 each include a first tab portion 832 that is inwardly spaced-apart from a second tab portion 834. Said differently, the second tab portion 834 of the first and second side mounting flanges 830, 831 is spaced outwardly relative to the first tab portion 832. The first and second tab portions 832, 834 are disposed below the third portion 806 of the hinge bracket 650C, and are substantially perpendicular thereto. The first tab portion 832 of the first and second side mounting flanges 830, 831 each include one or more apertures 838 disposed therethrough. In assembly, the one or more apertures 838 of the first tab portion 832 of the first and second side mounting flanges 830, 831 may be used to couple the hinge bracket 650C to an upper end of a trim member, such as the upper end 156 of trim member 92A at upper mounting aperture 166 shown in FIG. 52. The second tab portion 834 of the first and second side mounting flanges 830, 831 also includes one or more apertures 840 disposed therethrough. In assembly, the one or more apertures 840 of the second tab portion 834 of the first and second side mounting flanges 830, 831 may be used to couple the hinge bracket 650C to a sidewall of the cabinet structure, such as the first and second sidewalls 66, 68 of the cabinet structure 60 at the respective inner surfaces 67, 69 thereof, as best shown in FIG. 52.

Figure 53:
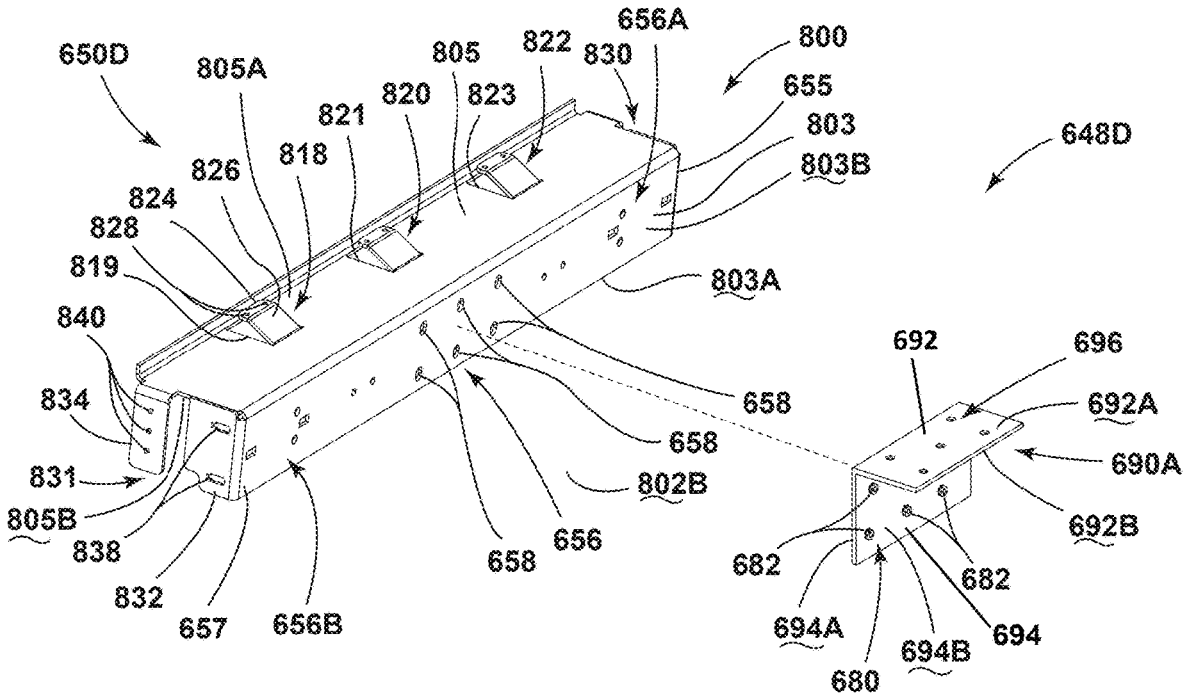
FIG. 53 is an exploded top perspective view of an upper bracket system.

Referring now to FIG. 53, an upper bracket system 648D is shown having another embodiment of a hinge bracket 650D. The hinge bracket 650D is similar to hinge bracket 650C, but does not include the first portion 802 of hinge bracket 650C. Instead, the hinge bracket 650D includes a body portion 800 having a first portion 803 and a second portion 805. The first portion 803 and the second portion 805 of the hinge bracket 650D are akin to the second portion 804 and the third portion 806 of hinge bracket 650C, respectively. Otherwise, like reference numerals are provided in FIG. 53 to denote common features shared between hinge brackets 650C and 650D.

The first portion 803 of the hinge bracket 650D is a substantially upright portion that includes a front surface 803A and a rear surface 803B. The second portion 805 of the hinge bracket 650D extends outwardly in a forward direction from the front surface 804A of the first portion 803 of the hinge bracket 650D. The second portion 805 of the hinge bracket 650D is a substantially horizontal portion that includes an upper surface 805A and a lower surface 805B. As shown in FIG. 53, the second portion 805 of the hinge bracket 650D extends outwardly from an upper portion of the first portion 803 of the hinge bracket 650D, such that the first portion 803 of the hinge bracket 650D is substantially perpendicular to the second portion 805. In this way, the hinge bracket 650D includes an overall L-shaped configuration between the first and second portions 803, 805 thereof. A plurality of apertures 656 is disposed at the middle portion of the first portion 803 of the hinge bracket 650D, and is configured to mount the first portion 803 of the hinge bracket 650D to the plurality of apertures 680 of the second portion 694 of the mounting bracket 690A. The plurality of apertures 656 shown in the embodiment of the hinge bracket 650D in FIG. 53 includes three sets of spaced-apart apertures 658 for a total of six apertures, which corresponds to the six mounting apertures 682 of the plurality of apertures 680 disposed on the second portion 694 of the mounting bracket 690A. Thus, the first portion 692 the mounting bracket 690A couples to the top wall 62 of the cabinet structure 60, while the second portion 694 of the mounting bracket 690A mounts to the first portion 803 of the hinge bracket 650D. Further, the one or more apertures 840 of the second tab portion 834 of the first and second side mounting flanges 830, 831 may be used to couple the hinge bracket 650C to a sidewall of the cabinet structure, such as the first and second sidewalls 66, 68 of the cabinet structure 60 at the respective inner surfaces 67, 69 thereof.

Figure 54:
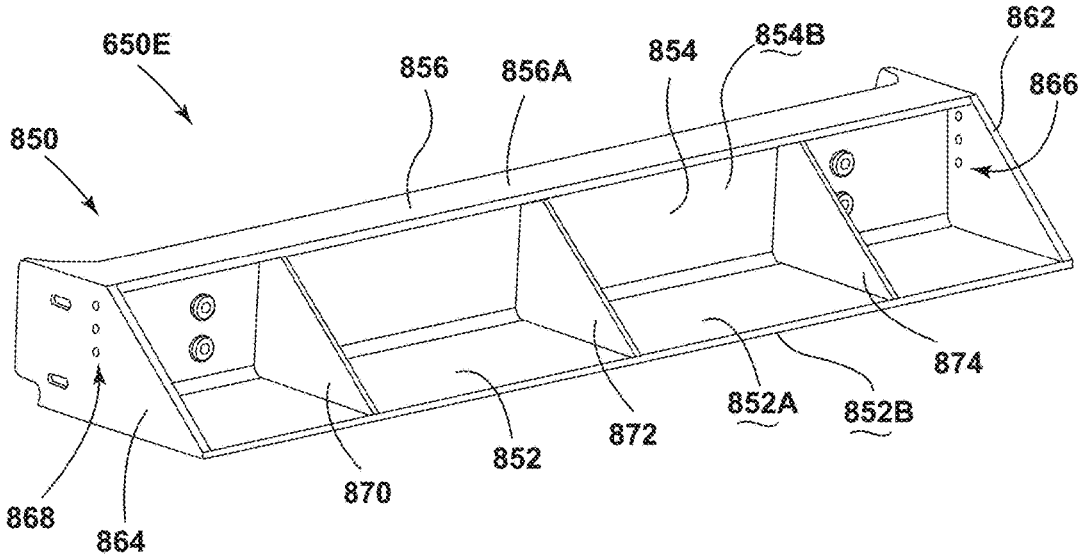
FIG. 54 is a rear top perspective view of a hinge bracket of an upper bracket system.
Figure 56:
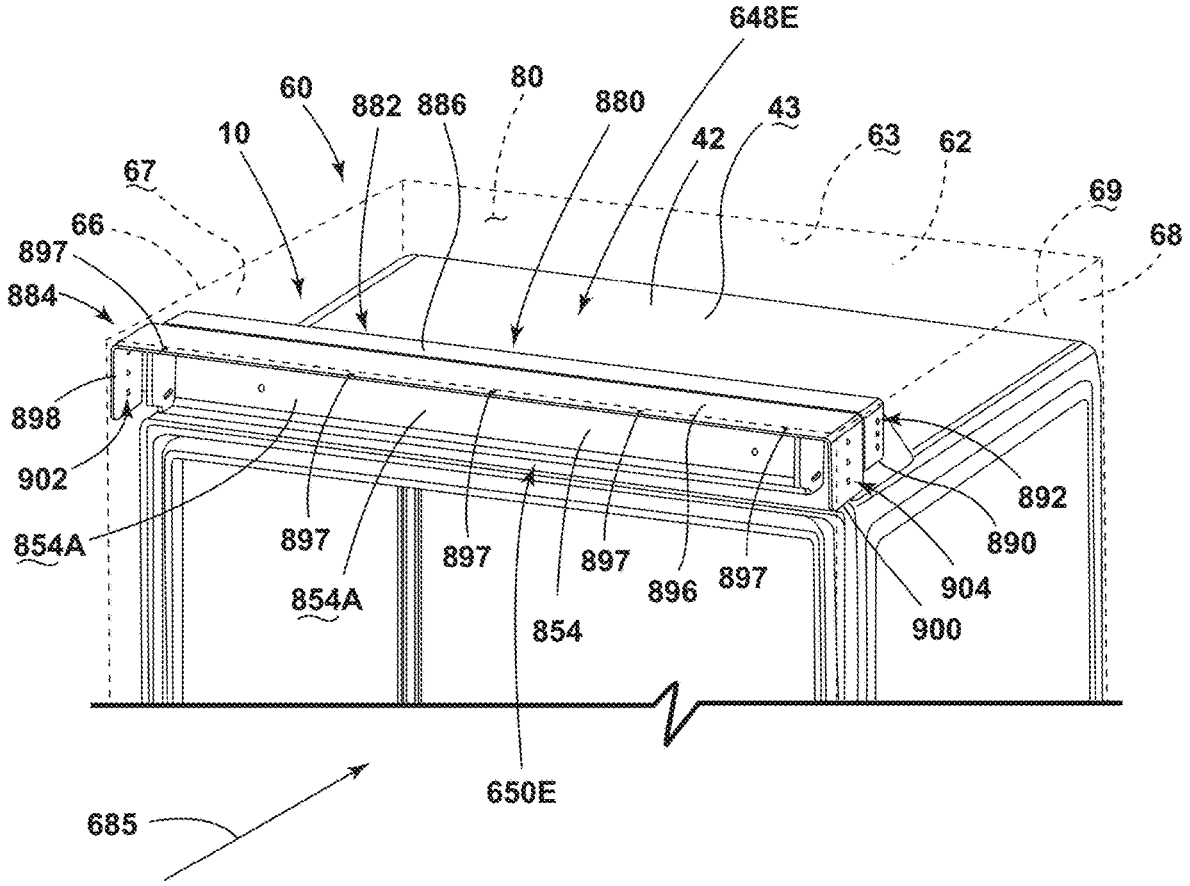
FIG. 56 is a fragmentary top perspective view of the upper bracket system of FIGS. 54 and 55 in an assembled condition and supported on a refrigerator that is received within a cabinet structure, with the cabinet structure shown in phantom.

Referring now to FIG. 54, another embodiment of a hinge bracket 650E is shown. The hinge bracket 650E includes a body portion 850 having a first portion 852, a second portion 854 and a third portion 856. The first portion 852 of the hinge bracket 650E is a substantially horizontal portion that includes upper and lower surfaces 852A, 852B. The second portion 854 of the hinge bracket 650E is a substantially upright portion that extends orthogonally in an upright direction from the upper surface 852A of the first portion 852 of the hinge bracket 650E. The second portion 854 of the hinge bracket 650E includes a front surface 854A (FIG. 56) and a rear surface 854B. The third portion 856 of the hinge bracket 650E extends outwardly in a forward direction from the front surface 854A of the second portion 854 of the hinge bracket 650E. The third portion 856 of the hinge bracket 650E includes an upper surface 856A. As shown in FIG. 54, the third portion 856 extends outwardly from an upper portion of the second portion 854 of the hinge bracket 650E, while the first portion 852 extends rearwardly from a lower portion of the second portion 854 of the hinge bracket 650E. Thus, the first portion 852 is vertically offset from, but substantially parallel to, the third portion 856. The second portion 854 of the hinge bracket 650E is substantially perpendicular to both the first portion 852 and the third portion 856. In this way, the hinge bracket 650E includes an overall S-shaped configuration between the first, second and third portions 852, 854 and 856 thereof. The lower surface 852B of hinge bracket 650E is configured to abut the outer surface 43 of the top wall of the refrigerator 10, as best shown in FIG. 56.

As further shown in FIG. 54, the hinge bracket 650E includes first and second sidewalls 862, 864 disposed on opposite sides of the body portion 850. The first sidewall 862 includes a plurality of apertures 866 disposed therethrough. The apertures of the plurality of apertures 866 of the first sidewall 862 are configured to couple the hinge bracket 650E to a mounting bracket 880 (FIG. 55), as further described below. Similarly, the second sidewall 864 includes a plurality of apertures 868 disposed therethrough. The apertures of the plurality of apertures 868 of the second sidewall 864 are also configured to couple the hinge bracket 650E to a mounting bracket 880 (FIG. 55), as further described below. In the embodiment shown in FIG. 54, the hinge bracket 650E includes a plurality of braces 870, 872 and 874 which are configured in a generally triangular shape, and which interconnect the first second and third portions 852, 854 and 856 of the hinge bracket 650E to provide a reinforcement feature for the hinge bracket 650E.

Figure 55:
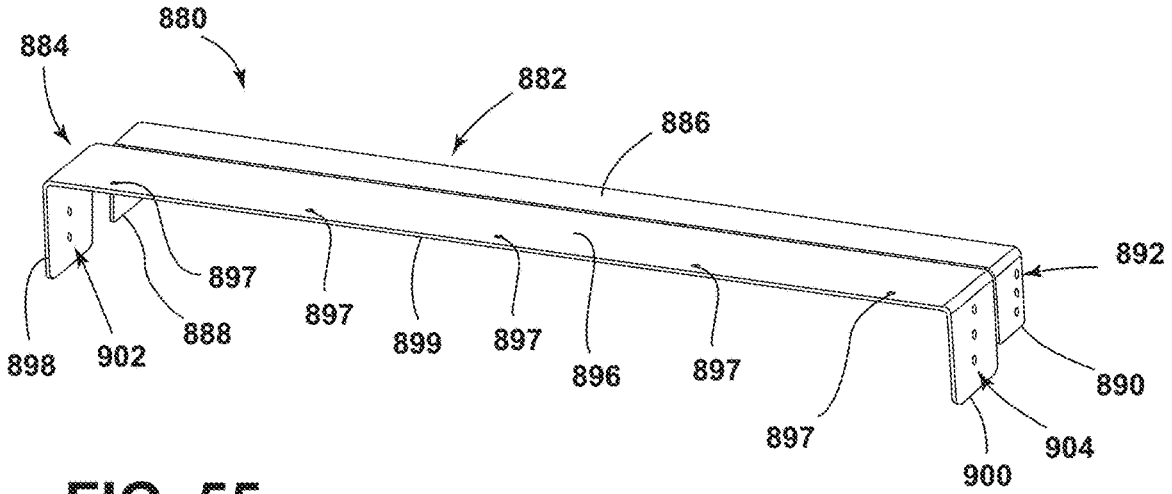
FIG. 55 is a front top perspective view of a mounting bracket of an upper bracket system.

Referring now to FIG. 55, a mounting bracket 880 is shown. Together, the mounting bracket 880 and the hinge bracket 650E define another upper bracket system 648E. The mounting bracket 880 includes a first portion 882 and a second portion 884. The first portion 882 of the mounting bracket 880 includes a generally planar body portion 886 having first and second downwardly turned end walls 888, 890. The second downwardly turned end wall 890 includes a plurality of apertures 892. The plurality of apertures 892 are shown in a configuration similar to the plurality of apertures 868 disposed on the second sidewall 864 of the hinge bracket 650E, as shown in FIG. 54. It is contemplated that a plurality of apertures is disposed on the first downwardly turned end wall 888 of the mounting bracket 880 as well, that is similar in configuration to the plurality of apertures 892 of the second downwardly turned end wall 890. In this way, it is contemplated that the plurality of apertures disposed on the first downwardly turned end wall 888 of the mounting bracket 880 is similar in configuration to the plurality of apertures 866 disposed on the first sidewall 862 of the hinge bracket 650E, as shown in FIG. 54. In this way, the body portion 886 and the first and second downwardly turned end walls 888, 890 of the first portion 882 of the mounting bracket 880 provide for an overall inverted U-shaped configuration for the first portion 882 of the mounting bracket 880. In assembly, as best shown in FIG. 56, the first portion 882 of the mounting bracket 880 is configured to be received over the third portion 856 of the hinge bracket 650E, such that the body portion 886 of the first portion 882 of the mounting bracket 880 abuts the upper surface 856A of the third portion 856 of the hinge bracket 650E when the mounting bracket 880 is coupled thereto. For coupling the mounting bracket 880 to the hinge bracket 650E, the first and second downwardly turned ends 888, 890 are contemplated to be aligned with the respective first and second sidewalls 862, 864 of the hinge bracket 650E, such that the apertures thereof are aligned and ready for coupling to one another. In FIG. 56, the upper bracket system 648E is shown mounted between the refrigerator 10 and the cabinet structure 60.

With further reference to FIG. 55, the second portion 884 of the mounting bracket 880 includes a generally planar body portion 896 having first and second downwardly turned end walls 898, 900. The first and second downwardly turned end walls 898, 900 each include a plurality of apertures 902, 904, respectively. The plurality of apertures 902 and 904 of the first and second downwardly turned end walls 898, 900 are provided to receive fasteners therethrough to couple the first and second downwardly turned end walls 898, 900 to the opposed side walls 66, 68 of the cabinet structure 60 at the respective inner surfaces 67, 69 thereof, as best shown in FIG. 56. The body portion 896 and the first and second downwardly turned end walls 898, 900 of the second portion 884 of the mounting bracket 880 provide for an overall inverted U-shaped configuration for the second portion 884 of the mounting bracket 880. While the second portion 884 of the mounting bracket 880 includes a similar configuration to the first portion 882 of the mounting bracket 880, the second portion 884 of the mounting bracket 880 is provided with the body portion 896 thereof in a forward and upward position relative to the body portion 886 of the first portion 882 of the mounting bracket 880. Further, the body portion 896 of the second portion 884 of the mounting bracket 880 is longer than the body portion 886 of the first portion 882 of the mounting bracket 880. In this way, the first and second downwardly turned end walls 898, 900 are positioned both forward and outward relative to the first and second downwardly turned end walls 888, 890 of the first portion 882 of the mounting bracket 880, respectively. As further shown in FIG. 55, the body portion 896 of the second portion 884 of the mounting bracket 880 includes apertures 897 disposed therethrough along a front edge 899 of the body portion 896. In assembly, as best shown in FIG. 56, the second portion 884 of the mounting bracket 880 is configured to abut the inner surface 63 of the top wall 62 of the cabinet structure 60, such that the apertures 897 are accessible for mounting the mounting bracket 880 to the top wall 62 of the cabinet structure 60. With the mounting bracket 880 coupled to the top wall 62 of the cabinet structure 60, and the first portion 852 of the hinge bracket 650E supported on the top wall 42 of the refrigerator 10, the refrigerator 10 can be inserted into the cabinet enclosure 80 of the cabinet structure 60 until the first and second sidewalls 862, 864, and the respective apertures 866, 868 thereof, of the hinge bracket 650E are aligned with the first and second downwardly turned end walls 888, 890, and the respective apertures thereof, of the first portion 882 of the mounting bracket 880 and configured for coupling to one another using fasteners.

Figure 57:
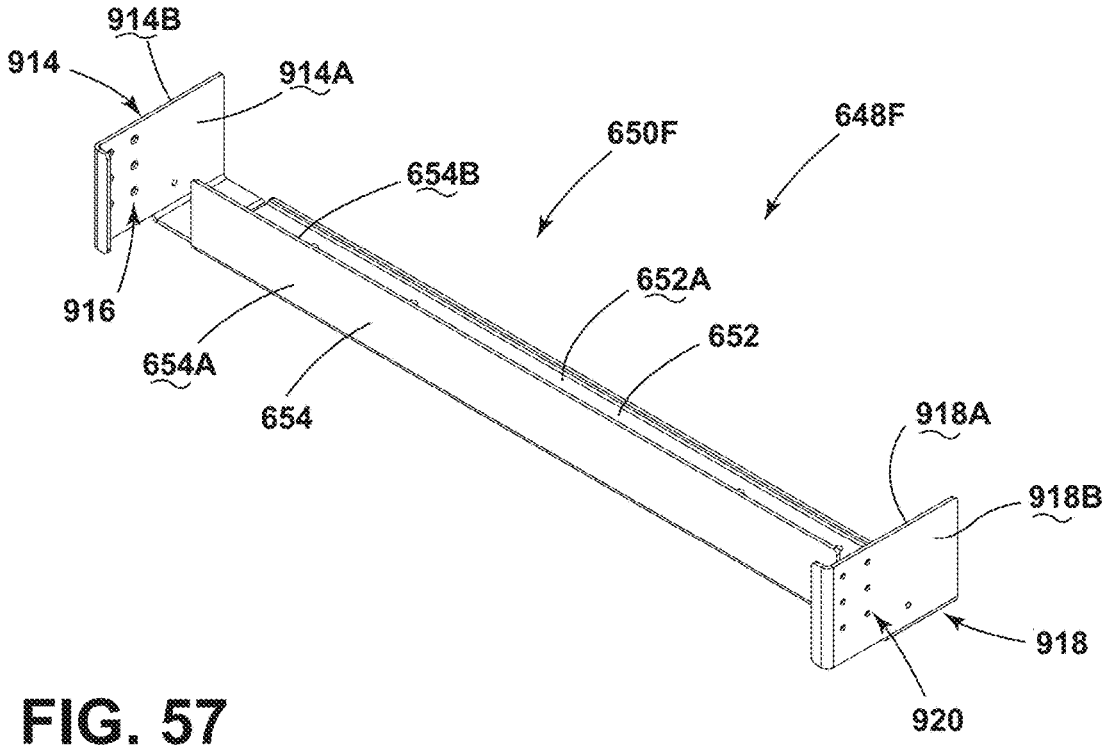
FIG. 57 is a front top perspective view of a hinge bracket.
Figure 58:
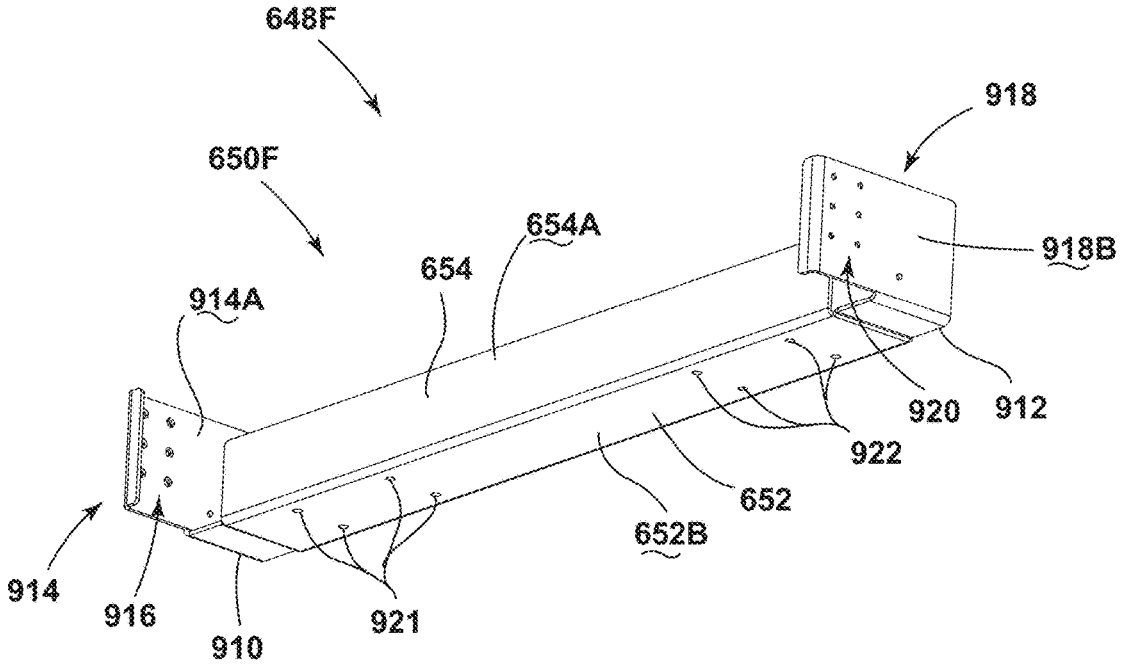
FIG. 58 is a front bottom perspective view of the hinge bracket of FIG. 57.

Referring now to FIGS. 57 and 58, a hinge bracket 650F is shown having a number of features in common with hinge bracket 650 described above. As such, like reference numerals are used in FIGS. 57 and 58 to identify common features shared between the hinge brackets 650 and 650F. The hinge bracket 650F defines another upper bracket system 648F of the present concept. As shown in FIGS. 57 and 58, the hinge bracket 650F includes a first portion 652 and a second portion 654. The first portion 652 of the hinge bracket 650F is a substantially horizontal portion that includes an upper surface (FIG. 57) and a lower surface 652B (FIG. 58). The second portion 654 of the hinge bracket 650F is a substantially upright portion that extends orthogonally in an upright direction from the upper surface 652A of the first portion 652 of the hinge bracket 650F. The second portion 654 of the hinge bracket 650 includes front and rear surfaces 654A, 654B. The hinge bracket 650F includes an overall L-shaped configuration between the first and second portions 652, 654 thereof.

As further shown in FIGS. 57 and 58, the first portion 652 of the hinge bracket 650F includes first and second ends 910, 912 that are opposed to one another. A first side bracket 914 is positioned on the first end 910 in a substantially upright manner. The first side bracket 914 is substantially perpendicular to both the first and second portions 652, 654 of the hinge bracket 650F, and includes inner and outer surfaces 914A, 914B. The first side bracket 914 includes a plurality of apertures 916 disposed therethrough. In the embodiment shown in FIGS. 57 and 58, the plurality of apertures 916 includes three pairs of spaced-apart apertures for a total of six apertures altogether. In assembly, the outer surface 914B of the first side bracket 914 is configured to abut the inner surface 67 of the first sidewall 66 of the cabinet structure 60 when the hinge bracket 650F is positioned on the top wall 42 of the refrigerator 10 and received within the cabinet enclosure 80 of the cabinet structure 60. In this way, the plurality of apertures 916 of the first side bracket 914 are accessible for coupling the first side bracket 914 to the first sidewall 66 of the cabinet structure 60 using fasteners.

As further shown in FIGS. 57 and 58, a second side bracket 918 is positioned on the first end 910 in a substantially upright manner. The second side bracket 918 is substantially perpendicular to both the first and second portions 652, 654 of the hinge bracket 650F, and includes inner and outer surfaces 918A, 918B. The second side bracket 918 includes a plurality of apertures 920 disposed therethrough. In the embodiment shown in FIGS. 57 and 58, the plurality of apertures 920 includes three pairs of spaced-apart apertures for a total of six apertures altogether. In assembly, the outer surface 918B of the second side bracket 918 is configured to abut the inner surface 69 of the second sidewall 68 of the cabinet structure 60 when the hinge bracket 650F is positioned on the top wall 42 of the refrigerator 10 and received within the cabinet enclosure 80 of the cabinet structure 60. In this way, the plurality of apertures 920 of the second side bracket 918 are accessible for coupling the second side bracket 918 to the second sidewall 68 of the cabinet structure 60 using fasteners.

As further shown in FIG. 58, the first portion 652 of the hinge bracket 650F includes first and second sets of apertures 921, 922 which may be used to couple the hinge support brackets, such as first and second hinge support brackets 700, 701 described above, to the hinge bracket 650F.

Figure 59:
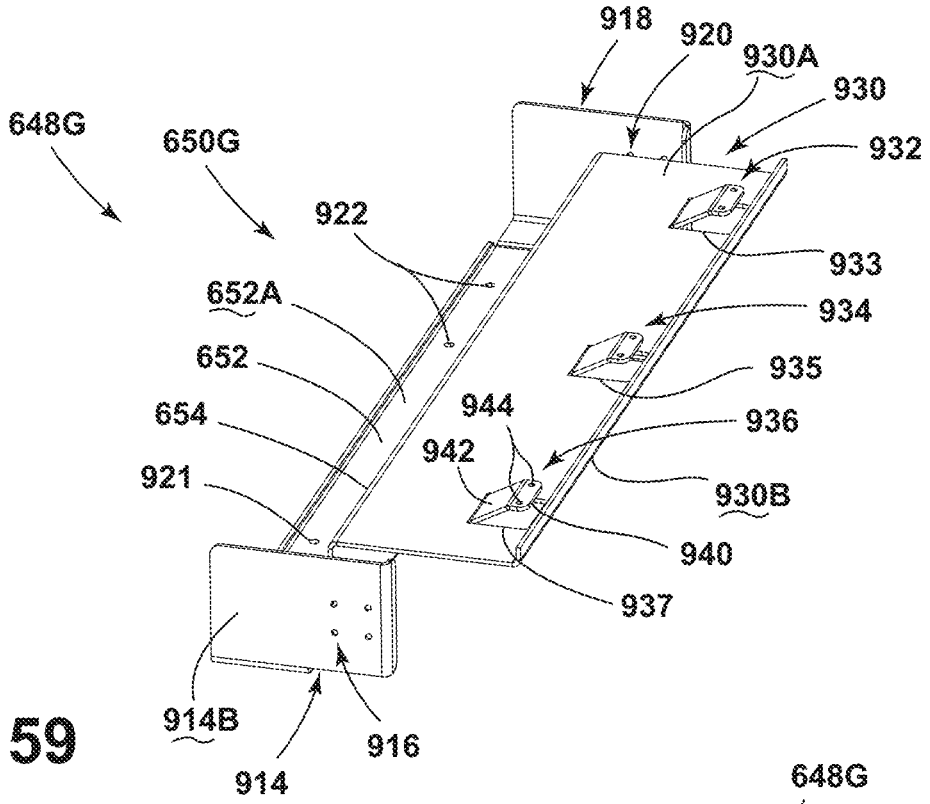
FIG. 59 is a front top perspective view of a hinge bracket.
Figure 60:
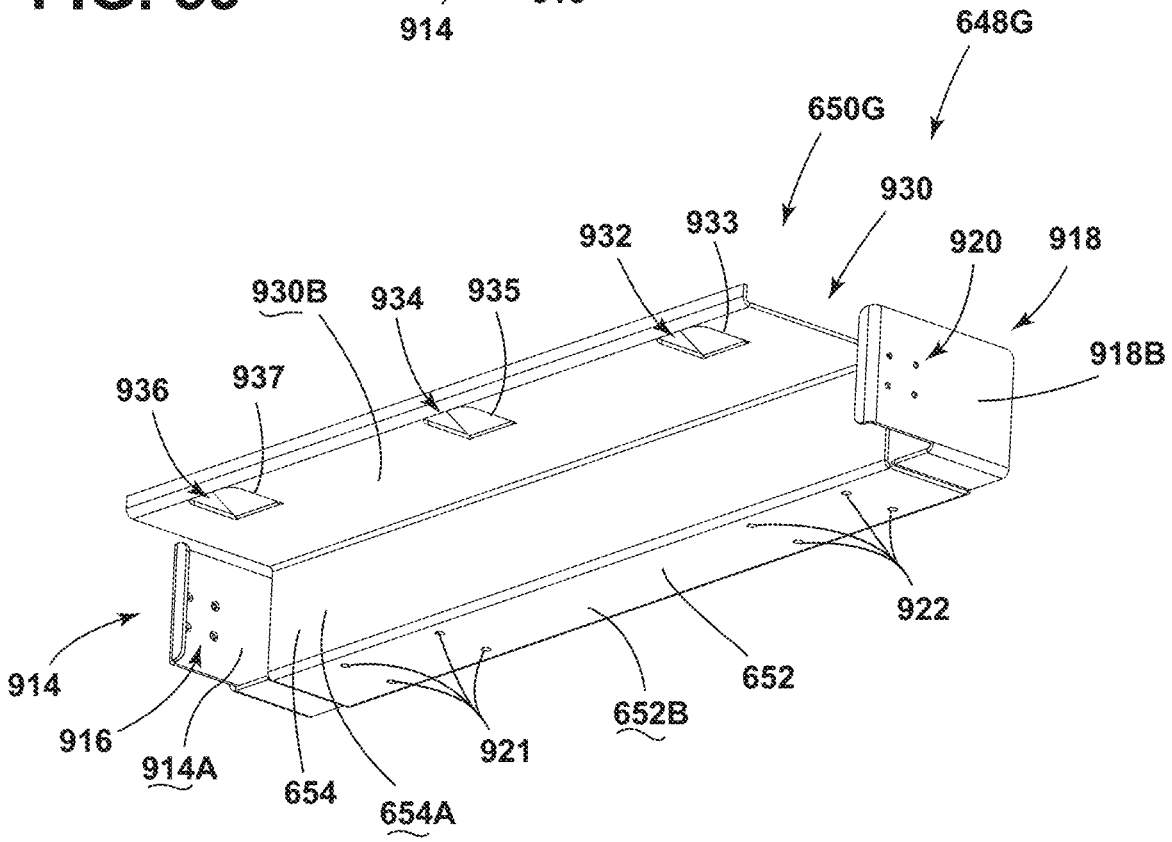
FIG. 60 is a front bottom perspective view of the hinge bracket of FIG. 59.

Referring now to FIGS. 59 and 60, another embodiment of a hinge bracket 650G is shown having a number of features in common with hinge bracket 650F. As such, like reference numerals are used to identify common features between hinge brackets 650F and 650G. The hinge bracket 650G defines another upper bracket system 648G of the present concept. In the embodiment shown in FIGS. 59 and 60, the hinge bracket 650G includes a third portion 930. The third portion 930 of the hinge bracket 650G extends outwardly in a forward direction from the front surface 654A (FIG. 60) of the second portion 654 of the hinge bracket 650G. The third portion 930 of the hinge bracket 650G includes an upper surface 930A and a lower surface 930B. As shown in FIGS. 59 and 60, the third portion 930 of the hinge bracket 650G extends outwardly from an upper portion of the second portion 654 of the hinge bracket 650G, while the first portion 652 extends rearwardly from a lower portion of the second portion 654 of the hinge bracket 650G. Thus, the first portion 652 is vertically offset from, but substantially parallel to, the third portion 930. The second portion 654 of the hinge bracket 650G is substantially perpendicular to both the first portion 652 and the third portion 930. In this way, the hinge bracket 650G includes an overall S-shaped configuration between the first, second and third portions 652, 654 and 930 thereof.

As further shown in FIGS. 59 and 60, the third portion 930 of hinge bracket 650G includes first, second and third mounting flanges 932, 934 and 936 which are disposed over respective apertures 933, 935 and 937. The mounting flanges 932, 934 and 936 include similar features, such that the description of the third mounting flange 936 will describe the first and second mounting flanges 932, 934 as well. The third mounting flange 936 includes a tab portion 940 that is vertically spaced-apart from the upper surface 930A of the third portion 930 by an angled portion 942. Specifically, the angled portion 942 extends upwardly at a forward angle from the upper surface 930A of the third portion 930 of hinge bracket 650G. The tab portion 824 is contemplated to be vertically spaced-apart, but substantially planar with the upper surface 930A of the third portion 930 of hinge bracket 650G. Apertures 944 define one or more apertures disposed through the tab portion 940 of the third mounting flange 936, and are used to couple the hinge bracket 650G to the top wall 62 of the cabinet structure 60 at the inner surface 63 thereof. In this way, the first, second and third mounting flanges 932, 934 and 936 are similar in configuration and function to mounting flanges 818, 820 and 822 described above with reference to FIGS. 50 and 51. Having the first, second and third mounting flanges 932, 934 and 936 for coupling to the top wall 62 of the cabinet structure, it is contemplated that the hinge bracket 650G may also be provided in another embodiment, wherein the first and second side brackets 914, 918 thereof are removed from the hinge bracket 650G.

With reference to the systems discussed above, it is contemplated that any combination of side-mounting bracket systems, such as side-mounting bracket systems 82-82E discussed above, and upper bracket systems, such as upper bracket systems 648-648E discussed above, can be used together to couple a refrigerator to a cabinet structure. Similarly, any lower mounting system, such as the roller box assembly 550 and machine room cover 56 and braces 500, 501 can be used with the above mentioned systems.

According to one aspect of the disclosure, a bracket system for use between an outer surface of an appliance and an inner surface of a cabinet structure includes a mounting bracket with an inner wall spaced-apart from an outer wall with at least one sidewall that interconnects the inner wall and the outer wall. A channel is defined between the inner wall and the outer wall. A plurality of apertures is provided through the outer wall. Each aperture of the plurality of apertures opens into the channel. The inner wall is configured to abut the outer surface of the appliance. A trim member includes first and second mounting portions and an abutment portion inwardly offset from the first and second mounting portions. The first mounting portion includes a plurality of apertures disposed therethrough. One or more of the apertures of the plurality of apertures of the first mounting portion of the trim member align with one or more of the apertures of the plurality of apertures of the mounting bracket to define aligned mounting apertures therebetween. An inner surface of the first mounting portion abuts the outer wall of the mounting bracket and a portion of an inner surface of the abutment portion is configured to abut the outer surface of the appliance. The second mounting portion includes a plurality of apertures disposed therethrough. An outer surface of the second mounting portion is configured to abut the inner surface of the cabinet structure.

According to another aspect of the disclosure, the at least one sidewall of the mounting bracket defines a first sidewall, and a second sidewall extends outwardly from the inner wall of the mounting bracket towards the outer wall of the mounting bracket.

According to another aspect of the disclosure, the second sidewall includes a distal end spaced-apart from the outer wall of the mounting bracket to define an opening into the channel of the mounting bracket.

According to another aspect of the disclosure, one or more apertures of the plurality of apertures provided through the outer wall of the mounting bracket include a threaded insert coupled thereto.

According to another aspect of the disclosure, a fastener is received in one or more of the aligned mounting apertures and threadingly engaged with the threaded insert.

According to another aspect of the disclosure, the first mounting portion includes a body portion having a thickness that is less than a thickness of a body portion of the second mounting portion and less than a thickness of a body portion of the abutment portion.

According to another aspect of the disclosure, the second mounting portion includes a tab inwardly extending from an inner surface of the second mounting portion.

According to another aspect of the disclosure, the trim member includes an inwardly angled transverse portion disposed between the first mounting portion and the abutment portion.

According to yet another aspect of the disclosure, an inner surface of the abutment portion includes first and second abutment locations configured to abut the outer surface of the appliance with an outwardly extending interconnecting web disposed between the first and second abutment locations.

According to another aspect of the disclosure, a bracket system for use between an outer surface of an appliance and an inner surface of a cabinet structure includes a mounting bracket with an inner wall spaced-apart from an outer wall with an intermediate wall interconnecting the inner wall and the outer wall. The inner wall is configured to abut the outer surface of the appliance, and a plurality of apertures is provided through the outer wall. A trim member includes a front mounting portion and a rear mounting portion spaced-apart from one another along a body portion of the trim member. The front and rear mounting portions each include a plurality of apertures disposed therethrough. One or more of the apertures of the plurality of apertures of the rear mounting portion of the trim member align with one or more of the apertures of the plurality of apertures of the mounting bracket to define aligned mounting apertures therebetween. An inner surface of the rear mounting portion abuts the outer wall of the mounting bracket. An outer surface of the front mounting portion is configured to abut the inner surface of the cabinet structure.

According to another aspect of the disclosure, the apertures of the plurality of apertures provided through the outer wall of the mounting bracket include a threaded insert coupled thereto.

According to another aspect of the disclosure, a fastener is received in one or more of the aligned mounting apertures and threadingly engaged with the threaded insert.

According to yet another aspect of the disclosure, the plurality of apertures of the front mounting portion are disposed adjacent to a front edge of the trim member and vertically spaced-apart therealong.

According to yet another aspect of the disclosure, an appliance mounting system includes an appliance having a sidewall with an outer surface. A mounting bracket includes an inner wall spaced-apart from an outer wall. The outer wall includes a plurality of apertures provided therethrough. The inner wall is coupled to the outer surface of the sidewall of the appliance. A trim member includes first and second mounting portions. The first mounting portion and the second mounting portion each include a plurality of apertures disposed therethrough. One or more of the apertures of the plurality of apertures of the first mounting portion of the trim member align with one or more of the apertures of the plurality of apertures of the mounting bracket to define aligned mounting apertures therebetween. An inner surface of the first mounting portion abuts the outer wall of the mounting bracket. A cabinet structure includes a sidewall with an inner surface to at least partially define a cabinet enclosure. The appliance is received within the cabinet enclosure of the cabinet structure. An outer surface of the second mounting portion of the trim member abuts the inner surface of the sidewall of the cabinet structure.

According to another aspect of the disclosure, one or more apertures of the plurality of apertures provided through the outer wall of the mounting bracket include a threaded insert coupled thereto.

According to another aspect of the disclosure, a fastener is received in one or more of the aligned mounting apertures and threadingly engaged with the threaded insert.

According to another aspect of the disclosure, a fastener is received in one or more of the apertures of the plurality of apertures of the second mounting portion of the trim member to couple the trim member to the sidewall of the cabinet structure.

According to another aspect of the disclosure, the appliance includes a vacuum insulated cabinet structure having an external wrapper comprised of a metal material. The mounting bracket is welded to the external wrapper.

According to another aspect of the disclosure, the vacuum insulated cabinet structure includes a vacuum cavity positioned between the external wrapper and one or more liners. The vacuum cavity includes a negative internal pressure.

According to another aspect of the disclosure, the trim member includes an abutment portion inwardly offset from the first and second mounting portions. A portion of an inner surface of the abutment portion abuts the outer surface of the side wall of the appliance.

According to another aspect of the disclosure, a bracket system for use between an outer surface of an appliance and an inner surface of a cabinet structure includes a mounting bracket having a body portion with an inner wall spaced-apart from an outer wall and a sidewall interconnecting the inner wall and the outer wall. A first end of the body portion is positioned on the inner wall and a second end of the body portion is positioned on the outer wall. A plurality of tabs rearwardly extends from the second end of the outer wall, and the tabs of the plurality of tabs are vertically spaced-apart along a length of the body portion of the mounting bracket. A trim member includes first and second mounting portions, an abutment portion and a plurality of slots. The slots of the plurality of slots are vertically spaced-apart along a length of the trim member. The tabs of the plurality of tabs of the mounting bracket are received through respective slots of the plurality of slots of the trim member to couple the trim member to the mounting bracket. An inner surface of the first mounting portion abuts the outer wall of the mounting bracket as coupled thereto.

According to another aspect of the disclosure, the abutment portion of the trim member is inwardly offset from the first mounting portion by an inwardly angled transverse portion.

According to another aspect of the disclosure, the plurality of slots are disposed through the inwardly angled transverse portion of the trim member.

According to another aspect of the disclosure, each tab of the plurality of tabs of the mounting bracket is inwardly disposed relative to the outer wall of the mounting bracket.

According to another aspect of the disclosure, each tab of the plurality of tabs of the mounting bracket includes a body portion having an inner surface and an outer surface.

According to another aspect of the disclosure, each slot of the plurality of slots of the trim member includes a front edge and a rear edge which respectively abut the outer surface and the inner surface of the body portion of each tab of the plurality of tabs on opposite sides of the tab.

According to another aspect of the disclosure, an outer surface of the inner wall of the mounting member and a portion of an inner surface of the abutment portion of the trim member are configured to abut the outer surface of the appliance.

According to another aspect of the disclosure, an outer surface of the second mounting portion of the trim member is configured to abut the inner surface of the cabinet structure.

According to another aspect of the disclosure, a bracket system for use between an outer surface of an appliance and an inner surface of a cabinet structure includes a mounting bracket having a body portion with an outer wall and a plurality of hook members vertically spaced-apart along a length of the body portion. A trim member includes first and second mounting portions, an abutment portion and a plurality of cutouts. The cutouts of the plurality of cutouts are vertically spaced-apart along a length of the trim member. The hook members of the plurality of hook members of the mounting bracket are received through respective cutouts of the plurality of cutouts of the trim member to couple the trim member to the mounting bracket. An inner surface of the first mounting portion abuts the outer wall of the mounting bracket as coupled thereto.

According to another aspect of the disclosure, each hook member of the plurality of hook members of the mounting bracket includes an upwardly extending tab.

According to another aspect of the disclosure, each upwardly extending tab is outwardly disposed relative to the outer wall of the mounting bracket to define spacings positioned between each upwardly extending tab and the outer wall of the mounting bracket.

According to another aspect of the disclosure, each upwardly extending tab is disposed over an open aperture.

According to another aspect of the disclosure, portions of the second mounting portion disposed above each open aperture are received in the spacings when the trim member is coupled to the mounting bracket.

According to another aspect of the disclosure, each upwardly extending tab includes a body portion having an upper edge and first and second side edges, wherein the first and second side edges define a width of the body portion of each hook member, and further wherein the body portion of each hook member includes an inner surface and an outer surface.

According to another aspect of the disclosure, a bracket system for use between an outer surface of an appliance and an inner surface of a cabinet structure includes a mounting bracket having a body portion with an outer wall and a plurality of mounting flanges vertically spaced-apart along a length of the body portion. Each mounting flange of the plurality of mounting flanges includes a tab outwardly extending from the outer wall. A trim member includes a body portion with a plurality of cutouts. The cutouts of the plurality of cutouts are vertically spaced-apart along a length of the trim member. Each tab of each mounting flange of the plurality of mounting flanges of the mounting bracket is received through respective cutouts of the plurality of cutouts of the trim member to couple the trim member to the mounting bracket.

According to another aspect of the disclosure, each tab of the mounting bracket is disposed over an open aperture positioned through the body portion of the mounting bracket.

According to another aspect of the disclosure, each tab of the mounting bracket includes upper and lower transitional portions interconnecting each tab to the outer wall of the mounting bracket.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A bracket system, comprising:

a hinge bracket having a first portion with upper and lower surfaces, a second portion extending upwardly from the upper surface of the first portion of the hinge bracket and having front and rear surfaces, and a third portion extend outwardly in a forward direction from the second portion of the hinge bracket, wherein the hinge bracket further includes first and second sidewalls disposed on opposite ends of the hinge bracket; and a mounting bracket coupled to the hinge bracket and having first and second portions, wherein the first portion of the mounting bracket includes a body portion having first and second downwardly turned end walls disposed on opposite ends of the body portion of the first portion of the mounting bracket, wherein the first and second downwardly turned end walls of the first portion of the mounting bracket include apertures disposed therethrough that are aligned with apertures disposed on the first and second sidewalls of the hinge bracket, and further wherein the second portion of the mounting bracket includes a body portion having first and second downwardly turned end walls disposed on opposite ends of the body portion of the second portion of the mounting bracket.

2. The bracket system of claim 1, wherein the body portion of the second portion of the mounting bracket is positioned in a forward and upward configuration relative to the body portion of the first portion of the mounting bracket.

3. The bracket system of claim 2, wherein the first and second downwardly turned end walls of the second portion of the mounting bracket are positioned in a forward and outward configuration relative to the first and second downwardly turned end walls of the first portion of the mounting bracket.

4. The bracket system of claim 1, including:

a plurality of braces disposed along the first portion of the hinge bracket and upwardly extending therefrom.

5. The bracket system of claim 4, wherein each brace of the plurality of braces interconnects the first portion, second portion and third portion of the hinge bracket.

6. A bracket system, comprising:

a hinge bracket having a first portion with upper and lower surfaces, a second portion extending upwardly from the upper surface of the first portion of the hinge bracket and having front and rear surfaces, and a third portion extend outwardly in a forward direction from the front surface of the second portion of the hinge bracket, wherein the first portion is vertically offset from the third portion; and a mounting bracket having first and second portions, wherein the first portion of the mounting bracket includes a body portion having first and second downwardly turned end walls disposed on opposite ends of the body portion of the first portion of the mounting bracket, wherein the second portion of the mounting bracket includes a body portion having first and second downwardly turned end walls disposed on opposite ends of the body portion of the second portion of the mounting bracket, wherein the first and second downwardly turned end walls of the second portion of the mounting bracket are outwardly disposed relative to the first and second downwardly turned end walls of the first portion of the mounting bracket, and further wherein the body portion of the second portion of the mounting bracket is positioned in a forward and upward configuration relative to the body portion of the first portion of the mounting bracket.

7. The bracket system of claim 6, wherein the first and second downwardly turned end walls of the first portion of the mounting bracket include one or more apertures disposed therethrough.

8. The bracket system of claim 7, wherein the hinge bracket includes first and second sidewalls disposed on opposite ends of the hinge bracket and each having one or more apertures disposed therethrough.

9. The bracket system of claim 8, wherein the one or more apertures of the first and second sidewalls of the hinge bracket align with the one or more apertures of the first and second downwardly turned end walls of the first portion of the mounting bracket.

10. A mounting system, comprising:

a cabinet structure having a top wall with an inner surface, a first sidewall with an inner surface, and a second sidewall with an inner surface, wherein the top wall and the first and second sidewalls cooperate to partially define a cabinet enclosure;

an appliance received within the cabinet enclosure, wherein the appliance includes an upper surface;

a hinge bracket having a first portion with upper and lower surfaces, a second portion extending upwardly from the upper surface of the first portion of the hinge bracket, and a third portion extending outwardly in a forward direction from the second portion of the hinge bracket, wherein the third portion includes upper and lower surfaces, and further wherein the hinge bracket includes first and second sidewalls disposed on opposite ends of the hinge bracket; and a mounting bracket having first and second portions, wherein the first portion of the mounting bracket includes a body portion having first and second downwardly turned end walls disposed on opposite ends of the body portion of the first portion of the mounting bracket, wherein the first and second downwardly turned end walls of the first portion of the mounting bracket are coupled to the first and second sidewalls of the hinge bracket, respectively, and wherein the second portion of the mounting bracket includes a body portion having first and second downwardly turned end walls disposed on opposite ends of the body portion of the second portion of the mounting bracket-, and further wherein the first and second downwardly turned end walls of the second portion of the mounting bracket are outwardly disposed relative to the first and second downwardly turned end walls of the first portion of the mounting bracket.

11. The mounting system of claim 10, wherein the first and second downwardly turned end walls of the second portion of the mounting bracket are coupled to the inner surfaces of the first and second sidewalls of the cabinet structure, respectively.

12. The mounting system of claim 11, wherein the lower surface of the first portion of the hinge bracket abuts the upper surface of appliance.

13. The mounting system of claim 12, wherein the body portion of the second portion of the mounting bracket includes a plurality of apertures disposed therethrough.

14. The mounting system of claim 12, wherein the body portion of the second portion of the mounting bracket is coupled to the inner surface of the top wall of the cabinet structure.

15. The mounting system of claim 10, wherein the first portion of the hinge bracket is vertically offset from the third portion of the hinge bracket.

16. The mounting system of claim 15, wherein the hinge bracket includes a plurality of braces disposed along the first portion of the hinge bracket, and further wherein each brace of the plurality of braces interconnects the first portion, second portion and third portion of the hinge bracket.

* * * * *